US009690259B2

(12) United States Patent
Takyo et al.

(10) Patent No.: US 9,690,259 B2
(45) Date of Patent: Jun. 27, 2017

(54) ELECTRONIC TIMEPIECE

(71) Applicants: CITIZEN HOLDINGS CO., LTD., Tokyo (JP); CITIZEN WATCH CO., LTD., Tokyo (JP)

(72) Inventors: Yu Takyo, Nishitokyo (JP); Shogo Sezaki, Kodaira (JP); Toshiaki Fukushima, Tokorozawa (JP); Daisuke Iri, Nishitokyo (JP)

(73) Assignee: CITIZEN WATCH CO., LTD., Tokyo (JP)

( * ) Notice: Subject to any disclaimer, the term of this patent is extended or adjusted under 35 U.S.C. 154(b) by 6 days.

(21) Appl. No.: 14/915,253

(22) PCT Filed: Aug. 29, 2014

(86) PCT No.: PCT/JP2014/072820

§ 371 (c)(1),
(2) Date: Feb. 29, 2016

(87) PCT Pub. No.: WO2015/030205

PCT Pub. Date: Mar. 5, 2015

(65) Prior Publication Data

US 2016/0216695 A1 Jul. 28, 2016

(30) Foreign Application Priority Data

Aug. 29, 2013 (JP) ..... 2013-177806

(51) Int. Cl.
*G04C 3/14* (2006.01)

(52) U.S. Cl.
CPC ..... *G04C 3/143* (2013.01)

(58) Field of Classification Search
CPC ..... H02P 8/14
(Continued)

(56) References Cited

U.S. PATENT DOCUMENTS 4,492,903 A * 1/1985 Knight ..... H02P 6/00 318/373
5,889,734 A 3/1999 Sato
2012/0204640 A1 8/2012 Takyo

FOREIGN PATENT DOCUMENTS

JP H01-42395 B2 9/1989
JP H07-120567 A 5/1995
(Continued)

OTHER PUBLICATIONS

English Translation of International Search Report for PCT/JP2014/072820 dated Nov. 25, 2014.
(Continued)

*Primary Examiner* — David S Luo
(74) *Attorney, Agent, or Firm* — Hubbs, Enatsky & Inoue PLLC

(57) ABSTRACT

Provided is an electronic timepiece, including: a step motor; a motor driver; a normal drive pulse generation circuit configured to output a normal drive pulse at a designated drive rank; a rotation detection pulse generation circuit configured to output a detection pulse; a rotation detection circuit which comprises at least a first detection mode determination circuit configured to conduct determination in a first detection mode and which is configured to detect rotation or non-rotation of a rotor; a rotation determination counter circuit configured to count a number of times that the rotation has been successively detected by the rotation detection circuit; a first detection mode determination counter circuit configured to count a number of times that a detection signal generated by the detection pulse becomes a predetermined detection pattern in the first detection mode; and a drive rank selection circuit configured to designate a drive rank of the normal drive pulse based on results of the counting conducted by the rotation determination counter
(Continued)

circuit and the first detection mode determination counter circuit.

16 Claims, 31 Drawing Sheets

(58) Field of Classification Search
USPC ..... 318/696, 34
See application file for complete search history.

(56) References Cited

FOREIGN PATENT DOCUMENTS

| | | | |
|---|---|---|---|
| JP | H08-33457 | B2 | 3/1996 |
| JP | H09-266697 | A | 10/1997 |
| JP | 2009-288133 | A | 12/2009 |
| JP | 2013-122391 | A | 6/2013 |
| WO | 95/27926 | A1 | 10/1995 |
| WO | 2011/043389 | A1 | 4/2011 |

OTHER PUBLICATIONS

Search Report and the European Search Opinion of Mar. 16, 2017, for corresponding EP Patent Application No. 14839800.1.

* cited by examiner

FIG.4

| DRIVE RANK | 16/32 | 17/32 | 18/32 | 19/32 | 20/32 | 21/32 | 22/32 | 23/32 | 24/32 | 25/32 | 26/32 | 27/32 |
|---|---|---|---|---|---|---|---|---|---|---|---|---|
| 1.20V | FP | FP | FP | FP | FP | FP | FP | FP | SP | SP | SP | SP |
| 1.35V | FP | FP | FP | FP | FP | FP | SP | SP | SP | SP | ***FP*** | ***FP*** |
| 1.50V | FP | FP | FP | SP | SP | SP | SP | ***FP*** | ***FP*** | ***SP*** | ***SP*** | ***SP*** |
| 1.65V | FP | FP | SP | SP | SP | ***FP*** | ***FP*** | ***SP*** | ***SP*** | ***SP*** | ***SP*** | ***SP*** |
| 1.80V | SP | SP | SP | ***FP*** | ***FP*** | ***SP*** | ***SP*** | ***SP*** | ***SP*** | ***SP*** | ***SP*** | ***SP*** |

FIG.22

| DRIVE RANK | 16/32 | 17/32 | 18/32 | 19/32 | 20/32 | 21/32 | 22/32 | 23/32 | 24/32 | 25/32 | 26/32 | 27/32 |
|---|---|---|---|---|---|---|---|---|---|---|---|---|
| 1.20V | FP | FP | FP | FP | FP | FP | FP | FP | FP | FP | ***SP*** | ***SP*** |
| 1.35V | FP | FP | FP | FP | FP | FP | FP | FP | ***SP*** | ***SP*** | ***FP*** | ***FP*** |
| 1.50V | FP | FP | FP | FP | FP | FP | ***SP*** | ***SP*** | ***SP*** | ***FP*** | ***FP*** | ***SP*** |
| 1.65V | FP | FP | FP | FP | ***SP*** | ***SP*** | ***FP*** | ***FP*** | ***SP*** | ***SP*** | ***FP*** | ***SP*** |
| 1.80V | FP | FP | ***SP*** | ***SP*** | ***FP*** | ***FP*** | ***SP*** | ***SP*** | ***SP*** | ***SP*** | ***SP*** | ***SP*** |

FIG.28

| DRIVE RANK | 16/32 | 17/32 | 18/32 | 19/32 | 20/32 | 21/32 | 22/32 | 23/32 | 24/32 | 25/32 | 26/32 | 27/32 | 28/32 | 29/32 | 30/32 |
|---|---|---|---|---|---|---|---|---|---|---|---|---|---|---|---|
| 1.05V | FP | FP | FP | FP | FP | FP | FP | FP | FP | FP | FP | SP | SP | SP | SP |
| 1.20V | FP | FP | FP | FP | FP | FP | FP | FP | SP | SP | SP | SP | ***FP*** | ***FP*** | ***SP*** |
| 1.35V | FP | FP | FP | FP | FP | FP | SP | SP | SP | SP | ***FP*** | ***FP*** | ***SP*** | ***SP*** | ***SP*** |
| 1.50V | FP | FP | FP | SP | SP | SP | SP | ***FP*** | ***FP*** | ***SP*** | ***SP*** | ***SP*** | ***SP*** | ***SP*** | ***SP*** |
| 1.65V | FP | FP | SP | SP | SP | ***FP*** | ***FP*** | ***SP*** | ***SP*** | ***SP*** | ***SP*** | ***SP*** | ***SP*** | ***SP*** | ***FP2*** |
| 1.80V | SP | SP | SP | ***FP*** | ***FP*** | ***SP*** | ***SP*** | ***SP*** | ***SP*** | ***SP*** | ***SP*** | ***SP*** | ***FP2*** | ***FP2*** | ***SP2*** |

(d) 1.80V PRESENT INVENTION

ELECTRONIC TIMEPIECE

CROSS REFERENCE TO RELATED APPLICATIONS

This application is a National Stage of International Application No. PCT/JP2014/072820 filed on Aug. 29, 2014, which claims priority to Japanese Patent Application No. 2013-177806 filed on Aug. 29, 2013. The contents of each of the above documents are incorporated herein by reference in their entirety.

TECHNICAL FIELD

The present invention relates to an electronic timepiece including a stepping motor.

BACKGROUND ART

In the related art, in an electronic timepiece, there has been adopted a method in which, in order to reduce current consumption, a plurality of normal drive pulses are prepared and one of the normal drive pulses that can be driven with a minimum energy is always selected to drive a motor. To briefly describe the selection method, a normal drive pulse is output first, and subsequently it is determined whether or not the motor has rotated. Then, when the motor has not rotated, a compensation driving pulse is output immediately to positively rotate a rotor, and the next time the normal drive pulse is output, a switch is made to output a normal drive pulse having a driving force that is one rank higher than the previous one. On the other hand, when the motor has rotated, the next time the normal drive pulse is output, the same normal drive pulse as the previous one is output. Then, the normal drive pulse is selected by a method in which, when the same driving pulse is output a predetermined number of times, a switch is made to a normal drive pulse having a driving force that is lower by one rank.

Note that, as the related-art method of detecting whether or not the rotor has rotated, there has often been used a method in which, after finishing application of the normal drive pulse, a rotation detection pulse is output to steeply change an impedance value of a coil of a stepping motor, and an induced voltage generated in the coil is detected across coil terminals to make a rotation determination based on a free vibration pattern of a rotor. For example, one of two drive inverters respectively connected to both ends of a coil is first operated in a first detection mode to output a rotation detection pulse, and the first detection mode is stopped when a rotation detection signal occurs. Meanwhile, another drive inverter is operated in a second detection mode to output a rotation detection pulse, and a rotation success is determined when a rotation detection signal occurs in the second detection mode.

In the second detection mode, it is detected that the rotation has been successful, that is, a rotor has exceeded a peak of a magnetic potential. The detection in the first detection mode before the second detection mode is conducted in order to prevent detection of an erroneous detection signal that may occur before the rotor has completely exceeded the peak of the magnetic potential in a case of being driven relatively weakly, and in order to prevent the detection signal from being erroneously detected as a signal that has exceeded the magnetic potential even before the rotation of the rotor has been finished. Therefore, a technology for conducting first detection mode before the second detection mode is known to be effective for conducting rotation detection more positively (see, for example, Patent Literature 1, Patent Literature 2, and Patent Literature 3).

Note that, in Patent Literature 4, as the method of changing the driving force of the normal drive pulse, there is described a method in which a driving pulse is composed of a plurality of subpulses (hereinafter referred to as "choppers"), and duties of the subpulses (choppers) are controlled to change pulse widths. Note that, such a driving pulse is hereinafter referred to as "chopper driving pulse".

CITATION LIST

Patent Literature

[PTL 1] JP 7-120567 A (paragraphs 0018 to 0024 and FIG. 8)

[PTL 2] JP 8-33457 B (page 3, sixth column, line 26 to page 4, column 7, line 39, and FIGS. 4 to 6)

[PTL 3] JP 1-42395 B (page 5, column 9)

[PTL 4] JP 9-266697 A (paragraph 0013 and FIG. 6)

SUMMARY OF INVENTION

Technical Problem

When a battery exhibiting a large voltage fluctuation, such as a lithium battery used for a timepiece with a solar power generation function or the like, is used for a timepiece, there is need to provide a plurality of normal drive pulses different in driving force depending on the voltage fluctuation, but when a temporary load imposed by a calendar operation or the like acts thereon, the normal drive pulse is raised in rank of the driving force, and the driving is maintained with a normal drive pulse having a large driving force for a while even after the load is removed. Normally, after the normal drive pulse having a large driving force is output a fixed number of times, the normal drive pulse is lowered in rank to a normal drive pulse having a driving force smaller by one rank. However, when a plurality of normal drive pulses are provided with the voltage fluctuation being large, even after the load is removed, some combinations of a power supply voltage and a normal drive pulse are erroneously determined to exhibit non-rotation despite the fact of exhibiting rotation depending on the combination, which raises a problem in that the normal drive pulse fails to be lowered in rank to become stable at a drive rank of the normal drive pulse having a large driving force and to increase in current consumption.

Against this backdrop, when rotation has been successively determined to be exhibited a fixed number of times at every drive rank, for example, the drive rank is lowered straight down to the drive rank exhibiting a smallest driving force, to thereby be able to avoid a state in which the drive rank cannot be lowered from a drive rank exhibiting a large driving force. However, depending on the drive voltage, the drive rank is raised repeatedly until a drive rank that allows rotation with a minimum driving force is attained, which also raises a problem in that a correction drive pulse having a large driving force is output each time the drive rank is raised, resulting in increase in current consumption, and that a hand appears to be moving fractionally for several seconds because a rotation oscillation due to an excess driving force of the correction drive pulse is transmitted to the hand through a wheel train.

Note that, the above-mentioned problems can be handled by finely setting a rotation detection pulse based on the power supply voltage and the drive rank, but in this case, a circuit scale becomes large.

It is an object of the present invention to provide an electronic timepiece that can be realized with a circuit having a relatively small size, supports a drive voltage within a wide range, and can also be driven with low current consumption.

Solution to Problem

In order to achieve the above-mentioned object, the present invention is configured as follows. That is, according to one embodiment of the present invention, there is provided an electronic timepiece, including: a step motor including a coil and a rotor; a motor driver configured to drive the step motor; a normal drive pulse generation circuit configured to output a normal drive pulse at a drive rank designated from among normal drive pulses at a plurality of drive ranks different in driving force; a rotation detection pulse generation circuit configured to output a detection pulse at a predetermined timing after the outputting of the normal drive pulse; a rotation detection circuit which includes at least a first detection mode determination circuit configured to conduct determination in a first detection mode after the outputting of the normal drive pulse and which is configured to detect rotation or non-rotation of the rotor based on a detection signal generated by the detection pulse; a rotation determination counter circuit configured to count a number of times that the rotation has been successively detected by the rotation detection circuit; a first detection mode determination counter circuit configured to count a number of times that the detection signal generated by the detection pulse becomes a predetermined detection pattern in the first detection mode; and a drive rank selection circuit configured to designate a drive rank of the normal drive pulse to be output by the normal drive pulse generation circuit based on results of the counting conducted by the rotation determination counter circuit and the first detection mode determination counter circuit.

Advantageous Effects of Invention

As described above, according to the one embodiment of the present invention, a rank to which a rank is to be lowered is switched through rotation determination based on a pattern of a free oscillation of a rotor, and hence a current consumption can be suppressed by inhibiting the rotor from remaining stable with a large driving force even when a power supply voltage has a wide range, which allows the rotor to be rotated with a minimum driving force. Further, the one embodiment of the present invention can be realized with a simple circuit configuration, and can be easily integrated into a related-art product without making a large change in the circuit configuration.

BRIEF DESCRIPTION OF DRAWINGS

FIG. 4 is a matrix table for showing a determination result of rotation or non-rotation obtained by changing a power supply voltage and a drive rank according to the first embodiment, the second embodiment, the third embodiment, the fourth embodiment, and the sixth embodiment of the present invention.

FIG. 22 is a matrix table for showing a determination result of rotation or non-rotation obtained by changing a power supply voltage and a drive rank according to the fifth embodiment of the present invention.

FIG. 28 is a matrix table for showing a determination result of rotation or non-rotation obtained by changing a power supply voltage and a drive rank according to the seventh embodiment of the present invention.

DESCRIPTION OF EMBODIMENTS

First Embodiment

A first embodiment of the present invention relates to an example of switching a drive rank to which a drive rank is to be lowered based on the number of times that detection has been conducted prior to a predetermined time point in a first detection mode when it is determined a fixed number of times that rotation has been exhibited with a predetermined normal drive pulse. Now, the first embodiment according to the present invention is described with reference to the accompanying drawings.

Figure 1:
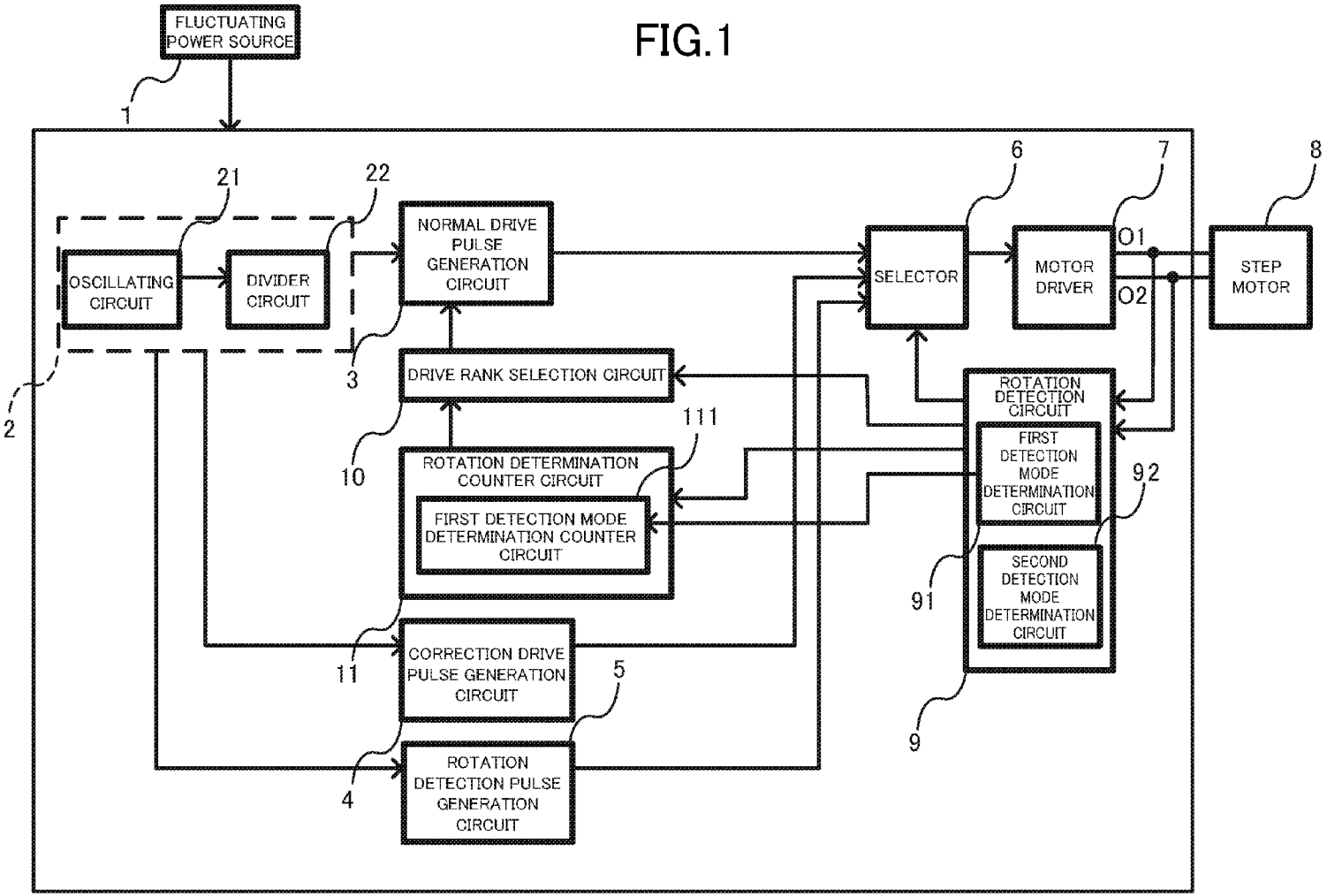
FIG. 1 is a block diagram for illustrating a circuit configuration according to a first embodiment, a second embodiment, a fourth embodiment, and a sixth embodiment of the present invention.
Figure 2:
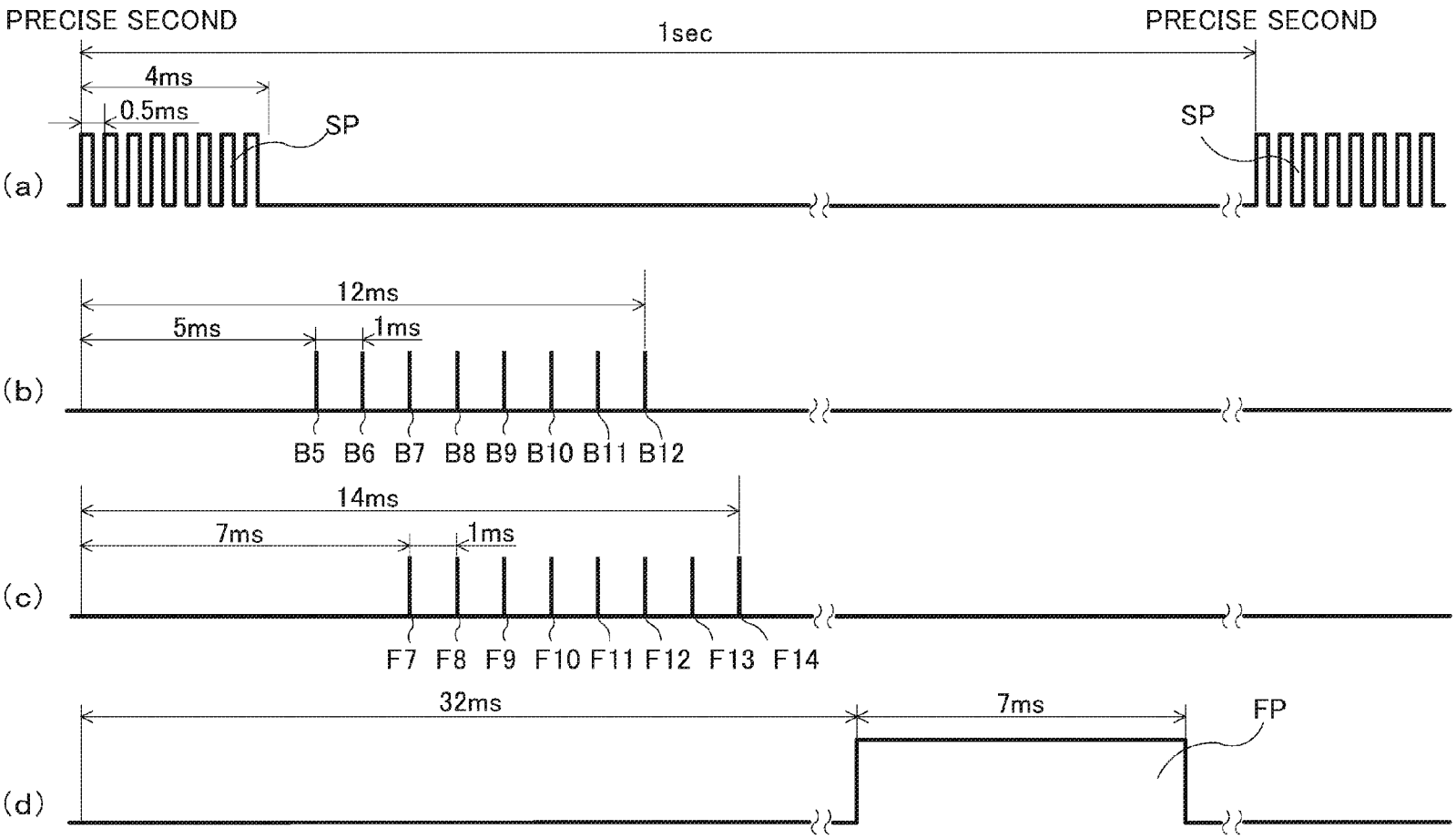
FIG. 2 are waveform diagrams for illustrating a pulse generated by a circuit of an electronic timepiece according to the first embodiment, the second embodiment, a third embodiment, a fifth embodiment, the sixth embodiment, and a seventh embodiment of the present invention.
Figure 3:
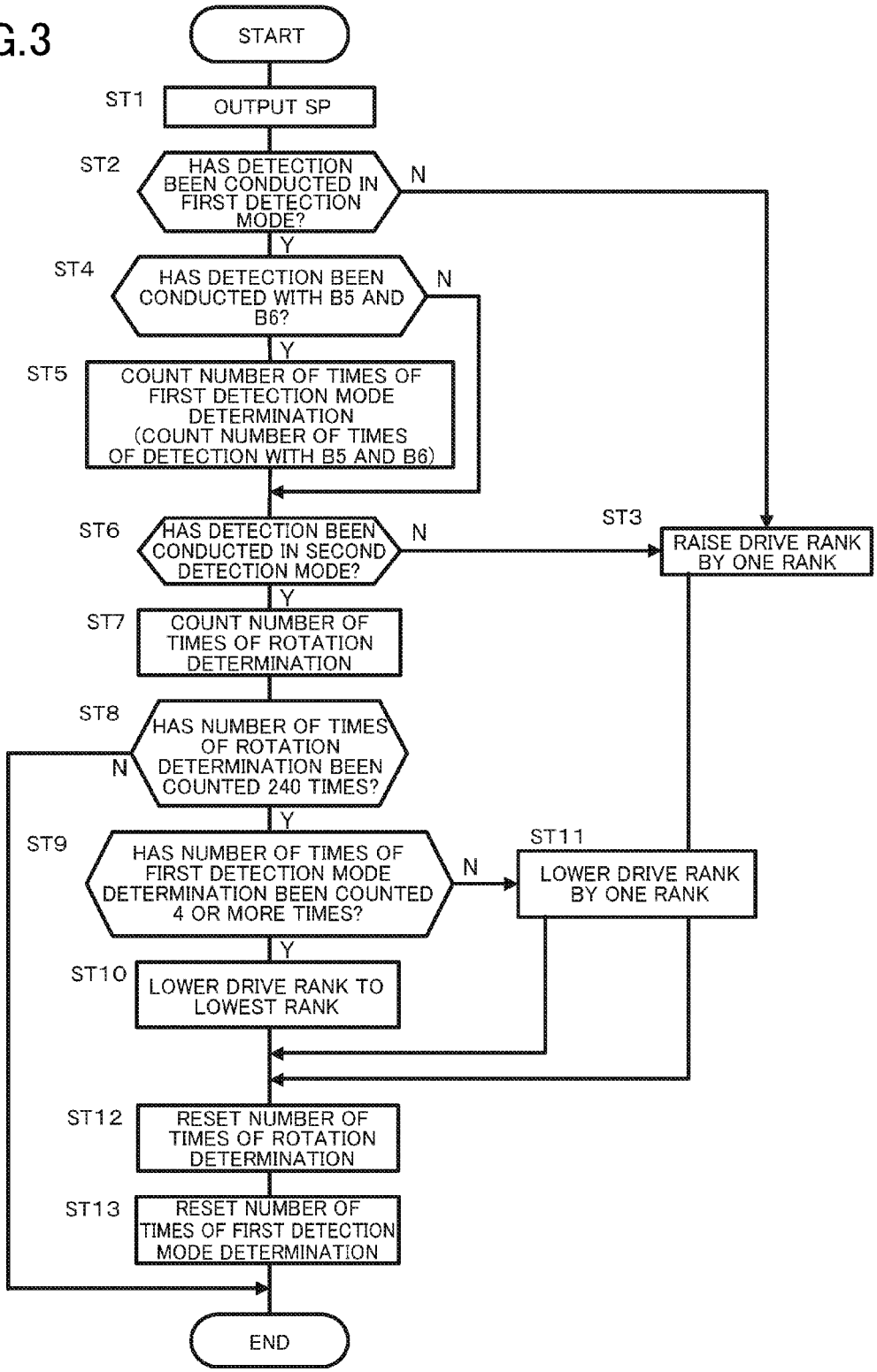
FIG. 3 is a flowchart of the first embodiment of the present invention.
Figure 5:
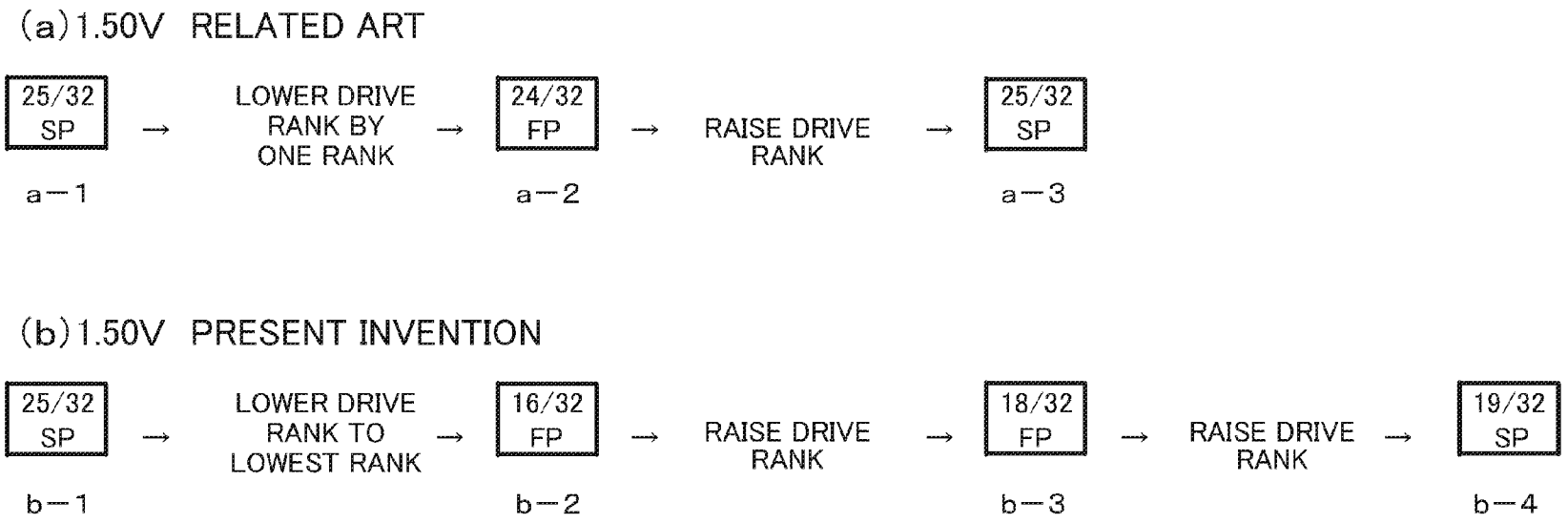
FIG. 5 are diagrams for schematically illustrating changes in the drive rank from a stable state at a drive rank 25/32 according to the first embodiment, the second embodiment, the third embodiment, and the fourth embodiment of the present invention and according to the related art.

FIG. 1 is a block diagram for illustrating a circuit configuration of an electronic timepiece according to the first embodiment of the present invention, FIG. 2 are waveform diagrams of a pulse generated by a circuit of the electronic timepiece according to the first embodiment of the present invention, FIG. 3 is a flowchart of the first embodiment of the present invention, FIG. 4 is a matrix table for showing a determination result of rotation or non-rotation obtained by changing a power supply voltage and the drive rank according to the first embodiment of the present invention, FIG. 5 are diagrams for schematically illustrating a change in the drive rank from a stable state at a drive rank 25/32 according to the first embodiment of the present invention and according to the related art, and FIG. 6, FIG. 7, FIG. 8, and FIG. 9 are waveform diagrams of the pulse generated by the circuit of the electronic timepiece and a waveform diagram of the current generated in a coil according to the first embodiment of the present invention.

A description is made with reference to FIG. 1. Reference numeral 1 denotes a fluctuating power source including a rechargeable/dischargeable secondary battery such as a lithium battery and power generation means such as a solar cell and involving a voltage fluctuation, and reference numeral 2 denotes a reference signal generation circuit including an oscillating circuit 21 configured to generate a reference timepiece through use of oscillation of a quartz resonator (not shown) and a divider circuit 22 configured to frequency-divide a reference signal output from the oscillating circuit 21. Reference numeral 3 denotes a normal drive pulse generation circuit configured to generate such a normal drive pulse SP as illustrated in FIG. 2(*a*) every 0.5 ms in a 4.0-ms width based on a timing signal output from the reference signal generation circuit 2, and output the normal drive pulse SP every precise second. Note that, the normal drive pulse SP is generated every 1/32 with a chopper duty cycle of from 16/32 to 27/32, and based on a drive rank selection circuit 10 described later, a normal drive pulse having a predetermined chopper duty cycle is selected and output.

Reference numeral 4 denotes a correction drive pulse generation circuit configured to generate and output such a 7-ms correction drive pulse FP as illustrated in FIG. 2(*d*) based on the reference signal generation circuit 2. When a rotor (not shown) of a step motor 8 described later is determined to exhibit non-rotation, the correction drive pulse FP is output after 32 ms has elapsed since the normal drive pulse SP is output.

Reference numeral 5 denotes a rotation detection pulse generation circuit configured to generate and output rotation detection pulses B5 to B12 to be used in the first detection mode and rotation detection pulses F7 to F14 to be used in a second detection mode based on the reference signal generation circuit 2. The rotation detection pulses B5 to B12 are such 0.125-ms-width pulses as illustrated in FIG. 2(*b*), and are output every 1 ms from 5 ms to 12 ms after the output of the normal drive pulse SP. The rotation detection pulses F7 to F14 are such 0.125-ms-width pulses as illustrated in FIG. 2(*c*), and are output every 1 ms from 7 ms to 14 ms after the output of the normal drive pulse SP.

Reference numeral 6 denotes a selector configured to select and output the pulses output from the normal drive pulse generation circuit 3, the correction drive pulse generation circuit 4, and the rotation detection pulse generation circuit 5 based on a determination result of a rotation detection circuit 9 described later.

Reference numerical 7 denotes a motor driver configured to supply the signal output from the selector 6 to a coil (not shown) of a bipolar step motor 8 described later, and transmit a rotation state of a rotor of the step motor 8 to the rotation detecting circuit 9 described later. Therefore, the motor driver 7 has two output terminals O1 and O2 for supplying the signal to the coil of the step motor 8.

Reference numeral 8 denotes a step motor including a coil and a rotor, which is configured to drive hands (not shown) via a wheel train (not shown).

Reference numeral 9 denotes a rotation detection circuit including a first detection mode determination circuit 91 configured to conduct determination in the first detection mode and a second detection mode determination circuit 92 configured to conduct determination in the second detection mode, which is configured to determine the rotation or non-rotation of the rotor of the step motor 8 from an induced voltage generated in the coil during periods of the first detection mode and the second detection mode, and control the selector 6 and a drive rank selection circuit 10, a rotation determination counter circuit 11, and a first detection mode determination counter circuit 111 that are described later.

Note that, the rotation detection pulses B5 to B12 are output to a terminal on a side opposite to a terminal to which the normal drive pulse SP has been output, and an impedance of a closed loop including the coil is changed steeply, to thereby amplify the induced voltage generated by a free oscillation of the rotor to which the normal drive pulse SP has been applied, and to detect the induced voltage by the rotation detection circuit 9. Further, the rotation detection pulses F7 to F14 are output to the terminal on the same side as the terminal to which the normal drive pulse SP has been output, and the impedance of the closed loop including the coil is changed steeply, to thereby amplify the induced voltage generated by the free oscillation of the rotor to which the normal drive pulse SP has been applied, and to detect the induced voltage by the rotation detection circuit 9.

Specifically, both terminals O1 and O2 are maintained at the same potential when a rotation detection pulse is not being output, and a state of the closed loop including the coil is set to a high impedance state when the rotation detection pulse is being output. As soon as the high impedance state is effected, the induced voltage generated in the coil by the free oscillation of the rotor is detected, and rotation detection of the rotor is conducted by this detection signal.

Reference numeral 10 denotes a drive rank selection circuit, and the drive rank selection circuit is configured to select the drive rank of a predetermined normal drive pulse to control the normal drive pulse generation circuit 3 when the rotor is determined to exhibit non-rotation by the rotation detection circuit 9, when the fact that the rotor exhibits rotation has been counted a predetermined number of times by the rotation determination counter circuit 11 described later, and when the fact that detection has been conducted prior to the predetermined time point in the first detection mode has been counted a predetermined number of times by the first detection mode determination counter circuit 111 described later. In this case, the chopper duty cycles of the normal drive pulses 16/32 to 27/32 correspond to respective drive ranks. As the chopper duty cycle becomes larger, a driving force of the step motor 8 becomes larger.

That is, the drive rank selection circuit 10 is controlled so that the correction drive pulse FP is caused to be output and the drive rank is raised by one rank when the rotor is determined to exhibit non-rotation by the rotation detection circuit 9, and that the drive rank is lowered to a predetermined drive rank when the rotor has been successively determined to exhibit rotation a predetermined number of times by the rotation determination counter circuit 11 described later.

Reference numeral 11 denotes a rotation determination counter circuit, and the rotation determination counter circuit is configured to count the number of times that the rotor of the step motor 8 has been determined to exhibit rotation, and control the drive rank selection circuit 10 when the predetermined number of times has been counted. Further, the rotation determination counter circuit 11 includes the first detection mode determination counter circuit 111 configured to count the number of times that the detection signal detected in the first detection mode has been detected in a predetermined detection pattern, that is, in this embodiment, has been detected prior to the predetermined time point, and controls the drive rank selection circuit 10 when the predetermined number of times has been counted. The rotation determination counter circuit 11 is configured to be reset when the rotor is determined to exhibit non-rotation, and count the number of times that rotation has been successively determined to be exhibited, and the first detection mode determination counter circuit 111 is configured to count the number of times that detection has been conducted prior to the predetermined time point in the first detection mode within the number of times that rotation has been successively determined to be exhibited. The drive rank selection circuit 10 is controlled so that the drive rank to which the drive rank is to be lowered is changed, that is, a manner of changing the drive rank is changed, based on whether or not the number of times that detection has been conducted in the first detection mode prior to the predetermined time point is equal to or larger than the predetermined number of times. Note that, after the drive rank is changed, the rotation determination counter circuit 11 and the first detection mode determination counter circuit 111 are reset.

Next, an operation of the above-mentioned configuration is described with reference to a flowchart of FIG. 3. The operation conducted at every precise second is illustrated in the flowchart. First, the normal drive pulse SP output from the normal drive pulse generation circuit 3 at a timing of a precise second is selected and output by the selector 6 to drive the step motor 8 through the motor driver 7 (Step ST1). Then, 5 ms after the precise second, the rotation detection in the first detection mode is started. In the first detection mode, the selector 6 selects and outputs the rotation detection pulses B5 to B12 that have been output from the rotation detection pulse generation circuit 5, and controls the step motor 8 so as to change the impedance of the coil. Then, the rotation detection circuit 9 detects induced voltages generated in the coil by the rotation detection pulses B5 to B12 through the motor driver 7 (Step ST2).

Meanwhile, the rotation detection circuit 9 instructs the first detection mode determination circuit 91 to start a determination operation. The first detection mode determination circuit 91, which is configured to determine presence or absence of the detection signal in the first detection mode based on the number of times that the detection signal has been input from the rotation detection circuit 9, determines the fact of detection when the detection signal from the rotation detection circuit 9 has occurred two times, immediately stops the output of the rotation detection pulse in the first detection mode being output from the rotation detection pulse generation circuit 5, notifies the selector 6 that the operation in the first detection mode is to be brought to an end, and instructs the selector 6 to shift to the second detection mode (Step ST2: Y). In a case where the detection signal from the rotation detection circuit 9 has occurred two times in the first detection mode, when the detection signal is the detection signal based on the rotation detection pulses B5 and B6 (Step ST4: Y), the number of occurrences of the detection signal based on the rotation detection pulses B5 and B6 is counted by the first detection mode determination counter circuit 111. When no detection signal or only one detection signal occurs based on the rotation detection pulses B5 and B6, the first detection mode determination counter circuit 111 is inhibited from counting the number of occurrences, and a shift is made to the second detection mode (Step ST4: N).

When no detection signal or only one detection signal occurs based on the rotation detection pulses B5 to B12, a rotation failure is determined to bring the operation in the first detection mode to an end, and the correction drive pulse FP is immediately selected and output by the selector 6 without the shift made to the second detection mode (Step ST2: N), while the drive rank selection circuit 10 is instructed to select and output the normal drive pulse SP having a driving force larger by one rank than the previous normal drive pulse SP from the normal drive pulse generation circuit 3 when a normal drive pulse is output at the subsequent precise second (Step ST3). In this case, when the number of times that rotation has been determined to be exhibited has been counted by the rotation determination counter circuit 11 after the operation at every precise second has been conducted several times, a count value thereof is reset (Step ST12), and when the number of times that both the rotation detection pulses B5 and B6 in the first detection mode have been detected by the rotation detection circuit 9 has been counted by the first detection mode determination counter circuit 111, a count value thereof is also reset to bring the operation at a precise second to an end (Step ST13).

When the shift is made to the second detection mode, the selector 6 selects and outputs the rotation detection pulses F7 to F14 that have been output from the rotation detection pulse generation circuit 5, and controls the step motor 8 so as to change the impedance of the coil in the same manner as in the first detection mode. Then, the rotation detection circuit 9 detects induced voltages generated in the coil by the rotation detection pulses F7 to F14 through the motor driver 7 (Step ST6).

The second detection mode determination circuit 92, which is configured to determine presence or absence of the detection signal in the second detection mode based on the number of times that the detection signal has been input from the rotation detection circuit 9, determines a rotation success when the detection signal from the rotation detection circuit 9 has occurred one time, immediately stops the output of the rotation detection pulse in the second detection mode being output from the rotation detection pulse generation circuit 5, brings the operation in the second detection mode to an end, and controls the selector 6 so as not to output the correction drive pulse FP (Step ST6: Y). Then, the number of times that the rotation success has been determined is counted by the rotation determination counter circuit 11 (Step ST7).

However, the detection signal generated by the rotation detection pulses F7 to F14 is stopped with at most 3 times of detection. When no detection signal occurs during that period, the rotation failure is determined to output the correction drive pulse FP (Step ST6: N), and the drive rank selection circuit 10 is instructed to select and output the normal drive pulse SP having the driving force larger by one rank than the previous normal drive pulse SP from the normal drive pulse generation circuit 3 when the normal drive pulse is output at the subsequent precise second (Step ST3). In the same manner as described above, the count value of the rotation determination counter circuit 11 is reset (Step ST12), and the count value of the first detection mode determination counter circuit 111 is also reset to bring the operation at a precise second to an end (Step ST13).

Further, when the rotation success has been determined in the second detection mode and when the number of times that the rotation success has been determined by the rotation determination counter circuit. 11 has not reached 240 times as a result of conducting the operation at every precise second several times, the operation at a precise second is brought to an end, and the drive rank selection circuit 10 is controlled so as to successively output the normal drive pulse SP having the same drive rank as the previous one (Step ST8: N), but when the number of times that the rotation success has been determined by the rotation determination counter circuit 11 reaches 240 times as a result of conducting the operation at every precise second several times, the count value of the first detection mode determination counter circuit 111 is confirmed (Step ST8: Y). The first detection mode determination counter circuit 111 is a circuit configured to count the number of times that both the rotation detection pulses B5 and B6 in the first detection mode have been detected, and when a counter value of the first detection mode determination counter circuit 111 is 4 or more times within the number of times that the rotation success has been determined 240 times by the rotation determination counter circuit 11 (Step ST9: Y), the first detection mode determination counter circuit 111 instructs the drive rank selection circuit 10 to select and output a normal drive pulse SP having a smallest driving force (Step ST10). In the same manner as described above, the count value of the rotation determination counter circuit 11 is reset (Step ST12), and the count value of the first detection mode determination counter circuit 111 is also reset to bring the operation at a precise second to an end (Step ST13). In contrast, when the counter value of the first detection mode determination counter circuit 111 is not 4 or more times (Step ST9: N), the drive rank selection circuit 10 is instructed to select and output a normal drive pulse SP having a driving force smaller by one rank (Step ST1). In the same manner as described above, the count value of the rotation determination counter circuit 11 is reset (Step ST12), and the count value of the first detection mode determination counter circuit 111 is also reset to bring the operation at a precise second to an end (Step ST13).

Next, a description is made of an operation with actual rotation detection described above taken into consideration based on a result of an experiment conducted by the applicant. FIG. 4 is a matrix table for showing the determination result of rotation or non-rotation of the rotor obtained by changing drive ranks 16/32 to 27/32 of the first embodiment every 1/32 and changing the power supply voltage in steps of 0.15 V from 1.20 V to 1.80 V.

In FIG. 4, the region of an FP indication means such a drive rank that the rotor has failed to be rotated with the normal drive pulse SP and has been properly determined to exhibit non-rotation by the rotation detection circuit 9, the correction drive pulse FP is immediately output to positively rotate the rotor, and the normal drive pulse SP having the driving force larger by one rank than the previous normal drive pulse SP is to be output at a timing of the subsequent precise second.

The region of an SP indication means a drive rank to be lowered to a drive rank of the normal drive pulse SP having the driving force smaller by one rank when the rotor has been successfully rotated with the normal drive pulse SP and has been properly determined to exhibit rotation by the rotation detection circuit 9, and has been successively rotated with the same normal drive pulse SP 240 times while the normal drive pulse SP is output also at the timing of the subsequent precise second.

The region of a bold italic FP indication means such a drive rank that the rotor has been successfully rotated with the normal drive pulse SP but has been erroneously determined to exhibit non-rotation by the rotation detection circuit 9, the correction drive pulse FP is output, and the normal drive pulse SP having the driving force larger by one rank than the previous normal drive pulse SP is to be output at the timing of the subsequent precise second.

The region of a bold italic SP indication means a drive rank to be lowered to a drive rank of the normal drive pulse SP exhibiting the smallest driving force when the rotor has been successfully rotated with the normal drive pulse SP and has been properly determined to exhibit rotation by the rotation detection circuit 9, and has been successively rotated with the same normal drive pulse SP 240 times while the normal drive pulse SP is output also at the timing of the subsequent precise second.

In regard to details within the regions of the drive rank according to this embodiment described above, an actual change in the drive rank is described in comparison with the related art.

FIG. 5 are diagrams for schematically illustrating changes in the drive rank from a state in which the drive rank has been raised from a drive rank that allows the rotation to be conducted with a minimum driving force due to a temporary load imposed with 1.50 V to become stable after removal of the load at the drive rank 25/32 exhibiting a relatively large driving force, which is indicated in the region of a bold italic SP indication, according to the related art and the embodiment of the present invention.

With reference to FIG. 5(*a*) "1.50 V Related Art", in the case of the related art, when the rotation has been successively conducted at the drive rank 25/32 of the same normal drive pulse SP 240 times (a-1), the drive rank is lowered to the drive rank 24/32 exhibiting a driving force smaller by one rank (a-2). However, the drive rank 24/32 falls within the region of the bold italic FP indication, and is to be raised again to the drive rank 25/32 exhibiting the driving force larger by one rank (a-3). That is, once the drive rank 25/32 within the region of the bold italic SP indication is reached, the drive rank cannot be lowered to the drive rank 19/32 that allows the rotation to be conducted with the minimum driving force, and becomes stable at the drive rank 25/32 having the relatively large driving force, which causes an increase in current consumption.

With reference to FIG. 5(*b*) "1.50 V Present Invention", in the case of this embodiment, when the rotation has been successively conducted at the drive rank 25/32 of the same normal drive pulse SP 240 times (b-1), the drive rank is lowered straight down to the drive rank 16/32 exhibiting the smallest driving force (b-2). The drive ranks 16/32 to 18/32 fall within the regions of the FP indication, and each time the operation at a precise second is conducted, the drive rank is repeatedly raised to the driving forces 17/32 and 18/32 larger by one rank (b-3). When the drive rank is raised to the drive rank 19/32 that falls within the region of the SP indication and allows the rotation to be conducted with the minimum driving force, the drive rank becomes stable (b-4). Note that, when the rotation has been successively conducted at the same drive rank 19/32 240 times, the same drive rank 19/32, which falls within the region of the SP indication, is lowered to the drive rank 18/32 lower by one rank. As described above, the drive rank 18/32, which falls within the region of the FP indication, is to be raised, but the drive rank becomes stable again at the drive rank 19/32, and thus raised and lowered repeatedly every 240 times.

That is, according to this embodiment, the rotation can be basically conducted with stability within the region of the SP indication, and hence the rotation can be conducted with the minimum driving force based on the power supply voltage even when a fluctuation occurs in the power supply voltage, which allows the rotation to be conducted with low current consumption. For example, even when the drive rank is raised due to a temporary load imposed by calendar driving or the like to fall within the region of the bold italic SP indication, the drive rank is lowered to the drive rank exhibiting the smallest driving force after the rotation has been conducted the predetermined number of times, and hence the rotation can be conducted within the region of the SP indication while the drive rank is inhibited from becoming stable at a drive rank exhibiting a large driving force. Note that, in this case, the drive rank is lowered to the drive rank exhibiting the smallest driving force, and is therefore, as described above, raised repeatedly for a while until the rotation can be conducted within the region of the SP indication depending on the power supply voltage, and the correction drive pulse FP is successively output for several seconds. However, the drive rank does not fall within the region of the bold italic SP indication unless a temporary load or the like is imposed, and hence such a phenomenon that a hand appears to be moving fractionally is suppressed to a minimum as a condition, which does not adversely affect visibility.

Figure 6:
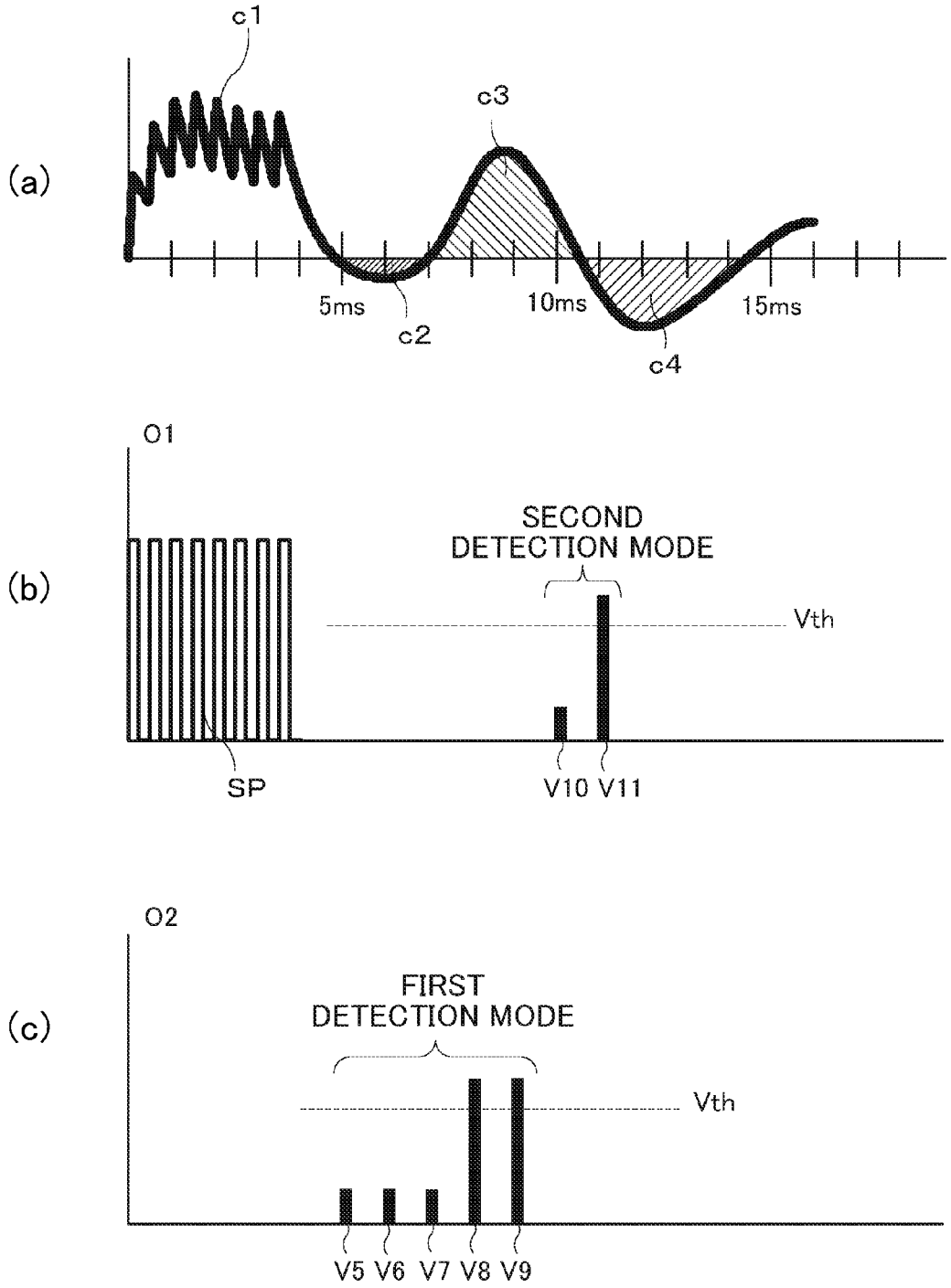
FIG. 6 are waveform diagrams of the pulse generated by the circuit of the electronic timepiece and a waveform diagram of the current generated in a coil, which are obtained when a rotor according to the first embodiment, the second embodiment, the third embodiment, the fifth embodiment, and the sixth embodiment of the present invention is successfully rotated with a normal drive pulse and is properly determined to exhibit rotation.

Next, the operation of the actual rotation detection is described with reference to waveform diagrams by taking typical examples for the respective regions. Current waveforms induced in the coil are illustrated in FIG. 6(*a*), FIG. 7(*a*), FIG. 8(*a*), and FIG. 9(*a*), voltage waveforms that occur in one terminal O1 of the coil at this time are illustrated in FIG. 6(*b*), FIG. 7(*b*), FIG. 8(*b*), and FIG. 9(*b*), and voltage waveforms that occur in the other terminal O2 of the coil are illustrated in FIG. 6(*c*), FIG. 7(*c*), FIG. 8(*c*), and FIG. 9(*c*). Note that, waveforms that occur in the terminals O1 and O2 are alternating pulses whose phases are reversed every second. The current value of the current waveform is merely reversed with the voltage waveforms being merely reversed between O1 and O2, which does not change shapes of the waveform diagrams, and hence the waveform diagrams are described below in regard to only one phase.

First, the region of the SP indication shown in FIG. 4 is described. A case where the rotor has been properly rotated with the normal drive pulse SP is described by taking an example of the power supply voltage 1.50 V and the drive rank 20/32 in FIG. 4 with reference to the waveform diagrams of FIG. 6.

First, the normal drive pulse SP illustrated in FIG. 6(*a*) is applied to one terminal O1 of the coil to start rotation of the rotor. The current waveform exhibited at this time is a waveform c1 illustrated in FIG. 6(*a*). When the output of the normal drive pulse SP is finished, the rotor is brought to a free oscillation state, and the current waveform becomes an induced current waveform indicated by c2, c3, and c4. At a time point of 5 ms, the first detection mode is started, and the rotation detection pulse B5 illustrated in FIG. 2(*b*) is applied to the coil. As illustrated in FIG. 6(*a*), at 5 ms, the current waveform falls within the region of the current waveform c2, and the current value is changed to become negative. Therefore, as illustrated in FIG. 6(*c*), an induced voltage V5 generated by the rotation detection pulse B5 does not exceed a threshold value voltage Vth of the rotation detection circuit 9. However, at 8 ms, the current waveform falls within the region of the current waveform c3, and the current value is changed to become positive. Therefore, as illustrated in FIG. 6(*c*), an induced voltage V8 generated by the rotation detection pulse B5 becomes a detection signal exceeding the threshold value Vth. In the same manner, at 9 ms, the current waveform falls within the region of the current waveform c3, and an induced voltage V9 generated by the rotation detection pulse B9 becomes a detection signal exceeding the threshold value Vth. With the trigger that the two detection signals of the induced voltages V8 and V9 have exceeded the threshold value Vth, the shift is made to the second detection mode.

When the shift is made to the second detection mode by the induced voltage V9, the rotation detection pulse for the subsequent timing, that is, the rotation detection pulse F10 at a time point of 10 ms illustrated in FIG. 2(*c*) is applied to the coil. As illustrated in FIG. 6(*a*), at 10 ms, the current waveform falls within the region of the current waveform c3 with the current value being positive, and hence, as illustrated in FIG. 6(*b*), an induced voltage V10 generated by the rotation detection pulse F10 does not exceed the threshold value Vth. However, at 11 ms, as illustrated in FIG. 6(*a*), the current waveform falls within the region of the current waveform c4 with the current value changed to become negative, and as illustrated in FIG. 6(*b*), an induced voltage V11 generated by the rotation detection pulse F11 becomes a detection signal exceeding the threshold value Vth. The second detection mode determination circuit 92 determines the rotation success based on the fact that the detection signal of the induced voltage V11 exceeds the threshold value Vth. Thus, the correction drive pulse FP is not to be output, and the normal drive pulse SP having the same driving force as the previous one is output next time the normal drive pulse is output.

Further, in the first detection mode, the induced voltage V5 and an induced voltage V6 generated by the rotation detection pulses B5 and B6 do not exceed the threshold value voltage Vth of the rotation detection circuit 9, and hence the number of times of determination of the first detection mode determination counter circuit 111 is not counted. That is, when the number of times that rotation has been determined to be exhibited by the rotation determination counter circuit 11 with the normal drive pulse SP within the region of the SP indication reaches 240 times, the number of times of determination of the first detection mode determination counter circuit 111 has not been counted at least 4 or more times, and hence the drive rank selection circuit 10 is controlled so as to output the normal drive pulse SP having the driving force smaller by one rank next time the normal drive pulse is output.

Next, an FP region shown in FIG. 4 is described. A case where the rotor has failed to be rotated with the normal drive pulse SP is described by taking an example of the power supply voltage 1.50 V and the drive rank 16/32 in FIG. 4 with reference to the waveform diagrams of FIG. 7.

Figure 7:
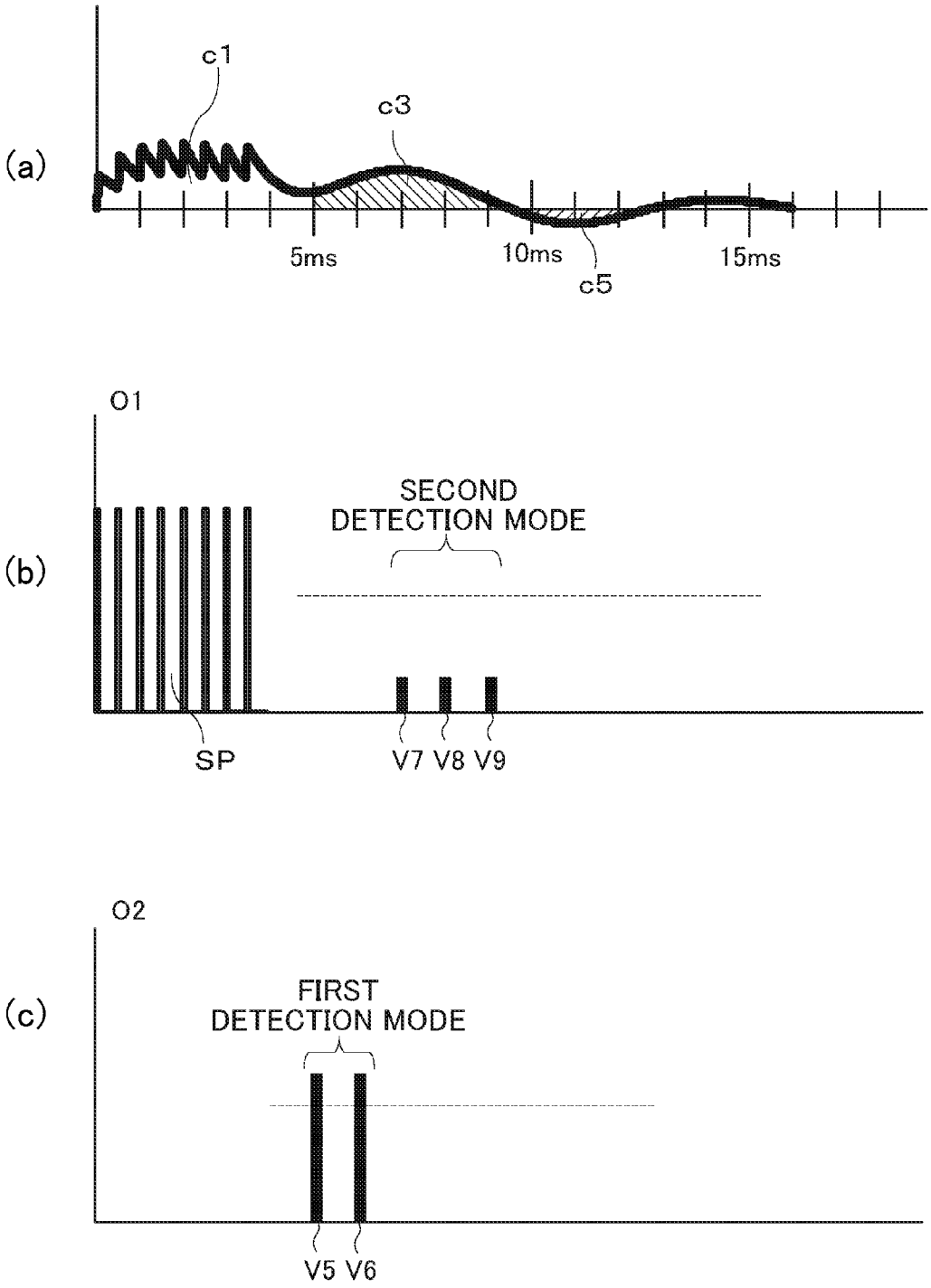
FIG. 7 are waveform diagrams of the pulse generated by the circuit of the electronic timepiece and a waveform diagram of the current generated in the coil, which are obtained when the rotor according to the first embodiment, the second embodiment, and the third embodiment of the present invention fails to be rotated with the normal drive pulse and is properly determined to exhibit non-rotation.

In FIG. 7, unlike in the case where the rotor has been successfully rotated with the normal drive pulse SP, the current waveform obtained after the output of the normal drive pulse SP, which includes the current waveforms c1 and c3 and a current waveform c5 in the stated order, exhibits a low peak value and becomes a smooth current waveform.

The operation of the rotation detection is conducted in the same manner even when the rotation has failed to be conducted. At the time point of 5 ms, the first detection mode is started, and the rotation detection pulse B5 is applied to the coil. As illustrated in FIG. 7(*a*), at 5 ms and 6 ms, the current waveform falls within the region of the current waveform c3 with the current value being positive. Therefore, as illustrated in FIG. 7(*c*), the induced voltages V5 and V6 generated by the rotation detection pulses B5 and B6 become detection signals exceeding the threshold value Vth, and the shift is made to the second detection mode.

When the shift is made to the second detection mode by the induced voltage V6, the rotation detection pulse for the subsequent timing, that is, the rotation detection pulse F7 at a time point of 7 ms is applied to the coil. As illustrated in FIG. 7(*a*), at 7 ms, the current waveform falls within the region of the current waveform c3 with the current value being positive. Therefore, as illustrated in FIG. 7(*b*), an induced voltage V7 does not exceed the threshold value Vth. Further, the induced voltages V8 and V9 generated by the rotation detection pulses F8 and F9 also fall within the region of the current waveform c3, and no detection signal exceeding the threshold value Vth is detected during a detection period from the induced voltage V7 to the induced voltage V9. The detection signal generated by the rotation detection pulses F7 to F14 is stopped with at most 3 times of detection in order to prevent the region of the current waveform c5 from being erroneously detected and determined to exhibit rotation despite the non-rotation of the rotor and to prevent a time delay from occurring. Therefore, the second detection mode determination circuit 92 cancels the determination by determining the rotation failure, with the result that the selector 6 selects the correction drive pulse FP to drive the step motor 8 and positively rotate the rotor, and the drive rank selection circuit 10 is controlled so as to output the normal drive pulse SP having the driving force larger than the previous one by one rank next time the normal drive pulse is output.

Next, the region of the bold italic FP indication shown in FIG. 4 is described. The description is made by taking an example of the power supply voltage 1.50 V and the drive rank 23/32 in FIG. 4 with reference to the waveform diagrams of FIG. 8. A case where the rotor has been successfully rotated with the normal drive pulse SP is described, and the driving force is slightly larger than in the waveform diagrams of FIG. 6. That is, the waveform diagrams obtained immediately after the load is removed after the drive rank has been raised due to the temporary load imposed by a calendar or the like are illustrated.

Figure 8:
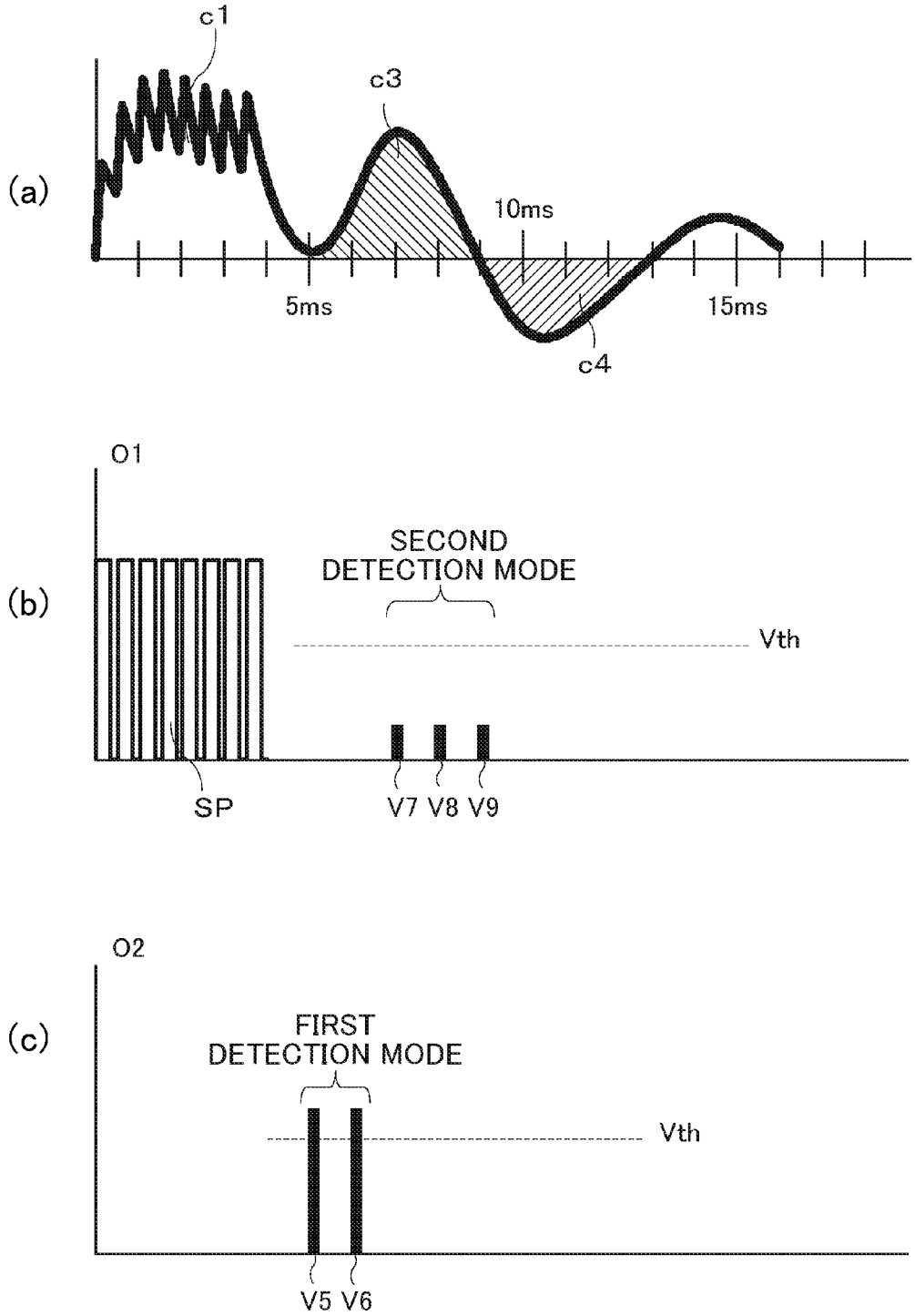
FIG. 8 are waveform diagrams of the pulse generated by the circuit of the electronic timepiece and a waveform diagram of the current generated in the coil, which are obtained when the rotor according to the first embodiment, the second embodiment, and the third embodiment of the present invention is successfully rotated with the normal drive pulse but is erroneously determined to exhibit non-rotation.

In FIG. 8, compared with FIG. 6, the current waveform includes the current waveforms c1, c3, and c4 in the stated order and excludes the current waveform c2, and the current waveform c3 directly follows the current waveform c1.

The operation of the rotation detection is conducted in the same manner as described above, and the first detection mode is the same as the details in the case of FIG. 7 where the rotor has failed to be rotated, and descriptions thereof are omitted.

When the shift is made to the second detection mode by the induced voltage V6, the rotation detection pulse for the subsequent timing, that is, the rotation detection pulse F7 at the time point of 7 ms is applied to the coil. As illustrated in FIG. 8(*a*), at 7 ms, the current waveform falls within the region of the current waveform c3 with the current value being positive. Therefore, as illustrated in FIG. 8(*b*), the induced voltage V7 does not exceed the threshold value Vth. Further, the induced voltages V8 and V9 generated by the rotation detection pulses F8 and F9 also fall within the region of the current waveform c3, and no detection signal exceeding the threshold value Vth is detected during the detection period from the induced voltage V7 to the induced voltage V9. That is, the rotation detection is brought to an end before the region of the current waveform c4, and hence the rotation failure is determined despite the rotation of the rotor, the selector 6 selects and outputs the correction drive pulse FP, and the drive rank selection circuit 10 is controlled so as to output the normal drive pulse SP having the driving force larger than the previous one by one rank next time the normal drive pulse is output. It is conceivable to handle the situation by increasing a number of times of detection to be conducted until the detection in the second detection mode is canceled from at most 3 times to 4 times in order to enable detection of the region of the current waveform c4 illustrated in FIG. 8(*a*). However, when the number of times of detection to be conducted until the detection is canceled is increased, the region of the current waveform c5 illustrated in FIG. 7 is detected when the rotor fails to be rotated. As a result, the rotation is determined to be exhibited despite the non-rotation of the rotor, which causes a time delay, and hence the number of times of detection to be conducted until the detection is canceled cannot be changed. That is, this drive rank cannot be lowered.

Next, the region of the bold italic SP indication shown in FIG. 4 is described. The description is made by taking an example of the power supply voltage 1.50 V and the drive rank 25/32 in FIG. 4 with reference to the waveform diagrams of FIG. 9. A case where the rotor has been successfully rotated with the normal drive pulse SP is described, and the driving force is slightly larger than in the waveform diagrams of FIG. 8. That is, the waveform diagrams relate to the drive rank for an operation conducted after the drive rank is raised due to the erroneous determination of the rotation failure even when the rotor has been rotated as in the case of the drive rank of the waveform diagrams of FIG. 8 or immediately after the load is removed after the temporary load is imposed by the calendar or the like.

Figure 9:
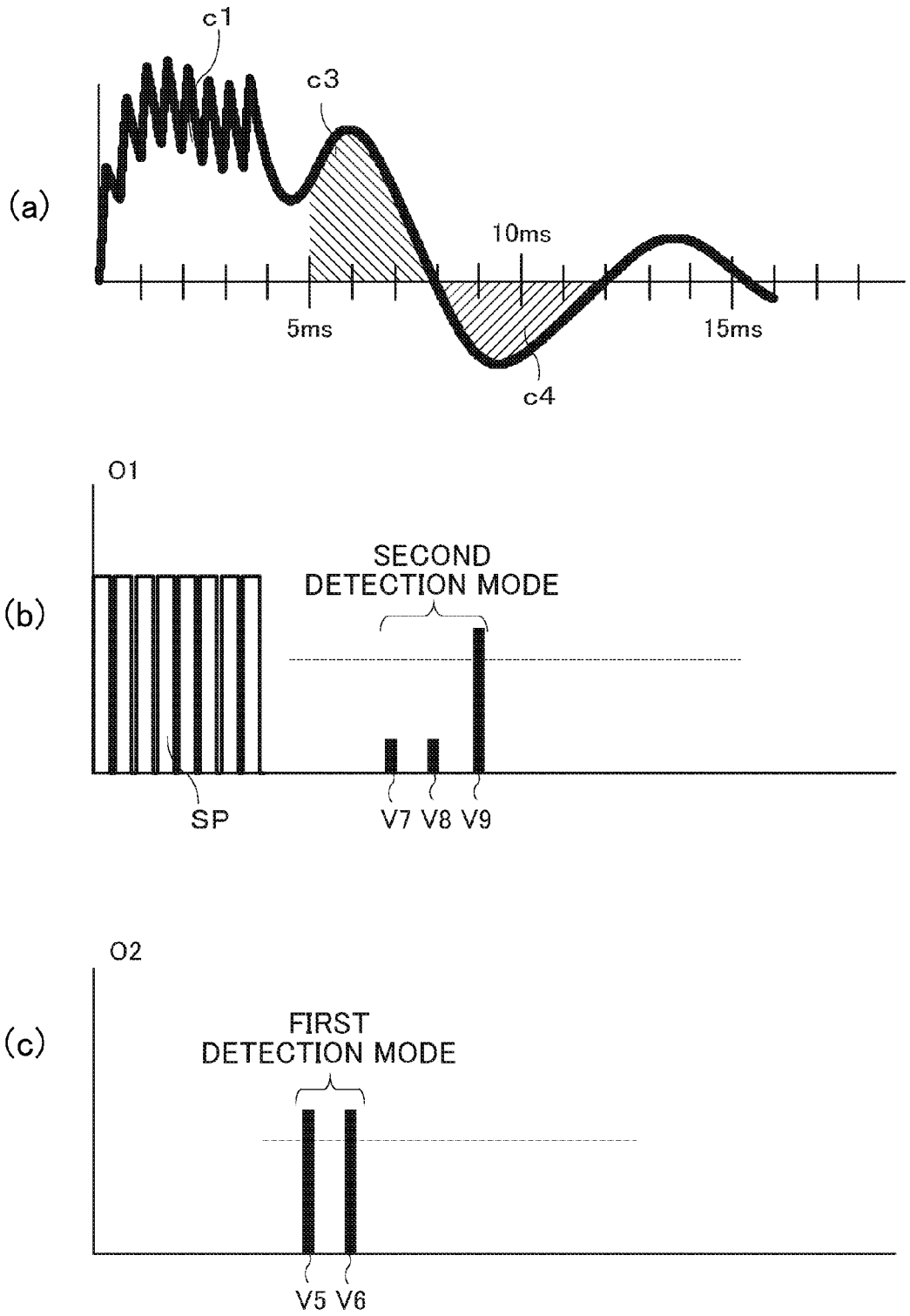
FIG. 9 are waveform diagrams of the pulse generated by the circuit of the electronic timepiece and a waveform diagram of the current generated in the coil, which are obtained when the rotor according to the first embodiment, the second embodiment, and the third embodiment of the present invention is successfully rotated with the normal drive pulse and is properly determined to exhibit rotation.

In FIG. 9, in the same manner as in FIG. 8, the current waveform includes the current waveforms c1, c3, and c4 in the stated order and excludes the current waveform c2, and the current waveform c3 directly follows the current waveform c1, but compared with FIG. 8, the current waveform c3 has such a current waveform shape as to cover the current waveform c1.

The operation of the rotation detection is described in the same manner as described above. The first detection mode is the same as that described with reference to FIG. 7, and hence a description thereof is omitted.

When the shift is made to the second detection mode by the induced voltage V6, the rotation detection pulse for the subsequent timing, that is, the rotation detection pulse F7 at the time point of 7 ms is applied to the coil. As illustrated in FIG. 9(*a*), at 7 ms, the current waveform falls within the region of the current waveform c3 with the current value being positive. Therefore, as illustrated in FIG. 9(*b*), the induced voltage V7 does not exceed the threshold value Vth. Further, the induced voltage V8 generated by the rotation detection pulse F8 also falls within the region of the current waveform c3, and the induced voltage V8 does not exceed the threshold value Vth. However, at 9 ms, as illustrated in FIG. 9(*a*), the current waveform falls within the region of the current waveform c4 with the current value changed to become negative, and as illustrated in FIG. 9(*b*), the induced voltage V9 generated by the rotation detection pulse F9 becomes a detection signal exceeding the threshold value Vth. The second detection mode determination circuit 92 determines the rotation success based on the fact that the detection signal of the induced voltage V9 exceeds the threshold value Vth. Thus, the correction drive pulse FP is not to be output, and the normal drive pulse SP having the same driving force as the previous one is output next time the normal drive pulse is output.

Further, both the induced voltages V5 and V6 generated by the rotation detection pulses B5 and B6 in the first detection mode exceed the threshold value voltage Vth of the rotation detection circuit 9, and hence the number of times of determination is counted by the first detection mode determination counter circuit 111. That is, when the number of times that rotation has been determined to be exhibited by the rotation determination counter circuit 11 with the normal drive pulse SP within the region of the bold italic SP indication reaches 240 times, the number of times of determination of the first detection mode determination counter circuit 111 has been counted at least 4 or more times, and hence the drive rank selection circuit 10 is controlled so as to output the normal drive pulse SP having the driving force at a minimum rank next time the normal drive pulse is output.

Therefore, even when there is a condition that the rotation failure is erroneously determined to raise the drive rank depending on a combination of the power supply voltage and the drive rank despite the rotation conducted as illustrated in FIG. 8, such a drive rank as illustrated in the waveform diagram of FIG. 9 is lowered straight down to the drive rank exhibiting the smallest driving force, which prevents the drive rank from remaining stable at the drive rank exhibiting a large driving force and high current consumption. When the drive rank is lowered to the drive rank exhibiting the smallest driving force, the drive rank exhibiting such a waveform as illustrated in FIG. 7 is successively output several times immediately after the lowering of the drive rank, but the rotation can be finally conducted with stability at the drive rank that allows the rotation to be conducted with the minimum driving force for the power supply voltage as illustrated in the waveform diagrams in FIG. 6, and hence the drive can be conducted with low current consumption.

As described above, in the first embodiment, the drive rank to which the drive rank is to be lowered is switched based on whether or not both the induced voltages generated by the rotation detection pulses B5 and B6 in the first detection mode exceed the threshold value voltage Vth of the rotation detection circuit 9. That is, even when a large voltage fluctuation occurs to cause a load fluctuation, the drive rank that allows the rotation to be conducted with the minimum driving force is finally reached, and hence the drive can be conducted with stability and with low current consumption.

The embodiment of the present invention is described above in detail with reference to the accompanying drawings, but the embodiment is merely an example of the present invention, and the present invention is not limited solely to the configuration of the embodiment. Therefore, it should be understood that design changes and the like made within the scope that does not depart from the gist of the present invention are included in the present invention. Accordingly, the following changes can be made.

Modification Example of First Embodiment (1) Respective numerical values such as a value of the chopper duty cycle of the normal drive pulse, a pulse number, a chopper cycle, a number of times of rotation determination, a number of times of determination count in the first detection mode, a number of determinations in the first detection mode and the second detection mode, a number of times of cancellation of the second detection mode (number of outputs of the second detection pulse), and the threshold value Vth are not limited to the above-mentioned numerical values, and should be optimized for the motor or a display body (such as a hand or a day dial) to be mounted.

(2) The block diagram of FIG. 1 is an example, and any other configuration that conducts the above-mentioned operation may be provided. For example, in the first detection mode, a detection circuit configured to detect that the detection signal has the predetermined detection pattern may be provided separately from the first detection mode determination circuit 91, or the first detection mode determination counter circuit 111 may be provided independently of the rotation determination counter circuit 11. As a method of configuring a system of the block diagram, any control such as control by random logic or control by a microcomputer may be employed. Such a configuration in which the selector 6 is formed of a microcomputer with the other circuits implemented by random logics may be employed. With such a configuration, a change to be applied to a large number of models can be carried out relatively easily.

(3) Because a range of the voltage fluctuation merely becomes small or a voltage variation range merely becomes different, the fluctuating power source 1 may be replaced by a power source exhibiting no voltage fluctuation or a primary battery configured to conduct only discharging.

(4) In the above-mentioned embodiment, the drive rank to which the drive rank is to be lowered is switched based on whether or not the counter value of a determination circuit for the first detection mode is 4 or more times within the number of times that the rotation success has been determined 240 times by the rotation determination counter circuit 11, but the drive rank may be lowered to the minimum rank by assuming that the drive rank exhibits a large driving force when the counter value of the determination circuit for the first detection mode becomes 4 times before the set number of times that the rotation success has been determined by the rotation determination counter circuit 11.

(5) In the above-mentioned embodiment, the first detection mode determination counter circuit 111 is configured to count the number of times that detection has been conducted prior to the predetermined time point in the first detection mode within the number of times that rotation has been successively determined to be exhibited, but the number of times that this detection has not been conducted may be counted. In this case, the same operation as that of the above-mentioned embodiment can be conducted by switching the drive rank to which the drive rank is to be lowered based on, for example, whether or not the counter value of the determination circuit for the first detection mode is equal to or smaller than 236 times within the number of times that the rotation success has been determined.

Second Embodiment

A second embodiment of the present invention is described. The second embodiment relates to an example of switching the set number of times of rotation determination counter circuit 11 midway based on an occurrence frequency that detection has been conducted prior to the predetermined time point in the first detection mode.

This means that a value of the set number of times of rotation determination counter circuit 11 is set small so as to lower the drive rank at an earlier stage because the current consumption is high when the rotation is conducted at the drive rank of the normal drive pulse SP having a relatively larger driving force than the drive rank of the normal drive pulse that allows the rotation to be conducted with the minimum driving force after the drive rank has been raised due to the temporary load imposed by the calendar or the like, while the value of the set number of times of rotation determination counter circuit 11 is set large at the drive rank that allows the rotation to be conducted with the minimum driving force in order to reduce to a minimum a frequency that the non-rotation is determined to output the correction drive pulse FP having high current consumption when the rotation fails to be conducted after the drive rank has been lowered to the drive rank exhibiting the driving force smaller by one rank. Now, the second embodiment according to the present invention is described with reference to the accompanying drawings.

Figure 10:
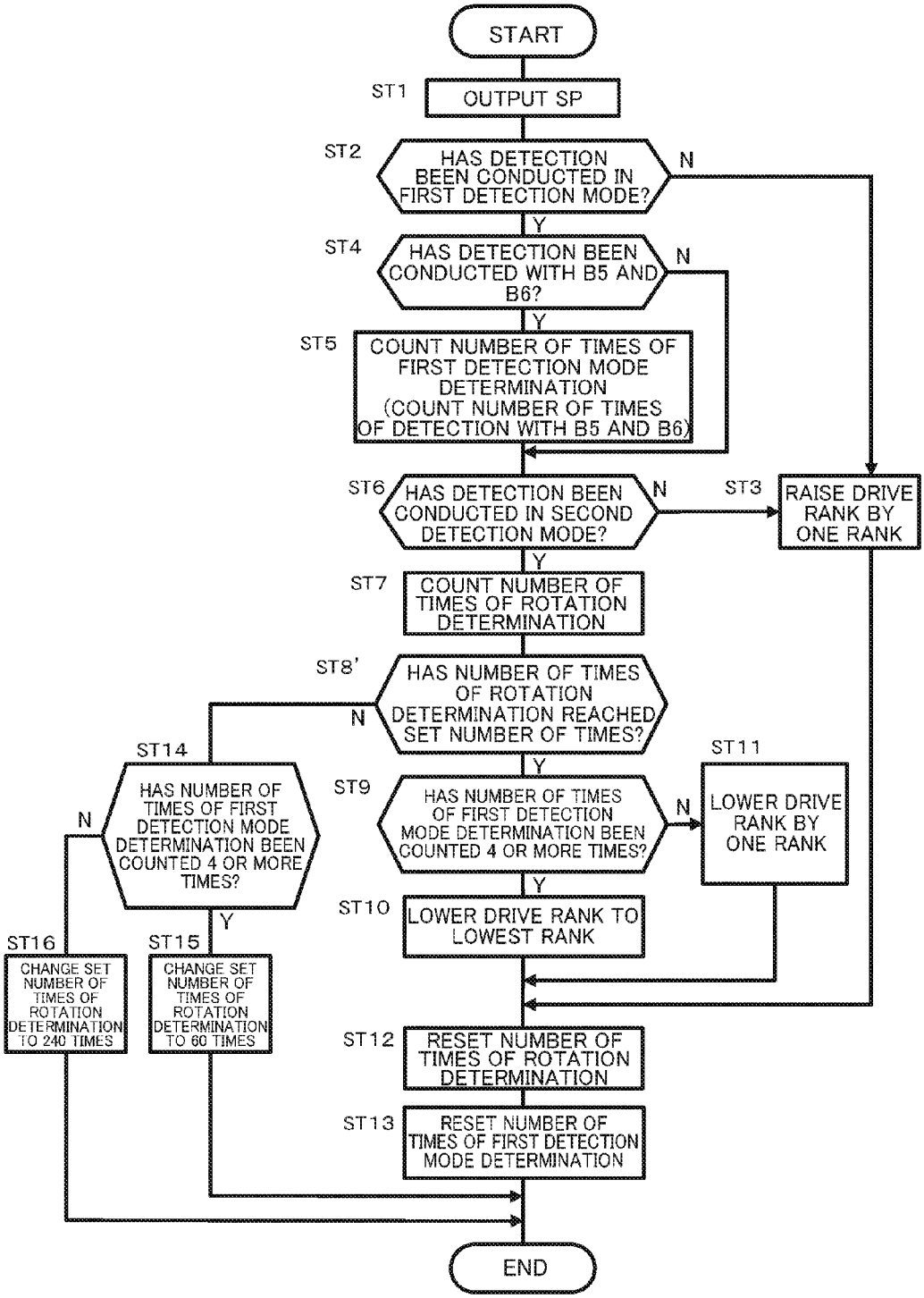
FIG. 10 is a flowchart of the second embodiment of the present invention.

FIG. 10 is a flowchart of the second embodiment of the present invention. Except for the flowchart, the block diagram for illustrating a circuit configuration of an electronic timepiece according to the second embodiment of the present invention (FIG. 1), the waveform diagrams of the pulse (FIG. 2), the matrix table for showing the determination result of rotation or non-rotation obtained by changing the power supply voltage and the drive rank (FIG. 4), the diagrams for schematically illustrating the change in the drive rank from the stable state at the drive rank 25/32 (FIG. 5), and the waveform diagrams of the pulse generated by the circuit and the waveform diagrams of the current generated in the coil (FIG. 6, FIG. 7, FIG. 8, and FIG. 9) are the same as those of the first embodiment, and descriptions thereof are omitted by using the same reference numerals to denote the same components as those described in the first embodiment.

To describe a different point from the first embodiment with reference to FIG. 1, the rotation determination counter circuit 11 counts the number of times that the rotor of the step motor 8 has been determined to exhibit rotation, and controls the drive rank selection circuit 10 when the set number of times is reached, but the set number of times of rotation determination counter circuit 11 is changed based on the number of times that detection has been conducted prior to the predetermined time point in the first detection mode, which is counted by the first detection mode determination counter circuit 111. That is, the set number of times of rotation determination counter circuit 11 is set to a fixed value irrespective of whether or not detection has been conducted prior to the predetermined time point in the first detection mode in the first embodiment, but a timing to lower the drive rank is switched by changing the set number of times of rotation determination counter circuit 11 based on the number of times that detection has been conducted prior to the predetermined time point in the first detection mode. Note that, the point that the drive rank selection circuit is controlled so as to change the drive rank to which the drive rank is to be lowered based on whether or not the number of times that detection has been conducted prior to the predetermined time point in the first detection mode is equal to or larger than the predetermined number of times when the number of times that rotation has been successively determined to be exhibited reaches the set number of times and the point that the numbers of times counted by the rotation determination counter circuit 11 and the first detection mode determination counter circuit 111 are reset after the drive rank is changed and when the rotor is determined to exhibit non-rotation are the same as those of the first embodiment.

The waveform diagrams of the pulse of FIG. 2 are the same as those of the first embodiment, and a description thereof is omitted. Next, an operation of the above-mentioned configuration is described with reference to a flowchart of FIG. 10. The operation conducted at every precise second is illustrated in the flowchart, from which the same parts as those of the first embodiment are omitted, and parts different from those of the first embodiment are described.

The normal drive pulse SP is output at the timing of a precise second to drive the step motor 8 (Step ST1).

The induced voltages generated in the coil by the rotation detection pulses B5 to B12 are detected in the first detection mode (Step ST2), and when the detection signal occurs, an instruction is issued to make a shift to the second detection mode (Step ST2: Y). Further, when the detection signals of the rotation detection pulses B5 and B6 occur, the number of occurrences thereof is counted by the first detection mode determination counter circuit 111. The induced voltages generated in the coil by the rotation detection pulses F7 to F14 are detected in the second detection mode (Step ST6). When the detection signal occurs, the rotation success is determined (Step ST6: Y), and the number of times that the rotation success has been determined by the rotation determination counter circuit 11 is counted (Step ST7). The above-mentioned steps are the same as those of the first embodiment, and the following description is made of parts different from the first embodiment.

When the rotation success is determined in the second detection mode and when the number of times that the rotation success has been determined by the rotation determination counter circuit 11 has not reached the set number of times (240 times as default) as a result of conducting the operation at every precise second several times (Step ST8': N), the count value of the first detection mode determination counter circuit 111 is confirmed (Step ST14). When the counter value of the determination circuit for the first detection mode has not been counted 4 or more times (Step ST14: Y), the set number of times of rotation determination of the rotation determination counter circuit 11 is changed to 60 times (Step ST15), and the rotation determination counter circuit 11 is controlled so as to lower the drive rank at an earlier stage. Further, when the counter value of the determination circuit for the first detection mode has been counted 4 or more times (Step ST14: N), the set number of times of rotation determination of the rotation determination counter circuit 11 is kept at 240 times (Step ST15), and the rotation determination counter circuit 11 is controlled so as to lower the drive rank at a later stage. Then, the operation at a precise second is brought to an end, and the drive rank selection circuit 10 is controlled so as to successively output the normal drive pulse SP having the same drive rank as the previous one.

When the number of times that the rotation success has been determined by the rotation determination counter circuit 11 has reached the set number of times as a result of conducting the operation at every precise second several times, the count value of the first detection mode determination counter circuit 111 is confirmed (Step ST9). When a counter value of the first detection mode determination counter circuit is 4 or more times within the number of times that the rotation success has been determined the set number of times by the rotation determination counter circuit 11 (Step ST9: Y), the first detection mode determination counter circuit 111 instructs the drive rank selection circuit 10 to select and output a normal drive pulse SP having a smallest driving force (Step ST10). In the same manner as described above, the count value of the rotation determination counter circuit 11 is reset (Step ST12), and the count value of the first detection mode determination counter circuit is also reset to bring the operation at a precise second to an end (Step ST13). In contrast, when the counter value of the first detection mode determination counter circuit 111 is not 4 or more times (Step ST9: N), the drive rank selection circuit 10 is instructed to select and output a normal drive pulse SP having a driving force smaller by one rank (Step ST11). The count value of the rotation determination counter circuit 11 is reset (Step ST12), and the count value of the first detection mode determination counter circuit 111 is also reset to bring the operation at a precise second to an end (Step ST13).

In the actual operation and rotation detection, the matrix table and the waveform diagrams are the same as those described in the first embodiment with reference to FIG. 4, FIG. 5, FIG. 6, FIG. 7, FIG. 8, and FIG. 9, and only different points are described. In the matrix table shown in FIG. 4, for example, when the drive rank of the normal drive pulse within the region of the bold italic SP indication is reached due to the temporary load or the like, the driving force is unnecessarily large, and such waveform diagrams with high current consumption as illustrated in FIG. 9 are obtained. With reference to the waveform diagrams of FIG. 9, both the induced voltages V5 and V6 generated by the rotation detection pulses B5 and B6 in the first detection mode exceed the threshold value voltage Vth of the rotation detection circuit 9. The occurrence of the detection signal exceeding the threshold value is counted by the first detection mode determination counter circuit 111. When the first detection mode determination counter circuit 111 has conducted the counting 4 or more times while the operation is conducted for several seconds, the set number of times of rotation determination of the rotation determination counter circuit 11 is changed to 60 times, and the drive rank is lowered at an earlier stage. When the rotation has been successively determined to be exhibited at the same drive rank 60 times, the drive rank is lowered to the minimum rank.

Further, in the matrix table shown in FIG. 4, when the drive rank of the normal drive pulse within an SP region is reached, the rotation is conducted with the minimum driving force, and such waveform diagrams with low current consumption as illustrated in FIG. 6 are obtained. With reference to the waveform diagrams of FIG. 6, both the induced voltages V5 and V6 generated by the rotation detection pulses B5 and B6 in the first detection mode do not exceed the threshold value voltage Vth of the rotation detection circuit 9. No detection signal has occurred, and hence the counting is not conducted by the first detection mode determination counter circuit 111. Thus, the set number of times of rotation determination of the rotation determination counter circuit becomes 240 times, and the drive rank is lowered at a later stage. When the rotation has been successively determined to be exhibited at the same drive rank 240 times, the drive rank is lowered to the drive rank lower by one rank.

As described above, in the second embodiment, the drive rank to which the drive rank is to be lowered is switched based on whether or not both the induced voltages generated by the rotation detection pulses B5 and B6 in the first detection mode exceed the threshold value voltage Vth of the rotation detection circuit 9, and at the same time, the set number of times for the lowering of the drive rank is changed. That is, even when a large voltage fluctuation occurs to cause a load fluctuation with the drive rank remaining stable at the drive rank exhibiting a large driving force, the drive rank that allows the rotation to be conducted with the minimum driving force is reached for a shorter period than in the first embodiment, and hence the drive can be conducted with stability and with lower current consumption.

Modification Example of Second Embodiment

Note that, this embodiment is not limited to the one described above, and the following modification examples can be provided.

(1) In the above-mentioned embodiment, the number of times of determination in the first detection mode has one level of whether or not the number is 4 or more times, but a plurality of levels may be set to change the drive rank at a time of the lowering of the drive rank based on a plurality of numbers of times of determination, namely, 3 or more numbers of times.

For example, when the count value of the first detection mode determination counter circuit 111 becomes two times, the set number of times of rotation determination of the rotation determination counter circuit 11 is set to 120 times, and when the count value of the first detection mode determination counter circuit 111 becomes 4 times, the set number of times of rotation determination of the rotation determination counter circuit 11 is set to 60 times.

(2) In the above-mentioned embodiment, when the counter value of the first detection mode determination counter circuit 111, that is, a number of times of first detection mode determination has been counted 4 or more times in Step ST14 of the flowchart of FIG. 10, the set number of times of rotation determination of the rotation determination counter circuit 11 is changed from 240 times to 60 times so as to lower the drive rank at an earlier stage, but in contrast, such a control may be added as to suppress to a minimum the number of occurrences of the correction drive pulse FP by changing the set number of times of rotation determination of the rotation determination counter circuit 11 from 240 times to 480 times to reduce a frequency of lowering the drive rank because the rotation is conducted at the drive rank that allows the rotation to be conducted with the minimum driving force when the counter value of the first detection mode determination counter circuit 111 has not been subjected to the counting successively, for example, 4 times.

Further, in addition to the above-mentioned modification, the threshold value of the number of times of determination in the first detection mode, which is used in Step ST14 of the flowchart of FIG. 10, may be set to a different value. That is, the description has been made on the assumption that the threshold value of the first detection mode determination counter circuit 111 for a case where the counting is conducted is set to 4 times and that the threshold value of the first detection mode determination counter circuit 111 for a case where the counting is not conducted successively is set to 4 times, but different threshold values may be employed by setting the threshold value of the first detection mode determination counter circuit 111 for the case where the counting is conducted to 8 times and setting the threshold value of the first detection mode determination counter circuit 111 for the case where the counting is not conducted successively to 4 times.

(3) The set number of times of rotation determination at the time of the lowering of the drive rank is set to 60 times and 240 times based on the number of times of determination in the first detection mode, but needs to be optimized for the power supply voltage, the motor, the display body (such as a hand or a day dial) to be mounted, or a kind of power source. The same applies to the number of levels of the number of times of determination in the first detection mode.

(4) The set number of times of rotation determination at the time of the lowering of the drive rank is switched based on whether or not the number of times of determination in the first detection mode is 4 or more times, but it should be understood that the numerical value is not limited to 4 times, and the numerical value itself may be counted successively or may be counted in a thinning-out manner.

Third Embodiment

A third embodiment of the present invention is described. The third embodiment relates to an example of switching the drive rank to which the drive rank is to be lowered based on a power supply voltage with which the detection has been conducted prior to the predetermined time point in the first detection mode.

This means that the drive rank is lowered after the drive rank has been raised due to the temporary load imposed by the calendar or the like and after the rotation has been conducted the predetermined number of times at the drive rank exhibiting a large driving force, while the number of occurrences of the correction drive pulse FP due to the raising of the drive rank before reaching the drive rank exhibiting the minimum driving force is reduced by setting the drive rank at the time of the lowering of the drive rank to a predetermined drive rank based on the power supply voltage, to reduce the current consumption and prevent the hand from appearing to be moving fractionally as much as possible. Now, the third embodiment according to the present invention is described with reference to the accompanying drawings.

Figure 11:
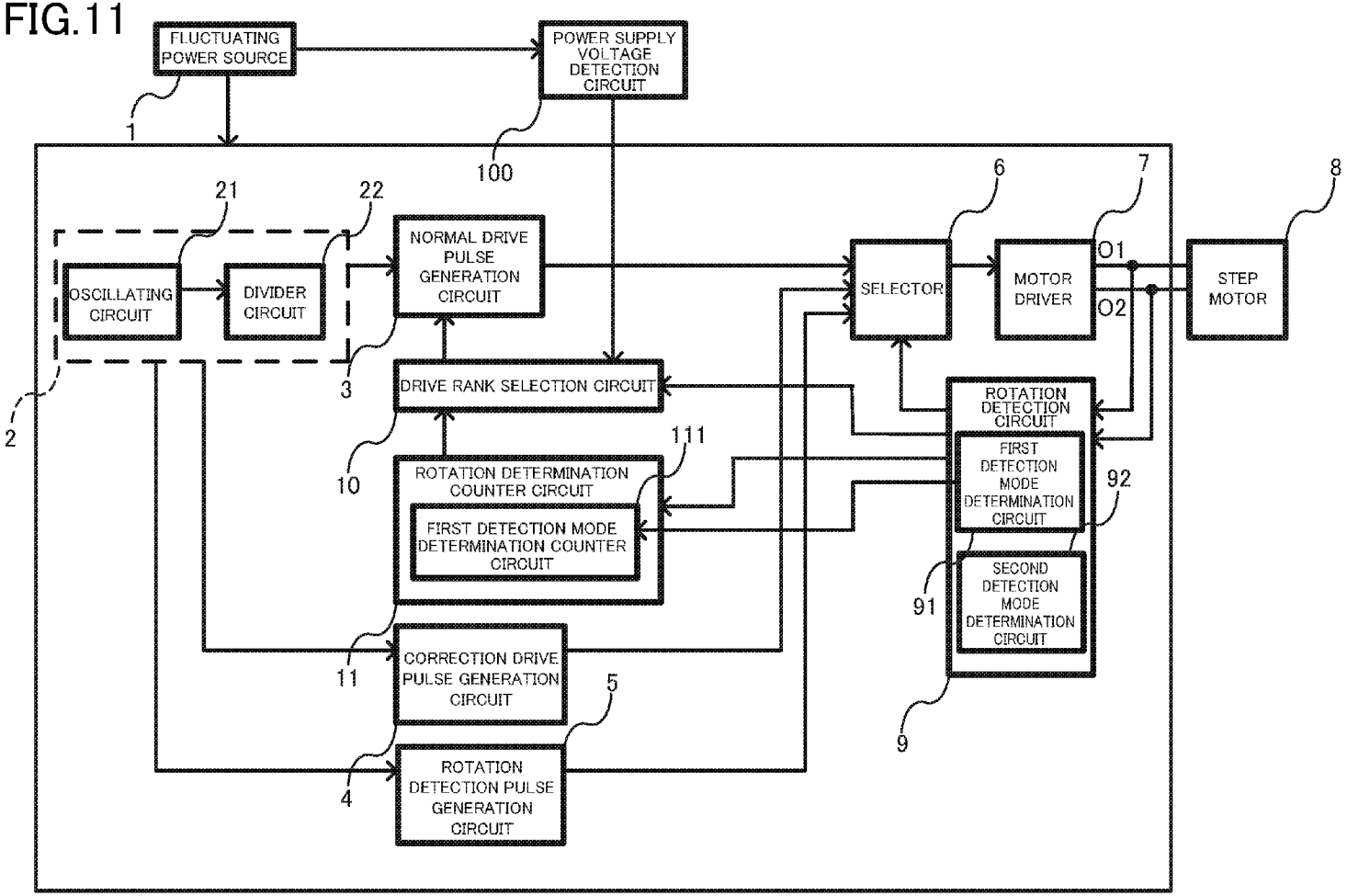
FIG. 11 is a block diagram for illustrating a circuit configuration according to the third embodiment of the present invention.
Figure 12:
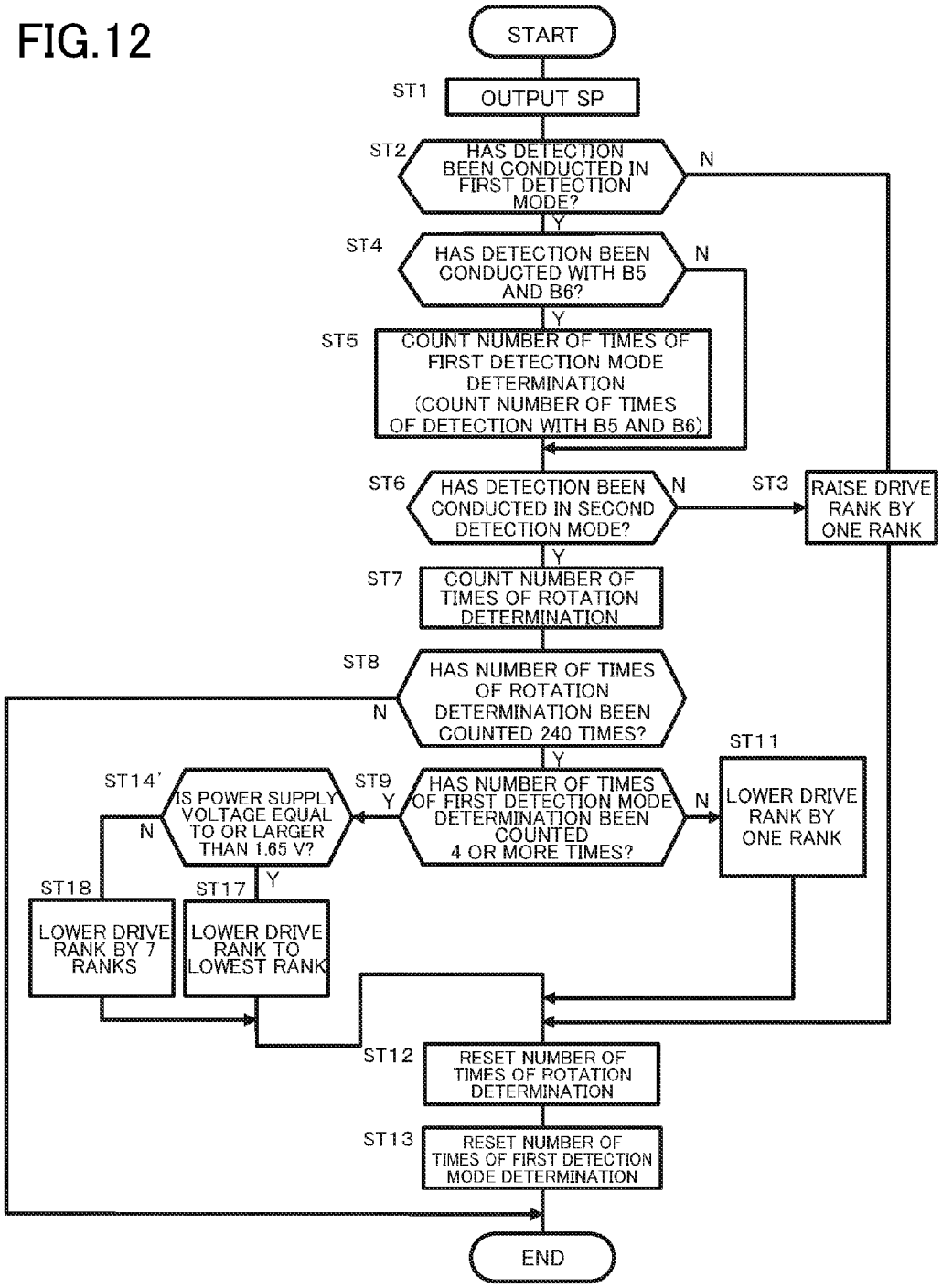
FIG. 12 is a flowchart of the third embodiment of the present invention.

FIG. 11 is a block diagram of the third embodiment of the present invention. FIG. 12 is a flowchart of the third embodiment of the present invention. Except for the block diagram and the flowchart, the wave form diagrams of the pulse for illustrating a circuit configuration of an electronic timepiece according to the third embodiment of the present invention (FIG. 2), the matrix table for showing the determination result of rotation or non-rotation obtained by changing the power supply voltage and the drive rank (FIG. 4), the diagrams for schematically illustrating the change in the drive rank from the stable state at the drive rank 25/32 (FIG. 5), and the waveform diagrams of the pulse generated by the circuit and the waveform diagrams of the current generated in the coil (FIG. 6, FIG. 7, FIG. 8, and FIG. 9) are the same as those of the first embodiment, and descriptions thereof are omitted by using the same reference numerals to denote the same components as those described in the first embodiment.

To describe a different point from the first embodiment with reference to FIG. 11, reference numeral 100 denotes a power supply voltage detection circuit, and is a circuit configured to detect an output voltage of the fluctuating power source 1 and control the drive rank selection circuit 10 based on a detection result thereof. The rotation determination counter circuit 11 counts the number of times that the rotor of the step motor 8 has been determined to exhibit rotation, and controls the drive rank selection circuit 10 when the set number of times is reached, but the drive rank selection circuit 10 is controlled so as to change the drive rank to which the drive rank is to be lowered based on the power supply voltage with which the detection has been conducted prior to the predetermined time point in the first detection mode, which is counted by the first detection mode determination counter circuit 111. That is, the drive rank is lowered to only the drive rank exhibiting the smallest driving force when detection has been conducted prior to the predetermined time point in the first detection mode in the first embodiment, but the drive rank to which the drive rank is to be lowered is changed based on the power supply voltage with which the detection has been conducted prior to the predetermined time point in the first detection mode. Note that, the point that the drive rank selection circuit 10 is controlled so as to change the drive rank to which the drive rank is to be lowered based on whether or not the number of times that detection has been conducted prior to the predetermined time point in the first detection mode is equal to or larger than the predetermined number of times when the number of times that rotation has been successively determined to be exhibited reaches the set number of times and the point that the numbers of times counted by the rotation determination counter circuit 11 and the first detection mode determination counter circuit 111 are reset after the drive rank is changed and when the rotor is determined to exhibit non-rotation are the same as those of the first embodiment.

The waveform diagrams of the pulse of FIG. 2 are the same as those of the first embodiment, and a description thereof is omitted. Next, an operation of the above-mentioned configuration is described with reference to a flowchart of FIG. 12. The operation conducted at every precise second is illustrated in the flowchart, from which the same parts as those of the first embodiment are omitted, and parts different from those of the first embodiment are described.

The normal drive pulse SP is output at the timing of a precise second to drive the step motor 8 (Step ST1).

The induced voltages generated in the coil by the rotation detection pulses B5 to B12 are detected in the first detection mode (Step ST2), and when the detection signal occurs, an instruction is issued to make a shift to the second detection mode (Step ST2: Y). Further, when the detection signals of the rotation detection pulses B5 and B6 occur, the number of occurrences thereof is counted by the first detection mode determination counter circuit 111. The induced voltages generated in the coil by the rotation detection pulses F7 to F14 are detected in the second detection mode (Step ST6). When the detection signal occurs, the rotation success is determined (Step ST6: Y), and the number of times that the rotation success has been determined by the rotation determination counter circuit 11 is counted (Step ST7). The above-mentioned steps are the same as those of the first embodiment, and the following description is made of parts different from the first embodiment.

The rotation success is determined in the second detection mode, the number of times that the rotation success has been determined by the rotation determination counter circuit 11 reaches 240 times as a result of conducting the operation at every precise second several times (Step ST8: Y), and the count value of the first detection mode determination counter circuit 111 is confirmed (Step ST9). When the counter value of the determination circuit for the first detection mode has been counted 4 or more times (Step ST9: Y), the drive rank after the lowering of the drive rank varies depending on whether or not the power supply voltage is equal to or larger than 1.65 V (Step ST14'). The drive rank selection circuit 10 is controlled so that, when the power supply voltage is equal to or larger than 1.65 V (Step ST14': Y), the drive rank is lowered to the drive rank exhibiting the smallest driving force (Step ST17), and when the power supply voltage is not equal to or larger than 1.65 V (Step ST14': N), the drive rank is lowered to a drive rank lower by 7 ranks (Step ST18).

Then, the count value of the rotation determination counter circuit 11 is reset (Step ST12), and the count value of the first detection mode determination counter circuit 111 is also reset to bring the operation at a precise second to an end (Step ST13). Further, when the counter value of the first detection mode determination counter circuit is not 4 or more times (Step ST9: N), the drive rank selection circuit 10 is instructed to select and output a normal drive pulse SP having a driving force smaller by one rank (Step ST11). The count value of the rotation determination counter circuit 11 is reset (Step ST12), and the count value of the first detection mode determination counter circuit 111 is also reset to bring the operation at a precise second to an end (Step ST13).

In the actual operation and rotation detection, the matrix table and the waveform diagrams are the same as those described in the first embodiment with reference to FIG. 4, FIG. 5, FIG. 6, FIG. 7, FIG. 8, and FIG. 9, and only different points are described. In the matrix table shown in FIG. 4, for example, when the drive rank of the normal drive pulse within the region of the bold italic SP indication is reached due to the temporary load or the like, the driving force is unnecessarily large, and such waveform diagrams with high current consumption as illustrated in FIG. 9 are obtained. With reference to the waveform diagrams of FIG. 9, both the induced voltages V5 and V6 generated by the rotation detection pulses B5 and B6 in the first detection mode exceed the threshold value voltage Vth of the rotation detection circuit 9. In a case where the rotation has been successively determined to be exhibited at the same drive rank 240 times and the number of occurrences of the detection signal exceeding the threshold value has been counted 4 or more times by the first detection mode determination counter circuit 111, when the power supply voltage is, for example, 1.50 V with the drive rank being 25/32, the power supply voltage is not equal to or larger than 1.65 V, and hence the drive rank is lowered to the drive rank 18/32 lower by 7 ranks. In the same manner, when the power supply voltage is 1.50 V with the drive rank being 26/32, the drive rank is lowered to the drive rank 19/32 lower by 7 ranks, and when the power supply voltage is 1.50 V with the drive rank being 27/32, the drive rank is lowered to the drive rank 20/32 lower by 7 ranks.

Further, when the power supply voltage is, for example, 1.80 V even in the case where the number of occurrences of the detection signal exceeding the threshold value has been counted 4 or more times, any one of the drive ranks 21/32 to 27/32 is lowered to the drive rank 16/32 exhibiting the smallest driving force.

As described above, in the third embodiment, after the rotation has been conducted the predetermined number of times at the drive rank within the region of the bold italic SP indication, the drive rank to which the drive rank is to be lowered is switched based on the power supply voltage. That is, the drive rank is lowered to a lowest drive rank with any power supply voltage when the rotation has been successively determined to be exhibited at the drive rank within the bold italic SP region the predetermined number of times in the first embodiment, but the drive rank to which the drive rank is to be lowered is switched based on the power supply voltage, to thereby be able to reduce the number of occurrences of a correction drive pulse at the time of the raising of the drive rank.

For example, in the first embodiment, when the rotation has been successively determined to be exhibited at the drive rank 25/32 with the power supply voltage 1.50 V the predetermined number of times, the drive rank is lowered to the drive rank 16/32 exhibiting the smallest driving force, and hence the drive rank is raised by 3 ranks before the drive rank 19/32 that allows the rotation to be conducted with the minimum driving force is reached, to thereby successively output the correction drive pulse FP 3 times. Meanwhile, in the third embodiment, when the drive has been conducted at the drive rank 25/32 with the power supply voltage 1.50 V, the drive rank is lowered to the drive rank 18/32, and hence the drive rank needs to be raised by only one rank before the drive rank 19/32 that allows the rotation to be conducted with the minimum driving force is reached, to thereby also output the correction drive pulse FP only one time. That is, in the third embodiment, compared with the first embodiment, the number of occurrences of the correction drive pulse at the time of the lowering of the drive rank can be reduced, which prevents the hand from appearing to be moving fractionally as much as possible, and which allows the drive to be conducted with lower current consumption and with satisfactory visibility as well.

Modification Example of Third Embodiment

Note that, this embodiment is not limited to the one described above, and the following modification examples can be provided.

(1) In the above-mentioned embodiment, a determination voltage has one level of 1.65 V, but a plurality of levels may be set to change the drive rank at the time of the lowering of the drive rank based on a plurality of voltage ranges, namely, 3 or more voltage ranges.

For example, the drive rank is lowered to the lowest drive rank when the power supply voltage being used in a case where the counter value of the determination circuit for the first detection mode has been counted 4 or more times is 1.80 V, lowered to a drive rank lower by 8 ranks when 1.65 V, and lowered to the drive rank lower by 7 ranks when 1.50 V.

(2) The drive rank to which the drive rank is to be lowered is set to the lowest drive rank and the drive rank lower by 7 ranks based on the power supply voltage, but needs to be optimized for the power supply voltage, the motor, the display body (such as a hand or a day dial) to be mounted, or the kind of power source. The same applies to the number of voltage levels.

(3) In the above-mentioned embodiment, the drive rank to which the drive rank is to be lowered is changed based on the power supply voltage, but the drive rank to which the drive rank is to be lowered may be changed based on the drive rank at which the detection signal has occurred prior to the predetermined time point in the first detection mode. For example, the drive rank 25/32 is lowered by 8 ranks, and the drive rank 26/32 is lowered by 9 ranks. Further, the drive rank to which the drive rank is to be lowered may be changed based on a combination of the power supply voltage and the above-mentioned drive rank.

Fourth Embodiment

A fourth embodiment of the present invention is described. The drive rank to which the drive rank is to be lowered is switched through use of the induced voltages V5 and V6 generated by the rotation detection pulses B5 and B6 in the first detection mode in the first embodiment, while the fourth embodiment relates to an example of newly providing a rotation detection pulse F5.5 and switching the drive rank to which the drive rank is to be lowered through use of an induced voltage V5.5 generated by the rotation detection pulse F5.5.

In the first embodiment, the drive rank to which the drive rank is to be lowered is switched through use of a waveform difference of the current waveform c3 obtained when the rotor is rotated with the normal drive pulse SP, while in the fourth embodiment, the drive rank to which the drive rank is to be lowered is switched through use of presence or absence of the current waveform c2 obtained when the rotor is rotated with the normal drive pulse SP.

Now, the fourth embodiment according to the present invention is described with reference to the accompanying drawings.

Figure 13:
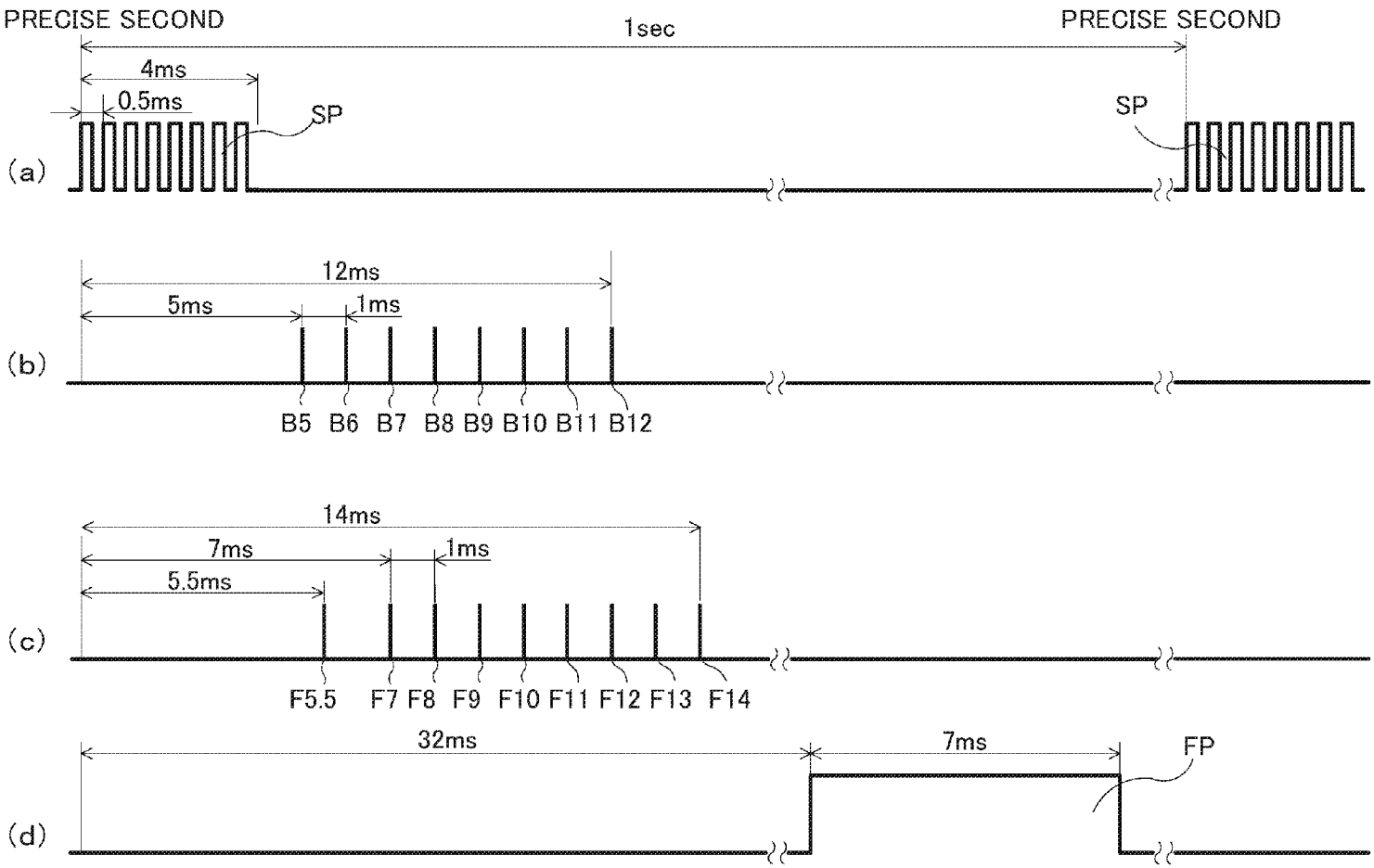
FIG. 13 are waveform diagrams of a pulse generated by a circuit of an electronic timepiece according to the fourth embodiment of the present invention.
Figure 14:
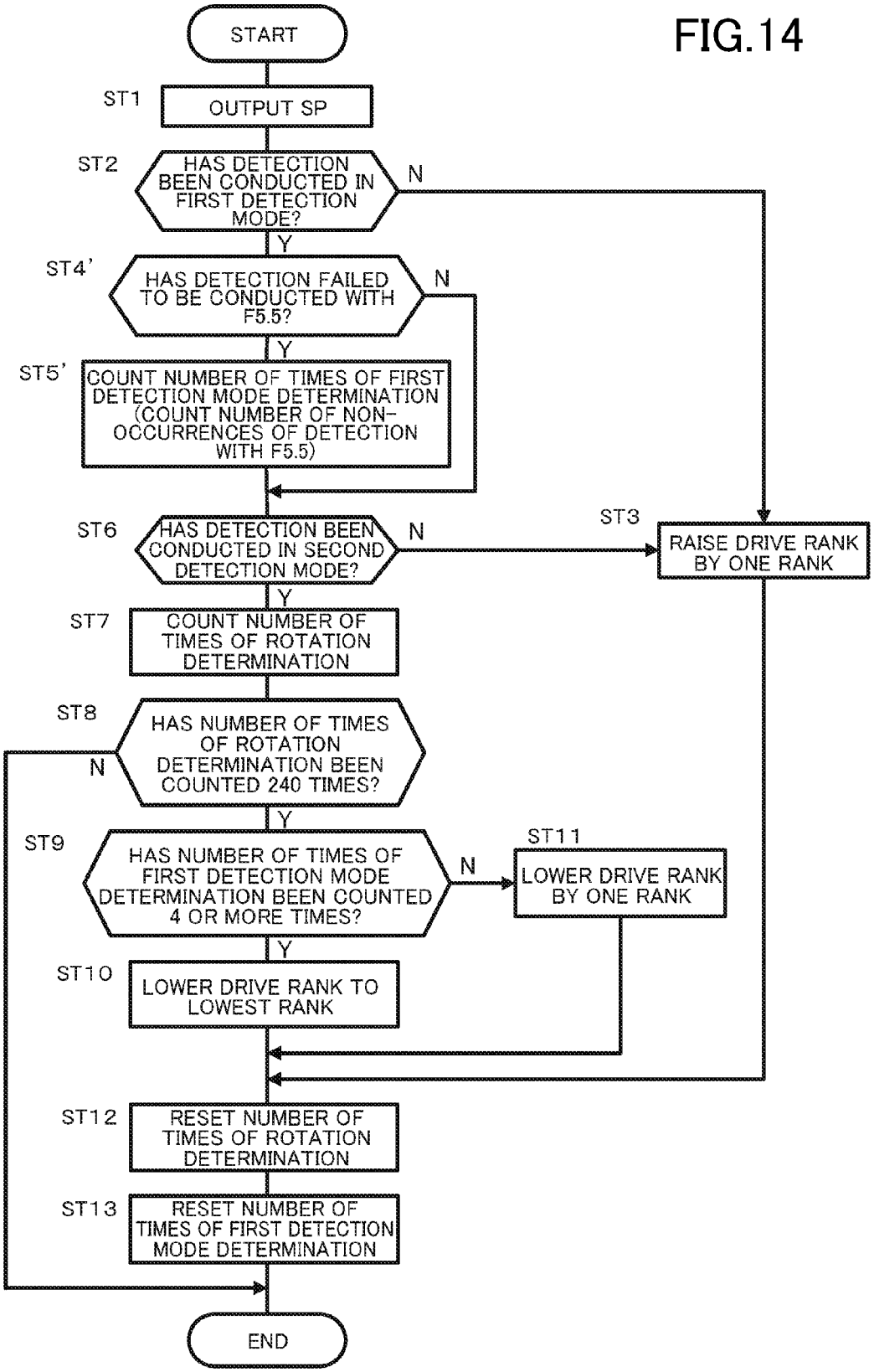
FIG. 14 is a flowchart of the fourth embodiment of the present invention.

FIG. 13 are waveform diagrams of a pulse according to the fourth embodiment of the present invention, FIG. 14 is a flowchart of the fourth embodiment of the present invention, and FIG. 15, FIG. 16, FIG. 17, and FIG. 18 are waveform diagrams of the pulse generated by the circuit of an electronic timepiece according to the fourth embodiment of the present invention and a waveform diagram of the current generated in the coil. Except for the waveform diagrams of the pulse, the flowchart, the waveform diagrams of the pulse generated by the circuit, and the waveform diagrams of the current generated in the coil, the block diagram for illustrating a circuit configuration of an electronic timepiece according to the fourth embodiment of the present invention (FIG. 1), the matrix table for showing the determination result of rotation or non-rotation obtained by changing the power supply voltage and the drive rank (FIG. 4), and the diagrams for schematically illustrating the change in the drive rank from the stable state at the drive rank 25/32 (FIG. 5) are the same as those of the first embodiment, and descriptions thereof are omitted by using the same reference numerals to denote the same components as those described in the first embodiment.

To describe a different point from the first embodiment with reference to FIG. 1, based on the reference signal generation circuit 2, the rotation detection pulse generation circuit 5 generates and outputs the rotation detection pulse F5.5 in addition to the rotation detection pulses B5 to B12 to be used in the first detection mode, and generates and outputs the rotation detection pulses F7 to F14 to be used in the second detection mode. The rotation detection pulses B5 to B12 are such 0.125-ms-width pulses as illustrated in FIG. 13(*b*), and are output every 1 ms from 5 ms to 12 ms after the output of the normal drive pulse SP. The rotation detection pulse F5.5 is such a 0.125-ms-width pulse as illustrated in FIG. 13(*c*), and is output 5.5 ms after the output of the normal drive pulse SP. The rotation detection pulses F7 to F14 are such 0.125-ms-width pulses as illustrated in FIG. 13(*c*), and are output every 1 ms from 7 ms to 14 ms after the output of the normal drive pulse SP.

The rotation detection circuit 9 is the rotation detection circuit including the first detection mode determination circuit 91 configured to conduct the determination in the first detection mode and the second detection mode determination circuit 92 configured to conduct the determination in the second detection mode, which is configured to determine the rotation or non-rotation of the rotor of the step motor 8 from the induced voltage generated in the coil during the periods of the first detection mode and the second detection mode, and control the selector 6 and the drive rank selection circuit 10, the rotation determination counter circuit 11, and the first detection mode determination counter circuit 111 that are described later.

However, the induced voltage generated in the coil by the rotation detection pulse F5.5 is used for determining the presence or absence of the detection signal by the rotation detection circuit 9 during the period of the first detection mode, but is not used for determining the rotation or non-rotation of the rotor of the step motor 8.

Note that, the rotation detection pulses B5 to B12 are output to the terminal on the side opposite to the terminal to which the normal drive pulse SP has been output, and the impedance of the closed loop including the coil is changed steeply, to thereby amplify the induced voltage generated by the free oscillation of the rotor to which the normal drive pulse SP has been applied, and to detect the induced voltage by the rotation detection circuit 9. Further, the rotation detection pulses F5.5 and F7 to F14 are output to the terminal on the same side as the terminal to which the normal drive pulse SP has been output, and the impedance of the closed loop including the coil is changed steeply, to thereby amplify the induced voltage generated by the free oscillation of the rotor to which the normal drive pulse SP has been applied, and to detect the induced voltage by the rotation detection circuit 9.

The rotation determination counter circuit 11 counts the number of times that the rotor of the step motor 8 has been determined to exhibit rotation, and controls the drive rank selection circuit 10 when the predetermined number of times has been counted. Further, the rotation determination counter circuit 11 includes the first detection mode determination counter circuit 111 configured to count a number of times that the detection has not been conducted with the rotation detection pulse F5.5 in the first detection mode, and control the drive rank selection circuit 10 when the predetermined number of times has been counted. That is, the number of times that the detection has been conducted with the rotation detection pulses B5 and B6 is counted in the first embodiment, while in the fourth embodiment, the number of times that the detection has not been conducted with the rotation detection pulse F5.5 is counted. The rotation determination counter circuit 11 is further configured to be reset when the rotor is determined to exhibit non-rotation, and count the number of times that rotation has been successively determined to be exhibited, and the first detection mode determination counter circuit 111 is further configured to count the number of times that the detection has not been conducted with the rotation detection pulse F5.5 in the first detection mode within the number of times that rotation has been successively determined to be exhibited. The drive rank selection circuit 10 is controlled so that the drive rank to which the drive rank is to be lowered is changed based on whether or not the number of times that the detection has not been conducted with the rotation detection pulse F5.5 in the first detection mode is equal to or larger than a predetermined number of times. Note that, after the drive rank is changed, the rotation determination counter circuit 11 and the first detection mode determination counter circuit 111 are reset.

Next, an operation of the above-mentioned configuration is described with reference to a flowchart of FIG. 14. The operation conducted at every precise second is illustrated in the flowchart, from which the same parts as those of the first embodiment are omitted, and parts different from those of the first embodiment are described.

First, the normal drive pulse SP output from the normal drive pulse generation circuit 3 at the timing of a precise second is selected and output by the selector 6 to drive the step motor 8 through the motor driver 7 (Step ST1). Then, 5 ms after the precise second, the first detection mode is started. In the first detection mode, the selector 6 selects and outputs the rotation detection pulses B5 to B12, the rotation detection pulse F5.5, and a rotation detection pulse F6.5 that have been output from the rotation detection pulse generation circuit 5, and controls the step motor 8 so as to change the impedance of the coil. Then, the rotation detection circuit 9 detects the induced voltages generated in the coil by the rotation detection pulses B5 to B12 and the rotation detection pulse F5.5 through the motor driver 7 (Step ST2).

Meanwhile, the rotation detection circuit 9 instructs the first detection mode determination circuit 91 to start the determination operation. The first detect ion mode determination circuit 91, which is configured to determine the presence or absence of the detection signal in the first detection mode based on a number of times that the detection signal based on the rotation detection pulses B5 to B12 and the rotation detection pulse F5.5 has been input from the rotation detection circuit 9, determines the fact of detection when the detection signal from the rotation detection circuit 9 based on the rotation detection pulses B5 to B12 has occurred two times, immediately stops the output of the rotation detection pulse in the first detection mode being output from the rotation detection pulse generation circuit 5, notifies the selector 6 that the operation in the first detection mode is to be brought to an end, and instructs the selector 6 to shift to the second detection mode (Step ST2: Y). In a case where the detection signal from the rotation detection circuit 9 based on the rotation detection pulses B5 to B12 has occurred two times in the first detection mode, when there is no detection signal based on the rotation detection pulse F5.5 (Step ST4': Y), a number of non-occurrences of the detection signal based on the rotation detection pulse F5.5 is counted by the first detection mode determination counter circuit 111 (Step ST5'). When the detection signal occurs based on the rotation detection pulse F5.5, the first detection mode determination counter circuit 111 is inhibited from counting the number of non-occurrences of the detection signal based on the rotation detection pulse F5.5, and the shift is made to the second detection mode (Step ST4': N).

In the same manner as in the first embodiment, when no detection signal or only one detection signal occurs based on the rotation detection pulses B5 to B12, the rotation failure is determined to bring the operation in the first detection mode to an end, and the correction drive pulse FP is immediately selected and output by the selector 6 without the shift made to the second detection mode (Step ST2: N), while the drive rank selection circuit 10 is instructed to select and output the normal drive pulse SP having the driving force larger by one rank than the previous normal drive pulse SP from the normal drive pulse generation circuit 3 when the normal drive pulse is output at the subsequent precise second (Step ST3).

When the rotation success has been determined in the second detection mode and when the number of times that the rotation success has been determined by the rotation determination counter circuit 11 has not reached 240 times as a result of conducting the operation at every precise second several times, the operation at a precise second is brought to an end, and the drive rank selection circuit 10 is controlled so as to successively output the normal drive pulse SP having the same drive rank as the previous one (Step ST8: N), but when the number of times that the rotation success has been determined by the rotation determination counter circuit 11 reaches 240 times as a result of conducting the operation at every precise second several times, the count value of the first detection mode determination counter circuit 111 is confirmed (Step ST8: Y). The first detection mode determination counter circuit 111 is a circuit configured to count the number of times that the detection has not been conducted with the rotation detection pulse F5.5, and when a counter value of the first detection mode determination counter circuit 111 is 4 or more times within the number of times that the rotation success has been determined 240 times by the rotation determination counter circuit 11 (Step ST9: Y), the first detection mode determination counter circuit 111 instructs the drive rank selection circuit 10 to select and output a normal drive pulse SP having a smallest driving force (Step ST10). In the same manner as described above, the count value of the rotation determination counter circuit 11 is reset (Step ST12), and the count value of the first detection mode determination counter circuit 111 is also reset to bring the operation at a precise second to an end (Step ST13).

The matrix table for showing the determination result of rotation or non-rotation obtained by changing the power supply voltage and the drive rank, which is shown in FIG. 4, and the diagrams for schematically illustrating the change in the drive rank from the stable state at the drive rank 25/32, which is illustrated in FIG. 5, are the same as those of the first embodiment, and descriptions thereof are omitted.

Figure 15:
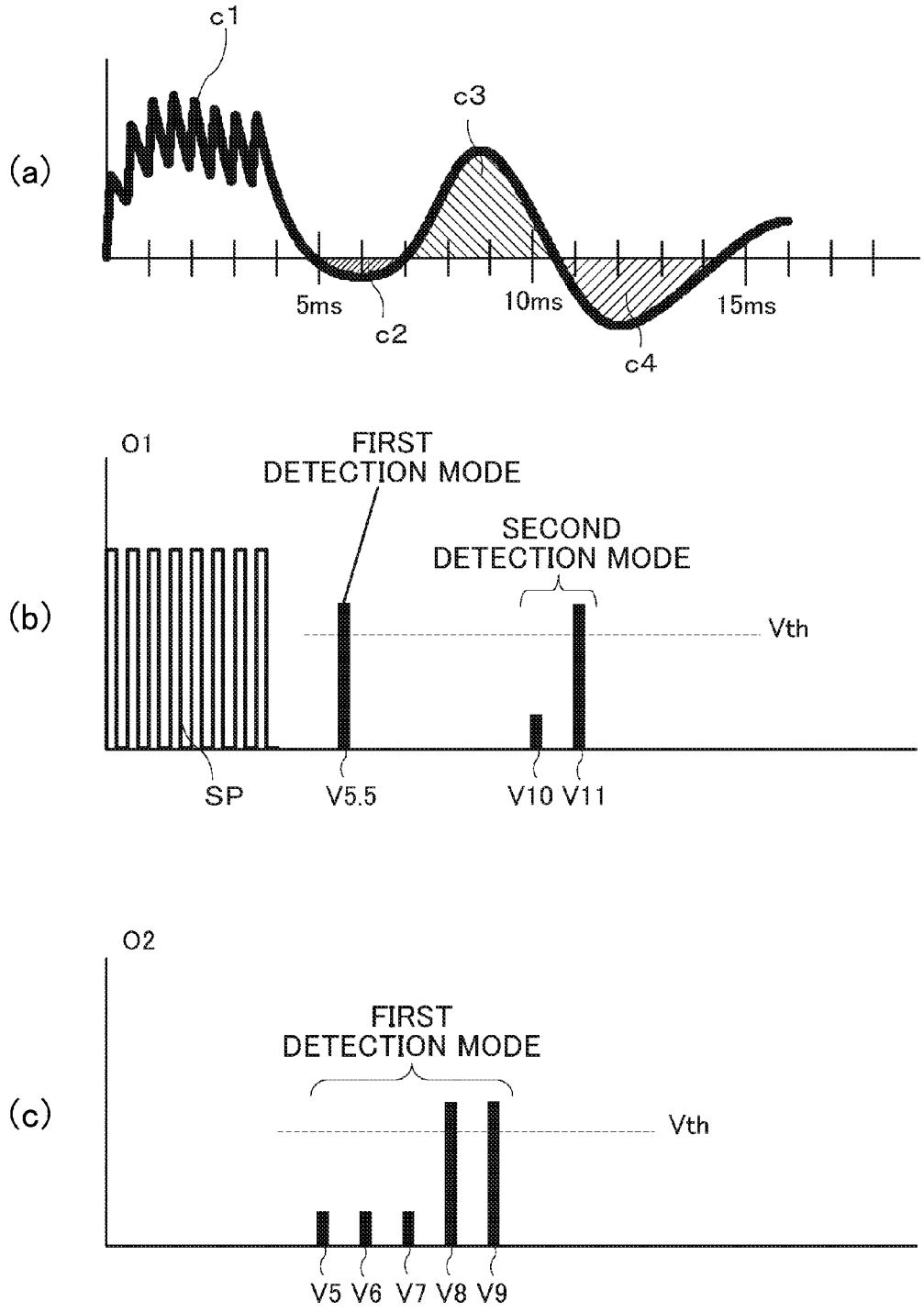
FIG. 15 are waveform diagrams of the pulse generated by the circuit of the electronic timepiece and a waveform diagram of the current generated in the coil, which are obtained when the rotor according to the fourth embodiment of the present invention is successfully rotated with the normal drive pulse and is properly determined to exhibit rotation.

Next, the operation of the actual rotation detection is described with reference to waveform diagrams by taking typical examples for the respective regions shown in FIG. 4. Current waveforms induced in the coil are illustrated in FIG. 15(*a*), FIG. 16(*a*), FIG. 17(*a*), and FIG. 18(*a*), voltage waveforms that occur in one terminal O1 of the coil at this time are illustrated in FIG. 15(*b*), FIG. 16(*b*), FIG. 17(*b*), and FIG. 18(*b*), and voltage waveforms that occur in the other terminal O2 of the coil are illustrated in FIG. 15(*c*), FIG. 16(*c*), FIG. 17(*c*), and FIG. 18(*c*). Note that, waveforms that occur in the terminals O1 and O2 are alternating pulses whose phases are reversed every second. The current value of the current waveform is merely reversed with the voltage waveforms being merely reversed between O1 and O2, which does not change the shapes of the waveform diagrams, and hence the waveform diagrams are described below in regard to only one phase in the same manner as in the first embodiment.

First, the region of the SP indication shown in FIG. 4 is described. A case where the rotor has been properly rotated with the normal drive pulse SP is described by taking an example of the power supply voltage 1.50 V and the drive rank 20/32 in FIG. 4 with reference to the waveform diagrams of FIG. 15.

The operation of the rotation detection is basically the same as that of the first embodiment, and is omitted while the description is made.

At the time point of 5 ms, the first detection mode is started, and the shift is made to the second detection mode when the detection signals of the two induced voltages V8 and V9 exceed the threshold value Vth.

The second detection mode determination circuit 92 determines the rotation success based on the fact that the detection signal of the induced voltage V11 exceeds the threshold value Vth after the shift is made to the second detection mode. Thus, the correction drive pulse FP is not to be output, and the normal drive pulse SP having the same driving force as the previous one is output next time the normal drive pulse is output.

In the first detection mode, the induced voltage V5.5 generated by the rotation detection pulse F5.5 exceeds the threshold value voltage Vth of the rotation detection circuit 9, and hence the number of times of determination of the first detection mode determination counter circuit 111 is not counted. That is, when the number of times that rotation has been determined to be exhibited by the rotation determination counter circuit 11 with the normal drive pulse SP within the region of the SP indication reaches 240 times, the number of times of determination of the first detection mode determination counter circuit 111 has not been counted at least 4 or more times, and hence the drive rank selection circuit 10 is controlled so as to output the normal drive pulse SP having the driving force smaller by one rank next time the normal drive pulse is output.

Next, the region of the FP indication shown in FIG. 4 is described. A case where the rotor has not been rotated with the normal drive pulse SP is described by taking an example of the power supply voltage 1.50 V and the drive rank 16/32 in FIG. 4 with reference to the waveform diagrams of FIG. 16.

At the time point of 5 ms, the first detection mode is started, and the shift is made to the second detection mode when the detection signals of the two induced voltages V5 and V6 exceed the threshold value Vth.

The shift is made to the second detection mode, and there is no detection signal exceeding the threshold value Vth within the detection period from the induced voltage V7 to the induced voltage V9. The detection signal generated by the rotation detection pulses F7 to F14 is stopped with at most 3 times of detection. Therefore, the second detection mode determination circuit 92 cancels the determination by determining the rotation failure, with the result that the selector 6 selects the correction drive pulse FP to drive the step motor 8 and positively rotate the rotor, and the drive rank selection circuit 10 is controlled so as to output the normal drive pulse SP having the driving force larger than the previous one by one rank next time the normal drive pulse is output.

Note that, the induced voltage V5.5 generated by the rotation detection pulse F5.5 in the first detection mode does not exceed the threshold value voltage Vth of the rotation detection circuit 9, but does not contribute to the counting of the number of times of determination of the first detection mode determination counter circuit 111 due to the determination of the non-rotation.

Figure 17:
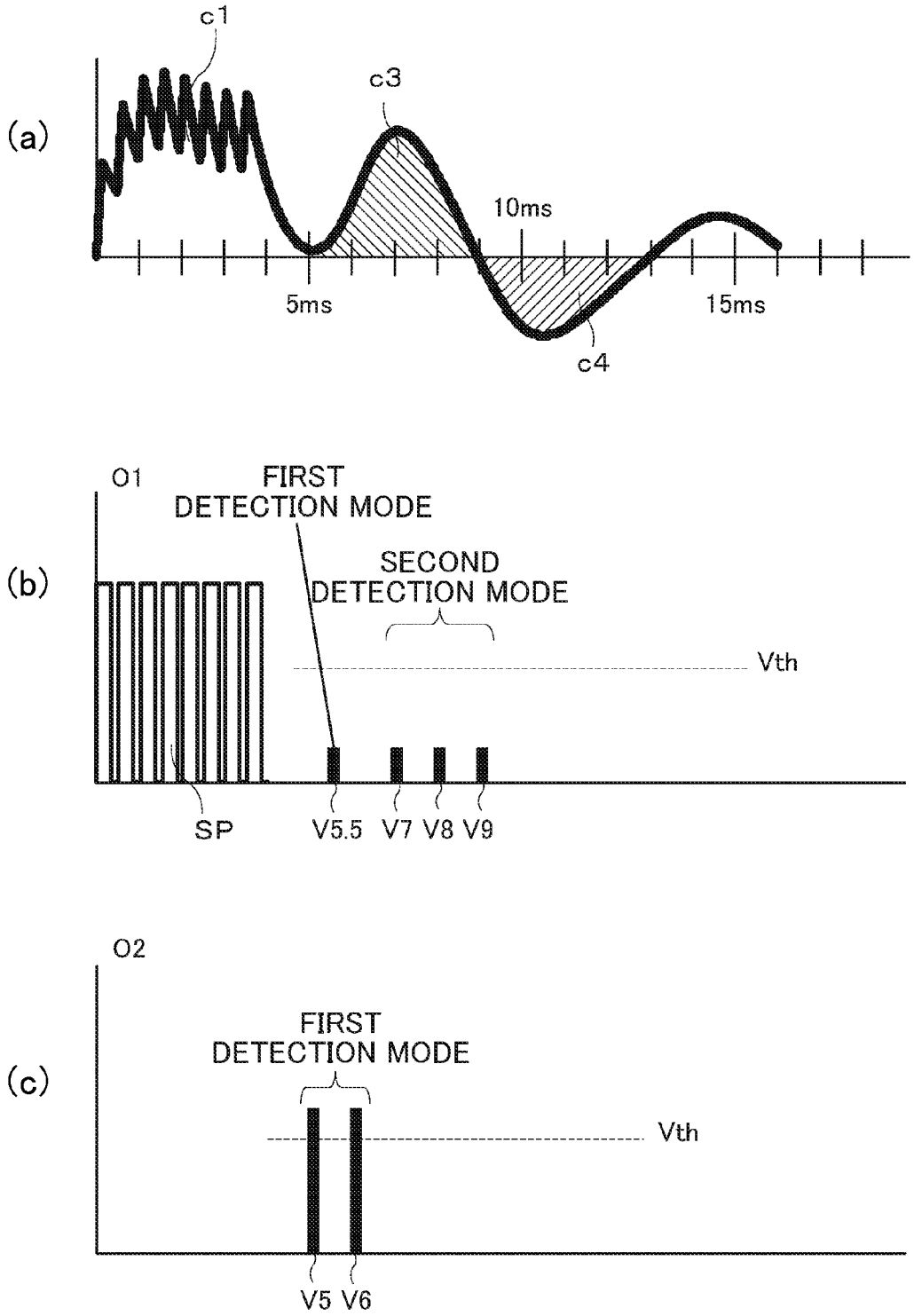
FIG. 17 are waveform diagrams of the pulse generated by the circuit of the electronic timepiece and a waveform diagram of the current generated in the coil, which are obtained when the rotor according to the fourth embodiment of the present invention is successfully rotated with the normal drive pulse but is erroneously determined to exhibit non-rotation.

Next, the region of the bold italic FP indication shown in FIG. 4 is described. The description is made by taking an example of the power supply voltage 1.50 V and the drive rank 23/32 in FIG. 4 with reference to the waveform diagrams of FIG. 17. In the same manner as in the first embodiment, the case where the rotor has been successfully rotated with the normal drive pulse SP is described, and the driving force is slightly larger than in the waveform diagrams of FIG. 15. That is, FIG. 17 are the waveform diagrams obtained immediately after the load is removed after the drive rank has been raised due to the temporary load imposed by the calendar or the like.

Figure 16:
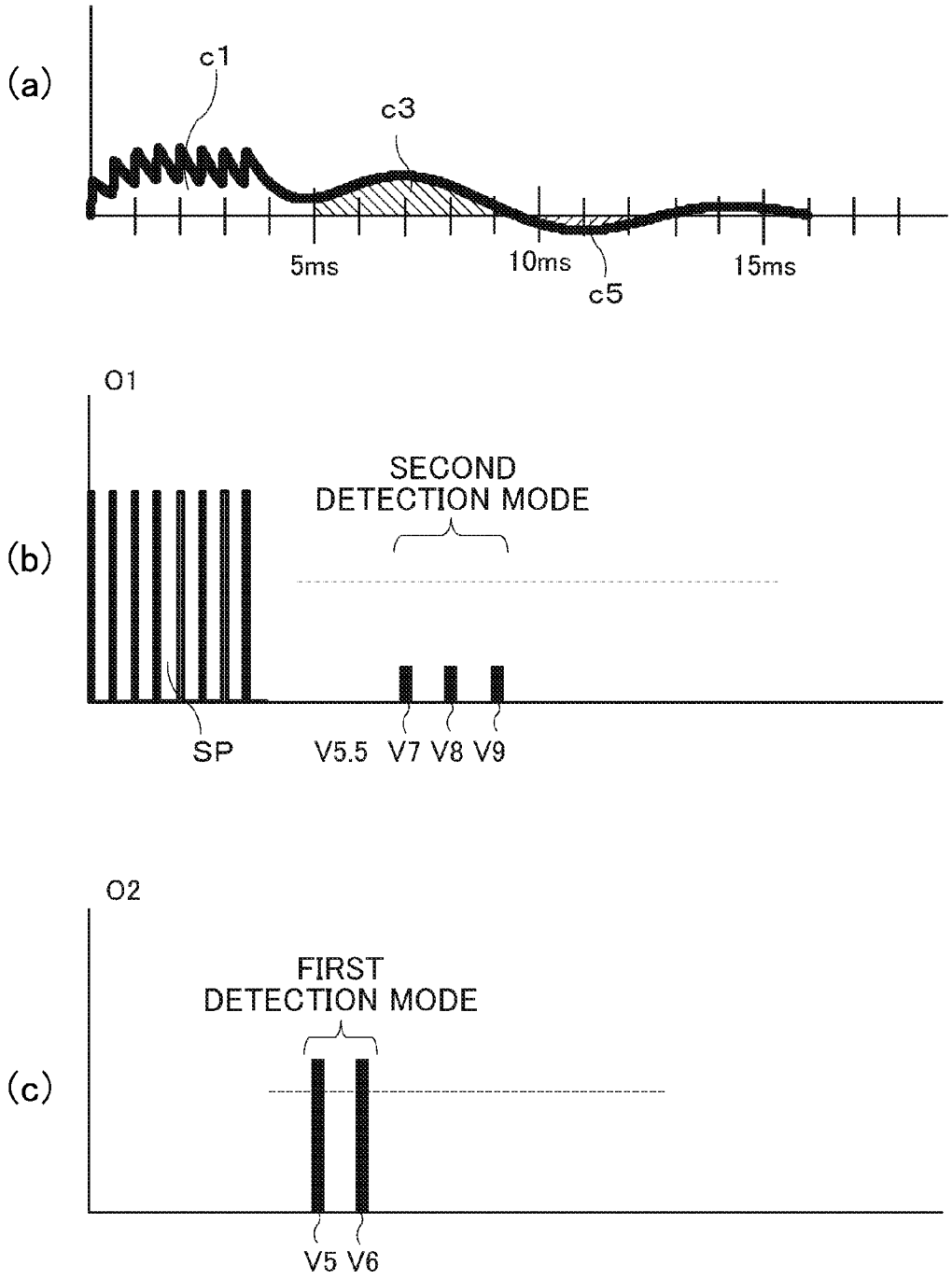
FIG. 16 are waveform diagrams of the pulse generated by the circuit of the electronic timepiece and a waveform diagram of the current generated in the coil, which are obtained when the rotor according to the fourth embodiment of the present invention fails to be rotated with the normal drive pulse and is properly determined to exhibit non-rotation.

The details of the first detection mode are the same as those in the case of FIG. 16 where the rotor has failed to be rotated, and hence a description thereof is omitted.

The shift is made to the second detection mode, and there is no detection signal exceeding the threshold value Vth within the detection period from the induced voltage V7 to the induced voltage V9. That is, the rotor has been rotated, but the rotation failure has been determined, and the selector 6 selects and outputs the correction drive pulse FP, while the drive rank selection circuit 10 is controlled so as to output the normal drive pulse SP having the driving force larger than the previous one by one rank next time the normal drive pulse is output. That is, this drive rank cannot be lowered.

Note that, in the same manner as in the case where the rotor has failed to be rotated, the induced voltage V5.5 generated by the rotation detection pulse F5.5 in the first detection mode does not exceed the threshold value voltage Vth of the rotation detection circuit 9, but does not contribute to the counting of the number of times of determination of the first detection mode determination counter circuit 111 due to the determination of the non-rotation.

Next, the region of the bold italic SP indication shown in FIG. 4 is described. The description is made by taking an example of the power supply voltage 1.50 V and the drive rank 25/32 in FIG. 4 with reference to the waveform diagrams of FIG. 18. In the same manner as in the first embodiment, the case where the rotor has been successfully rotated with the normal drive pulse SP is described, and the driving force is slightly larger than in the waveform diagrams of FIG. 17. That is, the waveform diagrams relate to the drive rank for the operation conducted after the drive rank is raised due to the erroneous determination of the rotation failure, the erroneous determination being made immediately after the load is removed after the temporary load is imposed by the calendar or the like, or despite the fact that the rotor has been rotated as in the case of the drive rank of the waveform diagrams of FIG. 17.

The first detection mode is the same as that described with reference to FIG. 16, and hence a description thereof is omitted.

The second detection mode determination circuit 92 determines the rotation success based on the fact that the detection signal of the induced voltage V9 exceeds the threshold value Vth after the shift is made to the second detection mode. Thus, the correction drive pulse FP is not to be output, and the normal drive pulse SP having the same driving force as the previous one is output next time the normal drive pulse is output.

In the first detection mode, the induced voltage V5.5 generated by the rotation detection pulse F5.5 does not exceed the threshold value voltage Vth of the rotation detection circuit 9, and hence the number of times of determination of the first detection mode determination counter circuit 111 is counted. That is, when the number of times that rotation has been determined to be exhibited by the rotation determination counter circuit 11 with the normal drive pulse SP within the region of the bold italic SP indication, reaches 240 times, the number of times of determination of the first detection mode determination counter circuit 111 has not been counted at least 4 or more times, and hence the drive rank selection circuit 10 is controlled so as to output the normal drive pulse SP having the smallest driving force rank next time the normal drive pulse is output.

Figure 18:
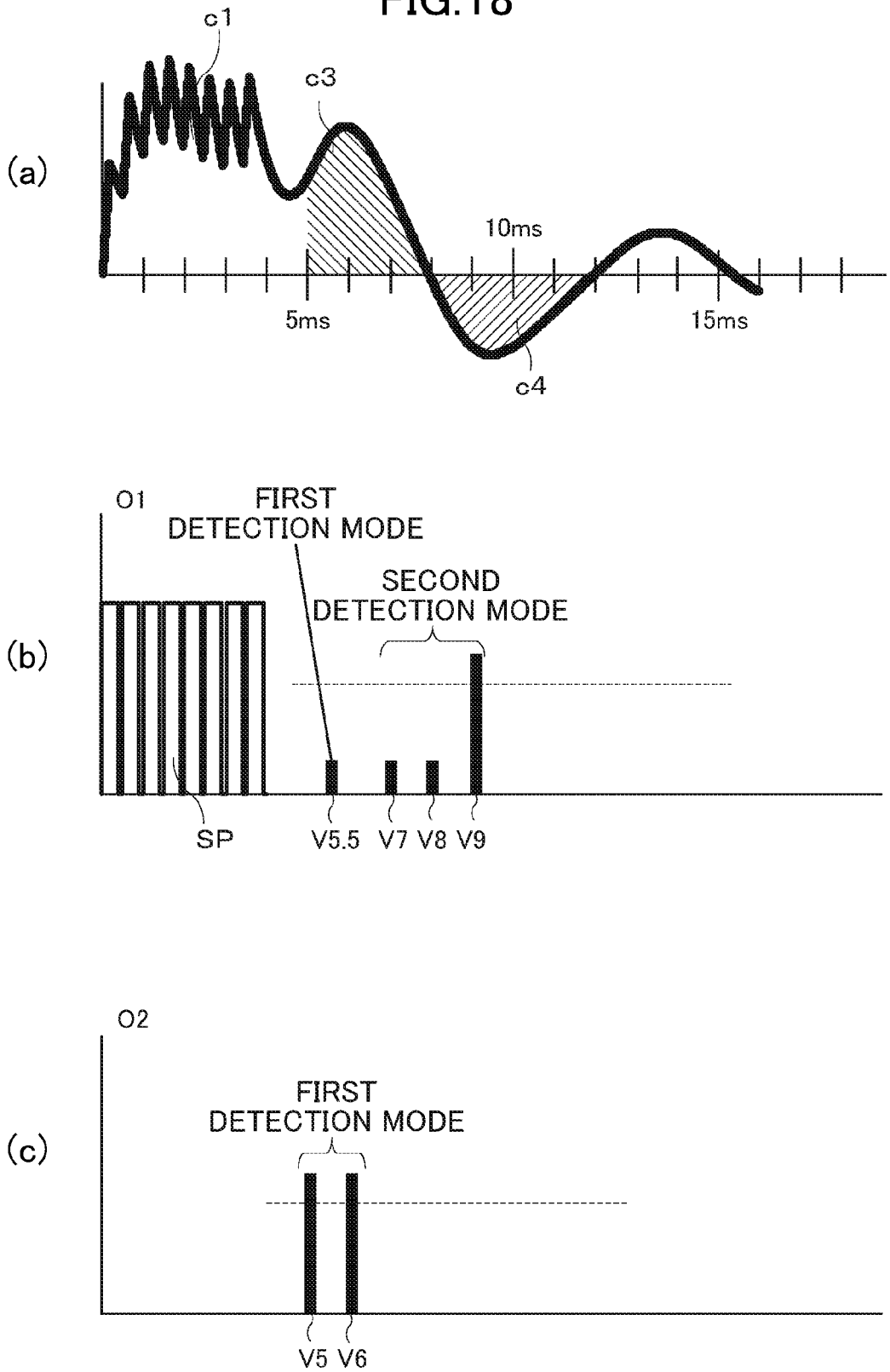
FIG. 18 are waveform diagrams of the pulse generated by the circuit of the electronic timepiece and a waveform diagram of the current generated in the coil, which are obtained when the rotor according to the fourth embodiment of the present invention is successfully rotated with the normal drive pulse and is properly determined to exhibit rotation.

In the same manner as in the first embodiment, even when there is a condition that the rotation failure is erroneously determined to raise the drive rank depending on the combination of the power supply voltage and the drive rank despite the rotation conducted as illustrated in FIG. 17, such a drive rank as illustrated in the waveform diagrams of FIG. 18 is lowered straight down to the drive rank exhibiting the smallest driving force, which prevents the drive rank from remaining stable at the drive rank exhibiting a large driving force and high current consumption. When the drive rank is lowered to the drive rank exhibiting the smallest driving force, the drive rank exhibiting such a waveform as illustrated in FIG. 16 is successively output several times immediately after the lowering of the drive rank, but the rotation can be finally conducted with stability at the drive rank that allows the rotation to be conducted with the minimum driving force for the power supply voltage as illustrated as the waveform diagrams in FIG. 15, and hence the drive can be conducted with low current consumption.

As described above, in the fourth embodiment, the drive rank to which the drive rank is to be lowered is switched based on whether or not the induced voltage generated by the rotation detection pulse F5.5 in the first detection mode exceeds the threshold value voltage Vth of the rotation detection circuit 9.

In the first embodiment, the rotation detection pulses B5 and B6 are used for both determination as to the shift to the second detection mode and determination of the switching of the drive rank to which the drive rank is to be lowered, while in the fourth embodiment, separate roles are played in such a manner that the rotation detection pulses B5 and B6 are used for only the determination as to the shift to the second detection mode and that the rotation detection pulse F5.5 is used for the determination of the switching of the drive rank to which the drive rank is to be lowered. In the fourth embodiment, in the same manner as in the first embodiment, even when a large voltage fluctuation occurs to cause a load fluctuation, the drive rank that allows the rotation to be conducted with the minimum driving force is finally reached, and hence the drive can be conducted with stability and with low current consumption.

Modification Example of Fourth Embodiment

Note that, this embodiment is not limited to the one described above, and the following modification examples can be provided.

(1) The respective numerical values such as the value of the chopper duty cycle of the normal drive pulse, the pulse number, the chopper cycle, the number of times of rotation determination, the number of times of determination count in the first detection mode, the number of determinations in the first detection mode and the second detection mode, the number of times of cancellation of the second detection mode (number of outputs of the second detection pulse), and the threshold value Vth are not limited to the above-mentioned numerical values, and needs to be optimized for the motor or the display body (such as a hand or a day dial) to be mounted.

(2) The separate roles are played in the first detection mode in such a manner that the rotation detection pulses B5 and B6 are used for only the determination as to the shift to the second detection mode and that the rotation detection pulse F5.5 is used for the determination of the switching of the drive rank to which the drive rank is to be lowered, and hence the threshold value Vth of the rotation detection pulse may differ for the respective roles. Providing different threshold values Vth allows the determination to be conducted with higher accuracy.

(3) The fourth embodiment is described on the assumption that the induced voltage generated in the coil by the rotation detection pulse F5.5 is used for the determination of the presence or absence of the detection signal but is not used for the rotation or non-rotation of the rotor of the step motor 8. However, it should be understood that the induced voltage can be used for the determination of the rotation or non-rotation.

(4) In the above-mentioned embodiment, the first detection mode determination counter circuit 111 is configured to count the number of times that the detection has not been conducted with the rotation detection pulse F5.5 in the first detection mode, but may be configured to count the number of times this detection has been conducted.

Fifth Embodiment

A fifth embodiment of the present invention is described. The fifth embodiment relates to an example of restricting the change in the drive rank in a case where a detection result of conducting the counting by the first detection mode determination counter circuit (111) is obtained when the normal drive pulse (SP) is output to only a specific terminal of a step motor.

This means that a load fluctuation is caused by a polarity of the rotor of the step motor in a case where an external magnetic field acts on the electronic timepiece, and hence the change in the drive rank is restricted in such a case because, when the drive rank is lowered to the lowest drive rank due to the temporary load fluctuation, the raising of the drive rank and the output of the correction drive pulse FP are repeated thereafter, which increases the power consumption. Now, the fifth embodiment according to the present invention is described with reference to the accompanying drawings.

Figure 19:
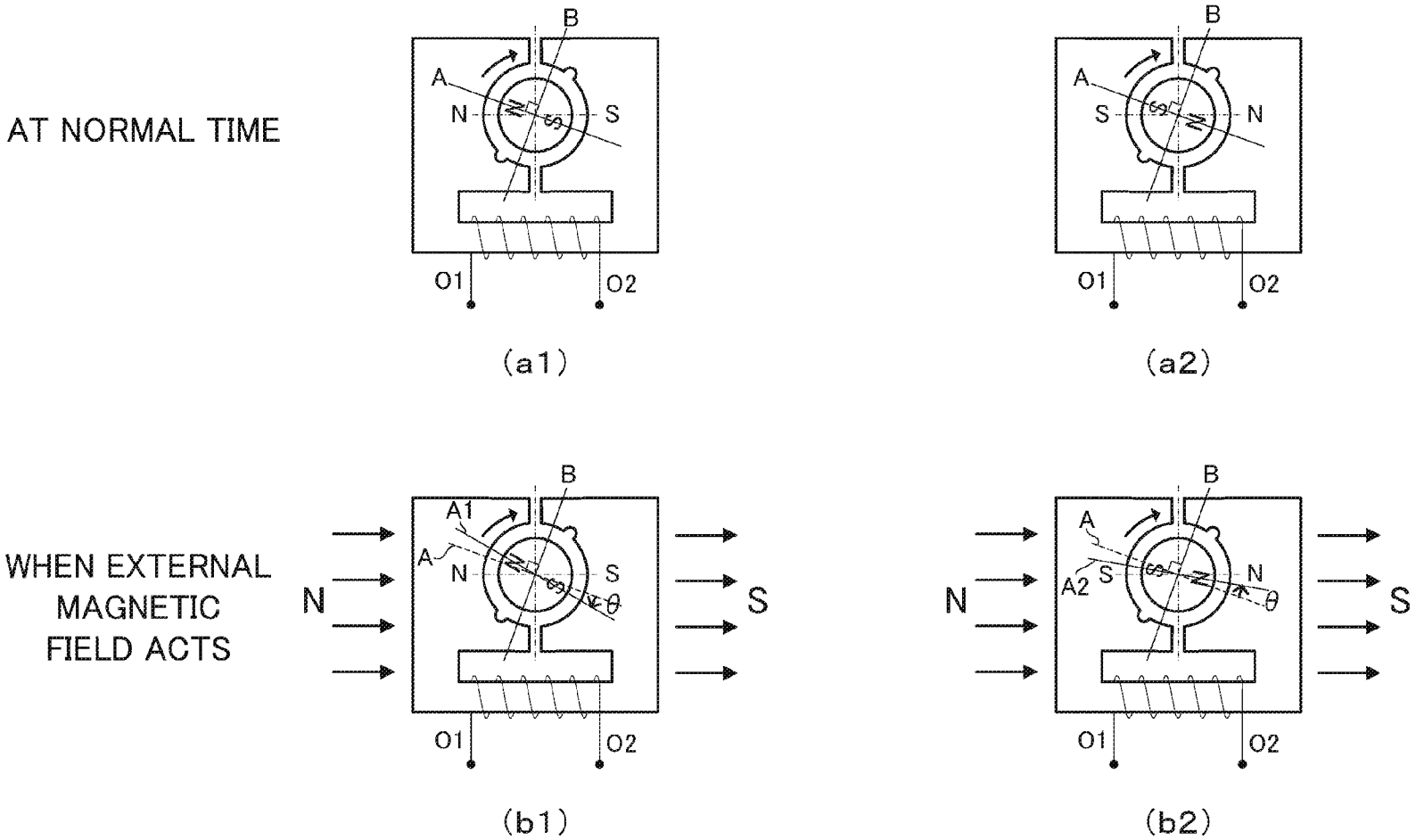
FIG. 19 are diagrams for illustrating a stable position of a rotor of a step motor exhibited when an external magnetic field acts thereon.
Figure 20:
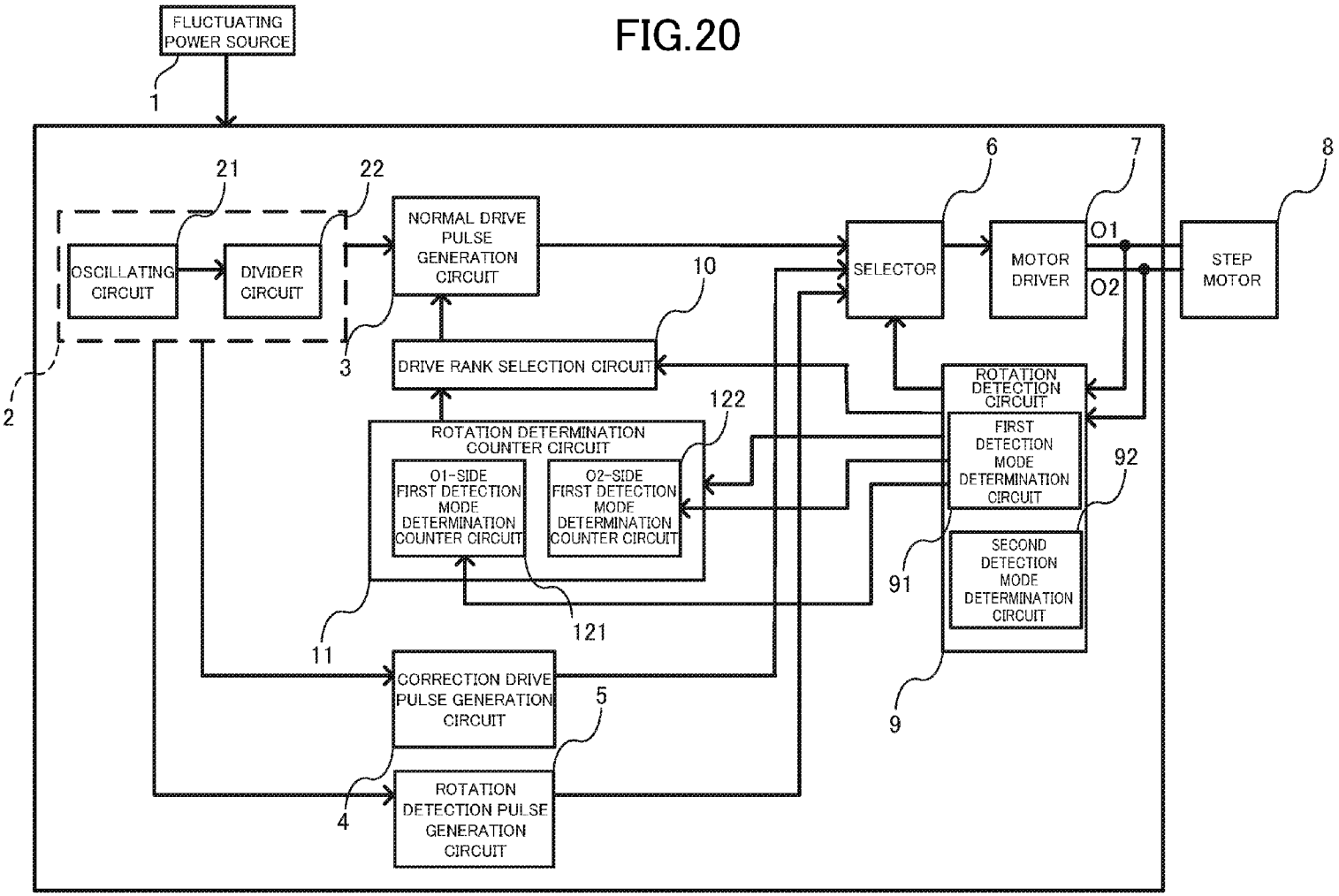
FIG. 20 is a block diagram for illustrating a circuit configuration according to a fifth embodiment of the present invention.
Figure 21:
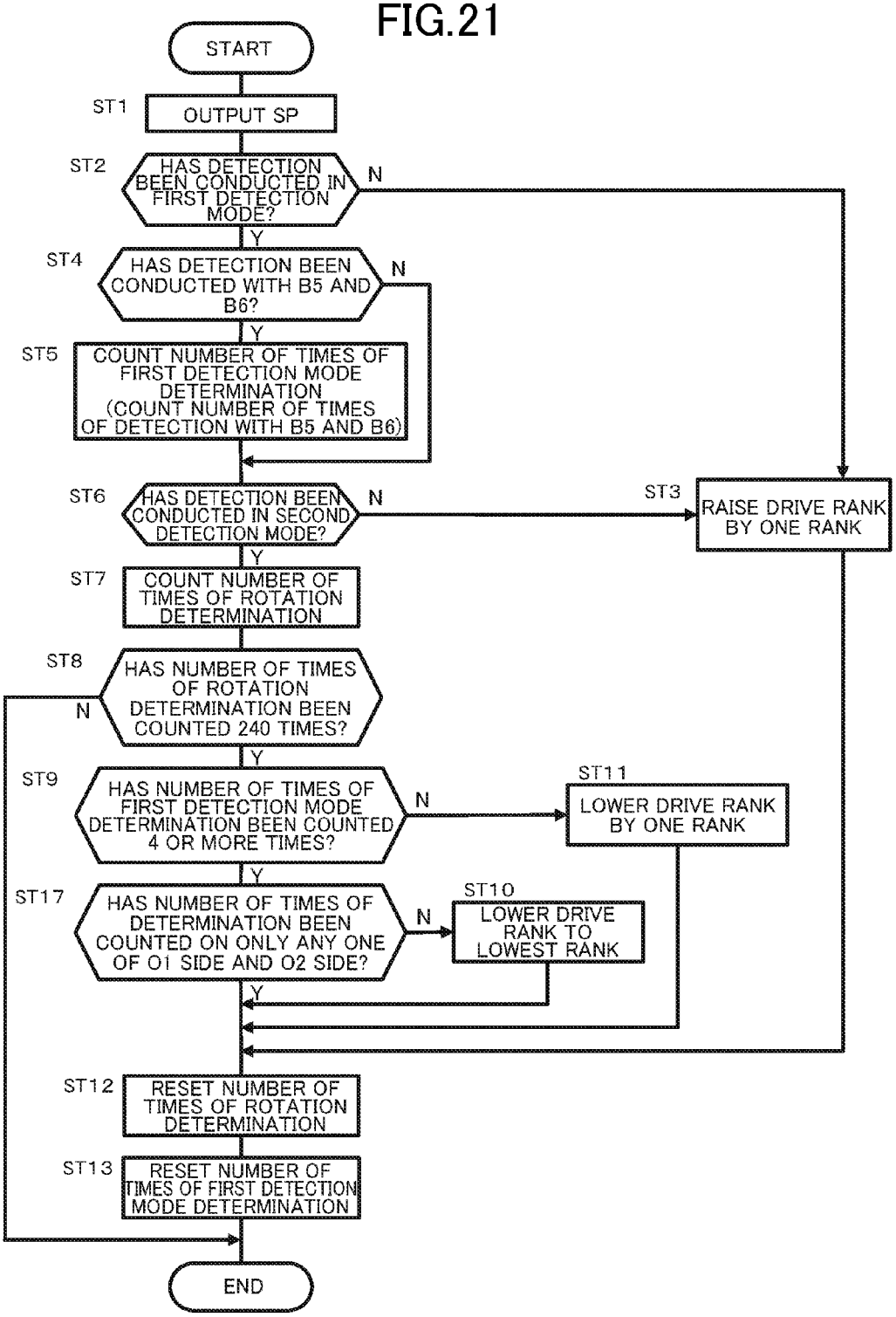
FIG. 21 is a flowchart of the fifth embodiment of the present invention.
Figure 23:
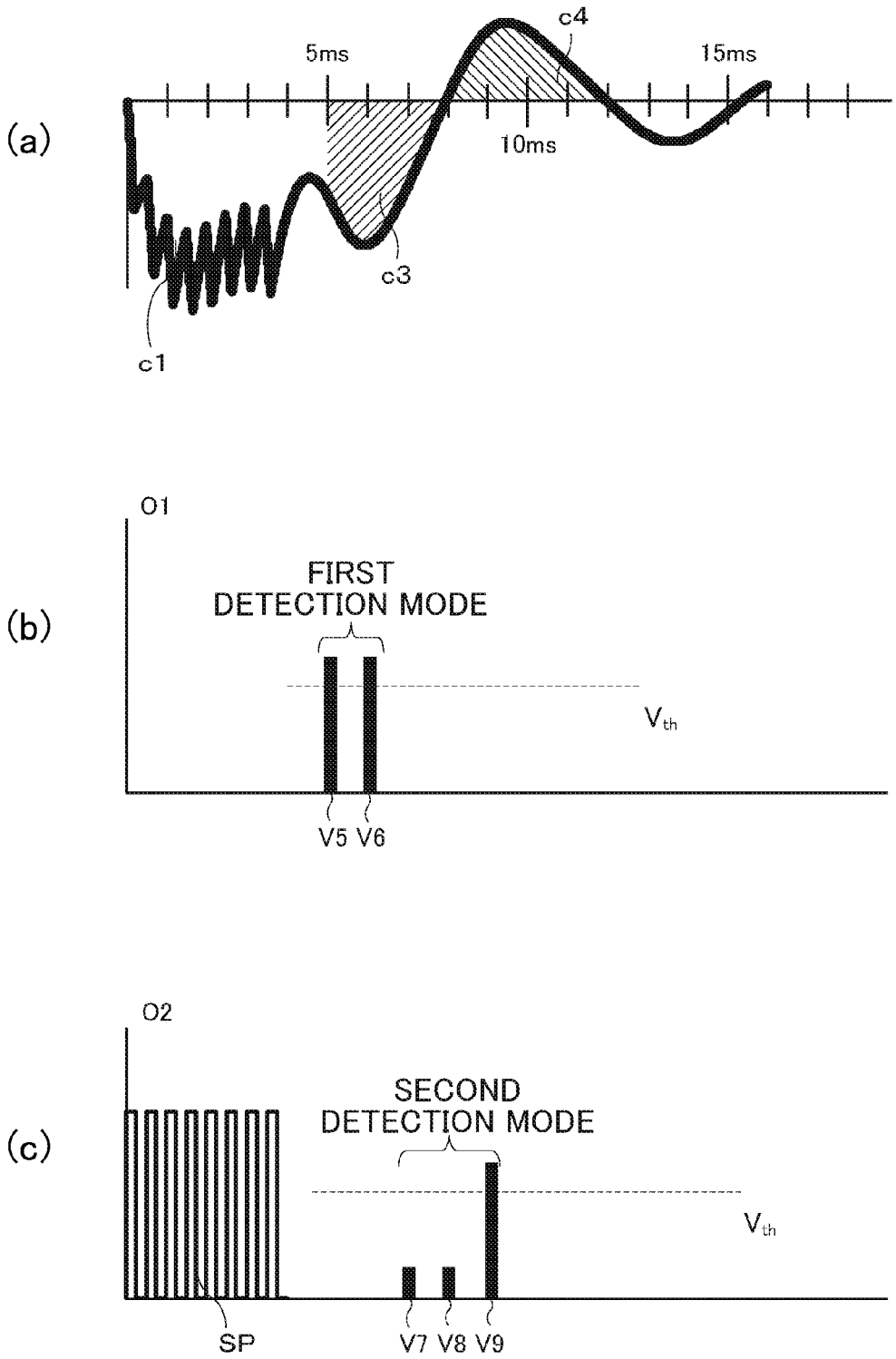
FIG. 23 are waveform diagrams of the pulse generated by the circuit of the electronic timepiece according to the fifth embodiment of the present invention and a waveform diagram of the current generated in the coil.

FIG. 19 are diagrams for illustrating a stable position of the rotor of the step motor exhibited when an external magnetic field acts thereon, FIG. 20 is a block diagram of the fifth embodiment of the present invention, FIG. 21 is a flowchart of the fifth embodiment of the present invention, FIG. 22 is a matrix table for showing the determination result of rotation or non-rotation obtained by changing the power supply voltage and the drive rank according to the fifth embodiment of the present invention, and FIG. 23 are waveform diagrams of the pulse generated by the circuit of an electronic timepiece according to the fifth embodiment of the present invention and a waveform diagram of the current generated in the coil. Except for those figures, the waveform diagrams of the pulse (FIG. 2) and the waveform diagrams of the pulse generated by the circuit of the electronic timepiece and the waveform diagram of the current generated in the coil (FIG. 6) are the same as those of the first embodiment, and descriptions thereof are omitted by using the same reference numerals to denote the same components as those described in the first embodiment.

FIG. 19(*a*1) is an illustration of the stable position under a static state, which is exhibited when an N-pole of the rotor of the step motor is positioned on a left side within FIG. 19(*a*1) under a state in which the external magnetic field does not act. At this time, a straight line A connecting centers of the N-pole and an S-pole of the rotor forms an angle as illustrated in FIG. 19(*a*1). The polarity excited in a stator by the coil and a direction in which the rotor is rotated thereby (arrow in FIG. 19(*a*1)) are also illustrated in FIG. 19(*a*1). Note that, in order to uniquely define a rotational direction of the rotor, the straight line A has such an orientation as to be slightly inclined relative to a straight line connecting centers of magnetic poles excited in the stator.

When the external magnetic field acts in this state, as illustrated in FIG. 19(*b*1), the stable position of the rotor under the static state is influenced by the external magnetic field to be changed to a straight line A1 further inclined from the straight line A toward the rotational direction by an angle θ. In this case, the rotor is in a state of being easier to rotate than in the case illustrated in FIG. 19(*a*1).

Further, FIG. 19(*a*2) is an illustration of the stable position under the static state, which is exhibited when the S-pole of the rotor of the step motor is positioned on the left side within FIG. 19(*a*2) under the state in which the external magnetic field does not act. In this case, the straight line A has the same orientation as in the case of FIG. 19(*a*1) referred to above.

When the same external magnetic field as the above-mentioned case of FIG. 19(*b*1) acts in this state, as illustrated in FIG. 19(*b*2), the stable position of the rotor under the static state is influenced by the external magnetic field to be changed to a straight line A2 further inclined from the straight line A toward a reverse rotational direction by the angle θ. In this case, the rotor is in a state of being harder to rotate than in the case illustrated in FIG. 19(*a*2).

From the above description, when an external magnetic field acts, each time the polarity of the rotor of the step motor is reversed, that is, each time the step motor is driven by one step, the rotor alternates between the state of being easier to rotate and the state of being harder to rotate.

The drive rank of the normal drive pulse SP selected by the drive rank selection circuit 10 in this case is the drive rank within the region of the bold italic SP indication shown in FIG. 22 that allows the rotor to be rotated even when the rotor is in the state of being harder to rotate. When the rotor in the state of being easier to rotate is driven with the normal drive pulse SP of this drive rank, for example, a current waveform induced in the coil after the rotation of the rotor is as illustrated in FIG. 23. Although described later in detail, as illustrated in FIG. 23(*b*), the induced voltages V5 and V6 generated by the rotation detection pulse B5 and the rotation detection pulse B6 become the detection signals exceeding the threshold value voltage Vth, and hence the drive rank of the normal drive pulse SP is lowered to the minimum rank according to the electronic timepiece of the first embodiment.

On the other hand, a current waveform which is induced in the coil after the rotation of the rotor after the rotor in the state of being harder to rotate is driven and which forms a pair with FIG. 23 is approximately the same as that illustrated in FIG. 6. Therefore, under the action of the external magnetic field, the current waveform and the detection signal illustrated in FIG. 23 and the current waveform and the detection signal illustrated in FIG. 6 appear alternately.

Therefore, this embodiment employs a configuration in which, as illustrated in FIG. 20, the rotation determination counter circuit 11 includes an O1-side first detection mode determination counter circuit 121 and an O2-side first detection mode determination counter circuit 122 as the first detection mode determination counter circuit to count the number of times that the detection signal based on a detection pulse in the first detection mode becomes a predetermined detection pattern for each polarity of the rotor. Note that, the configuration of the first detection mode determination counter circuit is not limited to that illustrated in FIG. 20, and may be any configuration that allows the number of times to be counted for each polarity of the rotor, that is, for each output of the normal drive pulse (SP) with respect to a specific terminal.

Other points, for example, the point that the drive rank selection circuit 10 is controlled so as to change the drive rank when the number of times that rotation has been successively determined to be exhibited reaches the set number of times, and the point that the numbers of times counted by the rotation determination counter circuit 11 and the first detection mode determination counter circuit (that is, the O1-side first detection mode determination counter circuit 121 and the O2-side first detection mode determination counter circuit 122) are reset after the drive rank is changed and when the rotor is determined to exhibit non-rotation, are the same as those of the first embodiment.

Next, an operation of the above-mentioned configuration is described with reference to a flowchart of FIG. 21. The operation conducted at every precise second is illustrated in the flowchart, from which the same parts as those of the first embodiment are omitted, and parts different from those of the first embodiment are described.

That is, the steps conducted until the count value of the first detection mode determination counter circuit is confirmed in Step ST9 and the drive rank is lowered to the rank lower by one rank when the number of times of determination thereof is not 4 or more times (Step ST11) are the same as those of the first embodiment. Note that, in this case, the count value of the first detection mode determination counter circuit is the count value of the entire first detection mode determination counter circuit, and is therefore a total sum of respective count values of the O1-side first detection mode determination counter circuit 121 and the O2-side first detection mode determination counter circuit 122.

When it is determined in Step ST9 that the number of times of determination thereof is 4 or more times, it is determined in Step ST17 that the number of times of determination has been counted for only a specific terminal. This determination can be conducted by determining that, for example, the number of times of determination conducted by any one of the O1-side first detection mode determination counter circuit 121 and the O2-side first detection mode determination counter circuit 122 is 0 times or equal to or smaller than a predetermined number of times (for example, one time).

When the determination result of Step ST17 is negative, it is conceivable that the situation in this case is not due to the influence of the external magnetic field, and hence, in the same manner as in the first embodiment, the procedure advances to Step ST10 to lower the drive rank to the minimum rank, and advances to Step ST12 and Step ST13 to reset each of the number of times of rotation determination and the number of times of first detection mode determination.

In contrast, when the determination result of Step ST17 is positive, it is conceivable that the situation in this case is temporary due to the influence of the external magnetic field, and the drive rank does not need to be lowered to the minimum rank. Therefore, the change in the drive rank conducted by the drive rank selection circuit 10 is restricted. This embodiment is configured so as not to change the drive rank by simply advancing to Step ST12 and Step ST13 to reset each of the number of times of rotation determination and the number of times of first detection mode determination. Note that, instead of this, the drive rank may be changed to a rank other than the minimum rank, for example, changed to the rank lower by one rank.

Next, the operation of the actual rotation detection is described with reference to waveform diagrams by taking a typical example. Note that, the waveform diagrams exhibited in the state of FIG. 19(*b*2), that is, exhibited when the rotor is in the state of being harder to rotate, are the same as those of FIG. 6, and descriptions thereof are also the same as those of the first embodiment and are therefore omitted.

In contrast, the waveform diagrams exhibited in the state of FIG. 19(*b*1), that is, exhibited when the rotor is in the state of being easier to rotate are the ones of FIG. 23. In this case, the normal drive pulse SP having an excessive driving force is applied to the rotor, and hence, as illustrated in FIG. 23(*a*), the current waveform induced in the terminal of the coil includes the waveform c3 which immediately appears after the waveform c1 based on the normal drive pulse SP without the appearance of the waveform c2 unlike in FIG. 6 (that is, the waveform c3 appears at an early stage). Therefore, at the time point of 5 ms after a precise second at which the first detection mode is started, the current waveform already falls within the region of the waveform c3, and the induced voltages V5 and V6 generated by the rotation detection pulses B5 and B6 become the detection signals exceeding the threshold value voltage Vth of the rotation detection circuit 9. The shift is made to the second detection mode when the detection signals of the two induced voltages V5 and V6 exceed the threshold value Vth.

When the shift is made to the second detection mode, the rotation detection pulse F7 is applied to the coil from the subsequent timing, that is, the time point of 7 ms illustrated in FIG. 23(*c*). In this example, at the time point of 7 ms and a time point of 8 ms, the current waveform still falls within the region of the waveform c3, and hence the induced voltages V7 and V8 do not exceed the threshold value voltage Vth. When the current waveform enters the region of the waveform c4 at a time point of 9 ms, the positive or negative of the current value is changed, and the induced voltage V9 generated by the rotation detection pulse F9 exceeds the threshold value voltage Vth to become the detection signal. As a result, the second detection mode determination circuit 92 determines the rotation success.

In this case, the detection signals based on the rotation detection pulses B5 and B6 are obtained in the first detection mode, and hence 1 is added to the number of times of determination for the terminal on the side to which the normal drive pulse SP is applied, in this case, to the number of times of determination of the O1-side first detection mode determination counter circuit 121.

Modification Example of Fifth Embodiment

Note that, this embodiment is not limited to the one described above, and the same modifications as those described in the first embodiment may be made thereto.

Sixth Embodiment

A sixth embodiment of the present invention is described. The sixth embodiment relates to an example of raising the drive rank when the number of times counted by the first detection mode determination counter circuit (11) becomes equal to or larger than a predetermined number.

That is, as in the first embodiment, the same effects as those of the first embodiment are obtained by raising the drive rank instead of selecting the drive rank so that the normal drive pulse SP having the smallest driving force is attained when the counter value of the first detection mode determination counter circuit 111 is 4 or more times. Now, the sixth embodiment according to the present invention is described with reference to the accompanying drawings.

Figure 24:
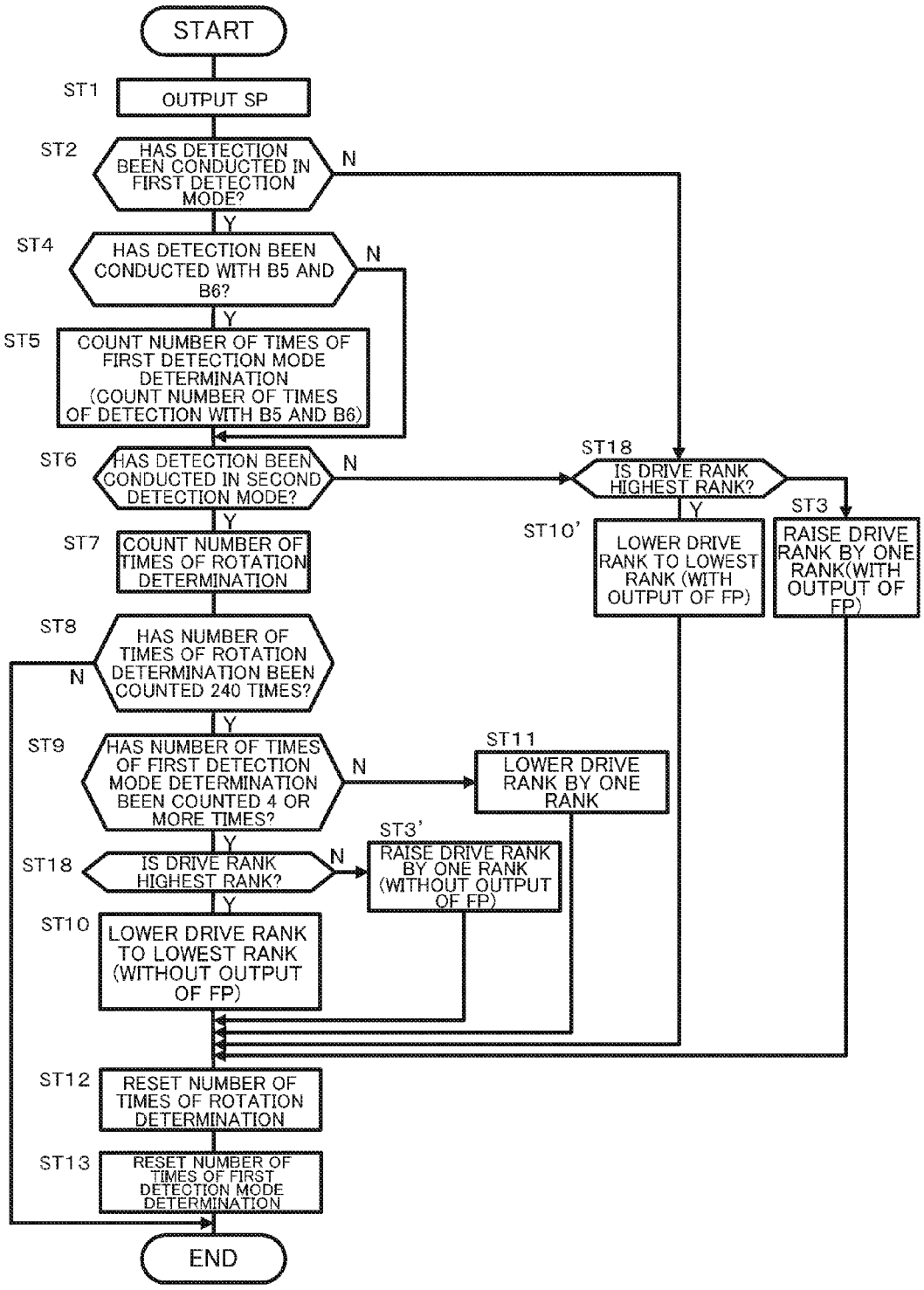
FIG. 24 is a flowchart of the sixth embodiment of the present invention.
Figure 25:
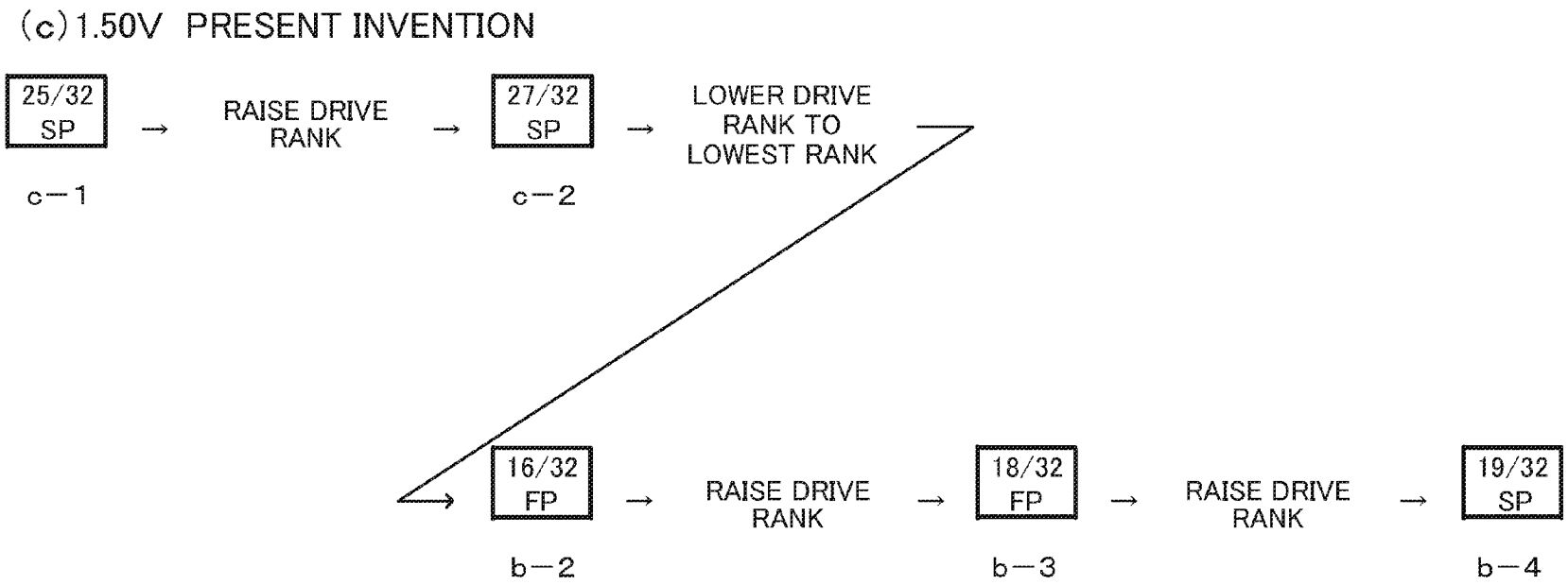
FIG. 25 is a diagram for schematically illustrating a change in the drive rank from the stable state at the drive rank 25/32 according to the sixth embodiment of the present invention.

FIG. 24 is a flowchart of the sixth embodiment of the present invention, and FIG. 25 is a diagram for schematically illustrating a change in the drive rank from the stable state at the drive rank 25/32. Except for those figures, the block diagram (FIG. 1), the waveform diagrams of the pulse (FIG. 2), the matrix table for showing the determination result of rotation or non-rotation obtained by changing the power supply voltage and the drive rank (FIG. 4), and the waveform diagrams of the pulse generated by the circuit of the electronic timepiece and the waveform diagram of the current generated in the coil (FIG. 6) are the same as those of the first embodiment, and descriptions thereof are omitted by using the same reference numerals to denote the same components as those described in the first embodiment.

An operation of an electronic timepiece of this embodiment is described with reference to a flowchart of FIG. 24. The operation conducted at every precise second is illustrated in the flowchart, from which the same parts as those of the first embodiment are omitted, and parts different from those of the first embodiment are described.

First, the steps conducted after the normal drive pulse SP is output (Step ST1) until the presence or absence of the detection of the detection signal conducted in the first detection mode is determined by the first detection mode determination circuit 91 (Step ST2) and the steps conducted after the rotation of the rotor is detected in the first detection mode (Step ST2: Y) until the presence or absence of the detection of the detect ion signal conducted in the second detection mode is determined by the second detection mode determination circuit 92 (Step ST6), are the same as those of the first embodiment.

When the rotor is determined to exhibit non-rotation, that is, when the detection signal fails to be detected in the first detection mode (Step ST2: N) and when the detection signal fails to be detected in the second detection mode (Step ST6: N), the procedure advances to Step ST18 to determine whether or not the current drive rank is a highest rank. When the current drive rank is the highest rank, the drive rank is lowered to the minimum rank, and the correction drive pulse FP is output to rotate the rotor (Step ST10'). When the current drive rank is not the highest rank, the drive rank is raised by one rank, and the correction drive pulse FP is output to rotate the rotor as well (Step ST3). In any of the cases, after the correction drive pulse is output, the procedure advances to Step ST12 and Step ST13 to reset the number of times of rotation determination and the number of times of first detection mode determination.

The point that, when the rotor is determined to exhibit rotation, that is, when the detection signal is detected in the second detection mode (Step ST6: Y), the number of times of rotation determination is counted in the subsequent Step ST7 and then it is determined in Step ST9 whether or not the number of times of first detection mode determination has been counted 4 or more times and the point that, when the number of times of first detection mode determination has not reached 4 times (Step ST9: N), the procedure advances to Step ST11 to lower the rank of the driving pulse by one rank, are the same as those of the first embodiment.

When it is determined that the number of times of first detection mode determination has been counted 4 or more times (Step ST9: Y), it is determined in the subsequent Step ST18 whether or not the current drive rank is the highest rank. When the current drive rank is not the highest rank (Step ST18: N), the procedure advances to Step ST3' to raise the drive rank by one rank. The control conducted in this case is different from that of Step ST3, and the rotor is rotated with the normal drive pulse SP, which eliminates the need to output the correction drive pulse FP. Therefore, when the drive rank is raised by one rank, the correction drive pulse FP is inhibited from being output in order to suppress an increase in the current consumption. Note that, even when the correction drive pulse FP is allowed to be output, the rotor which is already in the state of being rotated is not to be further rotated, and hence there is no problem except that wasteful current consumption occurs. In contrast, when the current drive rank is the highest rank, the procedure advances to Step ST10 to lower the drive rank to the minimum rank. In any of those cases, the correction drive pulse is not output, and the procedure advances to Step ST12 and Step ST13 to reset the number of times of rotation determination and the number of times of first detection mode determination.

The change in the drive rank conducted under the control described in the flow is described by taking an example. FIG. 25 is a diagram for schematically illustrating the change in the drive rank from the drive rank 25/32 having the relatively large driving force indicated in the region of the bold italic SP indication with 1.50 V (see FIG. 4).

With reference to FIG. 25(*c*) "1.50 V Present Invention", in the case of this embodiment, when the rotation has been successively conducted at the drive rank 25/32 of the same normal drive pulse SP 240 times (c-1), the drive rank is raised by one rank instead of being lowered. As a result, the drive rank becomes 26/32, but this region is also the region of the bold italic SP indication. Thus, when the rotation is successively conducted in this state further 240 times, the drive rank is further raised by one rank to become the drive rank 27/32 as a highest drive rank (c-2).

This highest drive rank 27/32 also falls within the region of the bold italic SP indication. Thus, when the rotation is successively conducted in this state further 240 times, the drive rank cannot be raised any further, but is lowered to the lowest drive rank 16/32 instead (b-2). The drive ranks 16/32 to 18/32 fall within the region of the FP indication as described above, and hence, the driving pulse is repeatedly raised in rank each time the rotor is operated (b-3), and the drive rank becomes stable at the drive rank 19/32 being the lowest drive rank among the regions of the SP indication (b-4). The point that the lowering of the drive rank to the drive rank 18/32 and the immediate raising of the drive rank to the drive rank 19/32 are repeated each time the rotation is conducted 240 times under the state in which the drive rank is stable at the drive rank 19/32 is the same as that of the first embodiment.

In this manner, even with such a configuration as to raise the drive rank when the counter value of the first detection mode determination counter circuit 111 is 4 or more times and lower the drive rank to the lowest drive rank when the drive rank is the highest drive rank, the drive rank becomes stable within the region of the SP indication without becoming stable within the region of the bold italic SP indication, and hence the rotation can be conducted with low current consumption in the same manner as in the first embodiment.

Modification Example of Sixth Embodiment

Note that, this embodiment is not limited to the one described above, and the same modifications as those described in the first embodiment may be made thereto.

Seventh Embodiment

A seventh embodiment of the present invention is described. The seventh embodiment relates to an example of altering the manner of changing the drive rank, that is, lowering the drive rank to the minimum rank, even when the detection result of conducting the counting by the first detection mode determination counter circuit (111) is obtained based on the detection signal detected non-successively.

This means that, in a case where a higher drive rank, for example, such a drive rank as to change a duty cycle of the normal drive pulse SP from 28/32 to 30/32 is used, such as a case where the rotor of the step motor is to be rotated even under a state in which the power supply voltage is lowered, there may exist a combination erroneously determined to exhibit non-rotation under a condition in which the power supply voltage and the drive rank are both high, and hence the drive rank is stopped at a high rank due to the erroneous determination for such a region, to thereby cause an increase in the current consumption, and that the drive rank is therefore lowered to a proper rank also in such a case. Now, the seventh embodiment according to the present invention is described with reference to the accompanying drawings.

Figure 26:
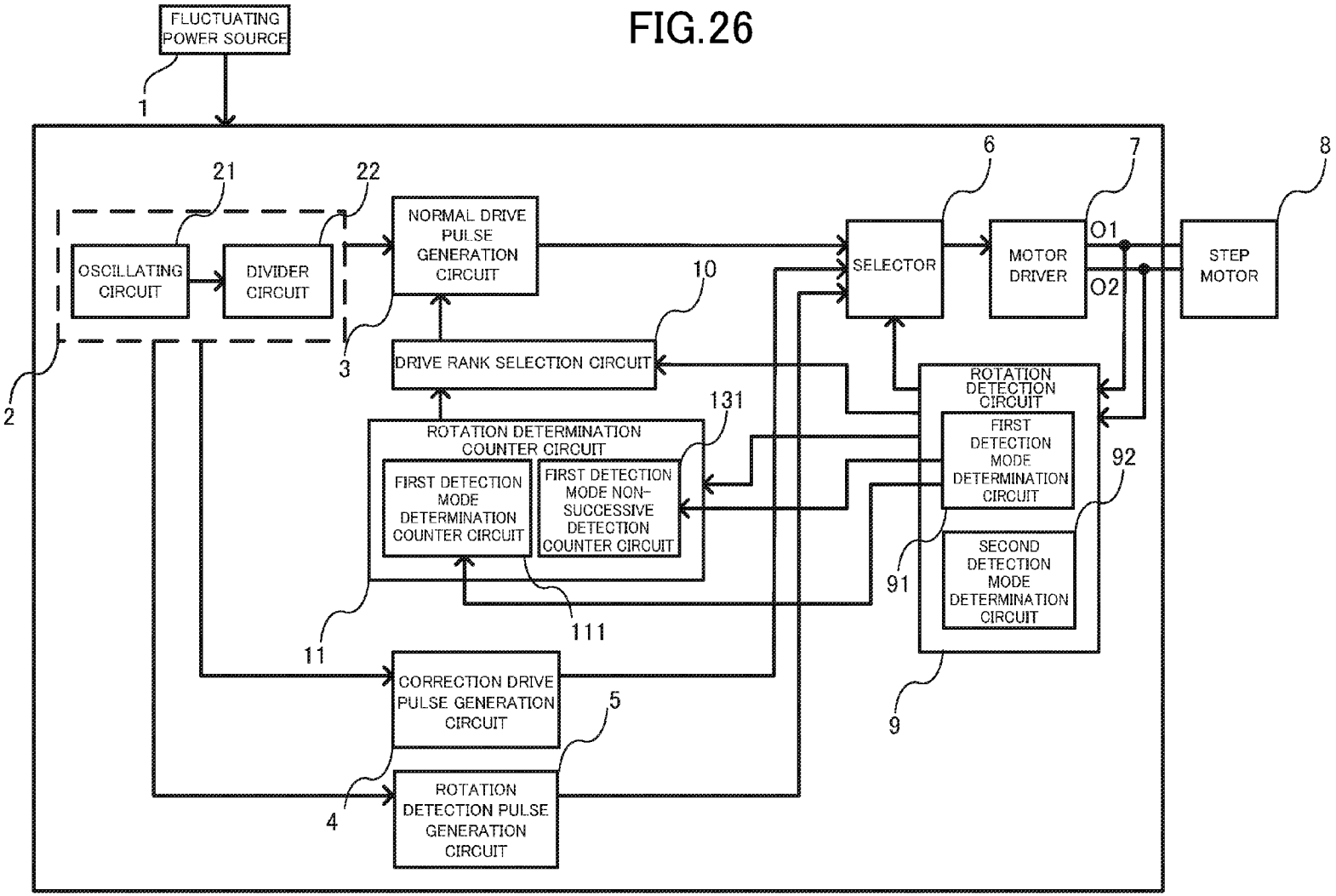
FIG. 26 is a block diagram for illustrating a circuit configuration according to the seventh embodiment of the present invention.
Figure 27:
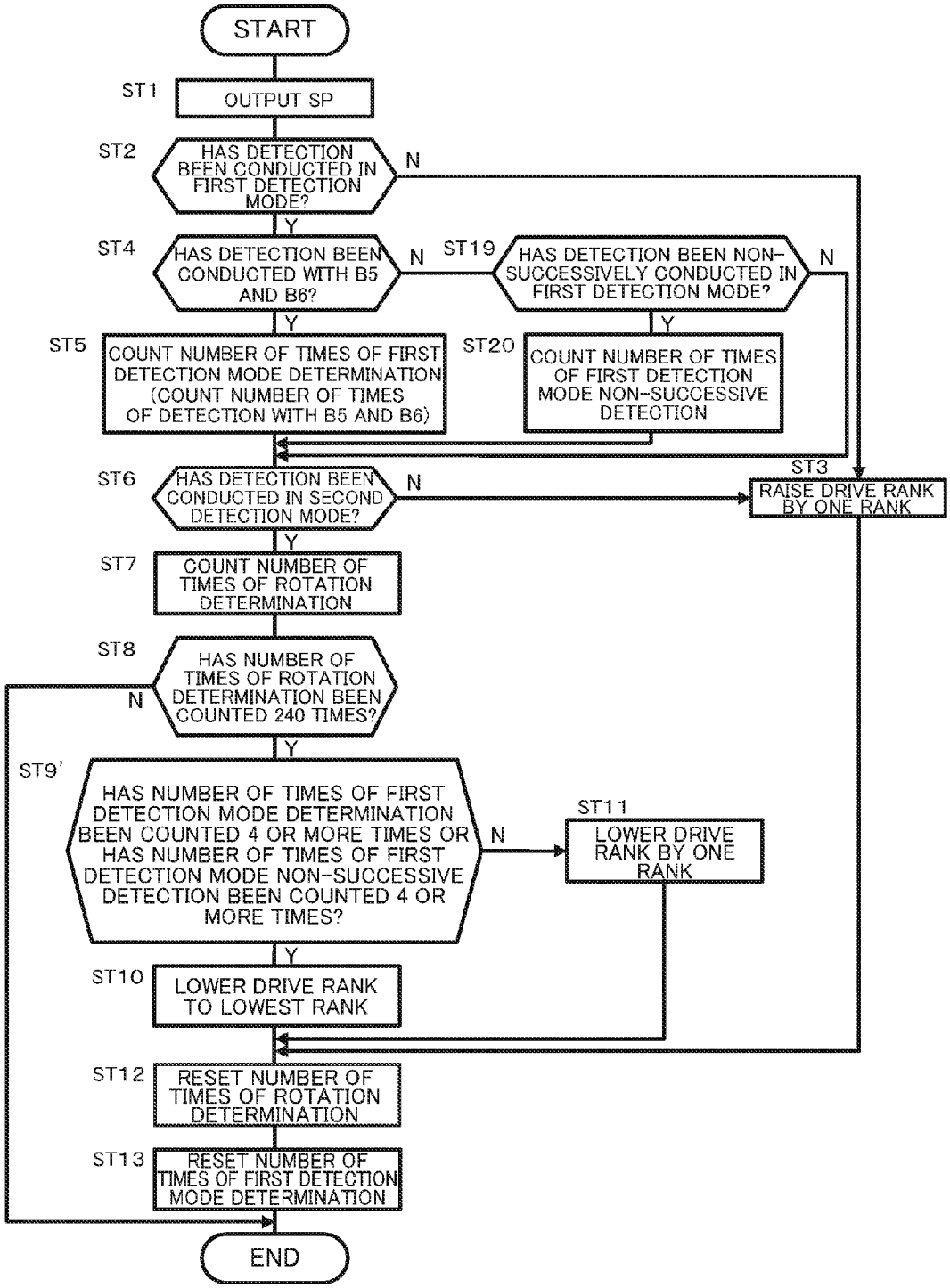
FIG. 27 is a flowchart of the seventh embodiment of the present invention.
Figure 29:
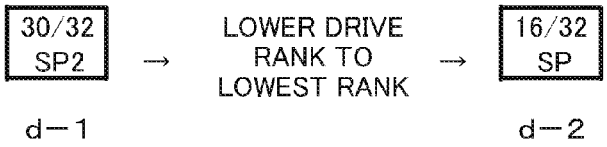
FIG. 29 is a diagram for schematically illustrating a change in the drive rank from a drive rank 30/32 according to the seventh embodiment of the present invention.
Figure 30:
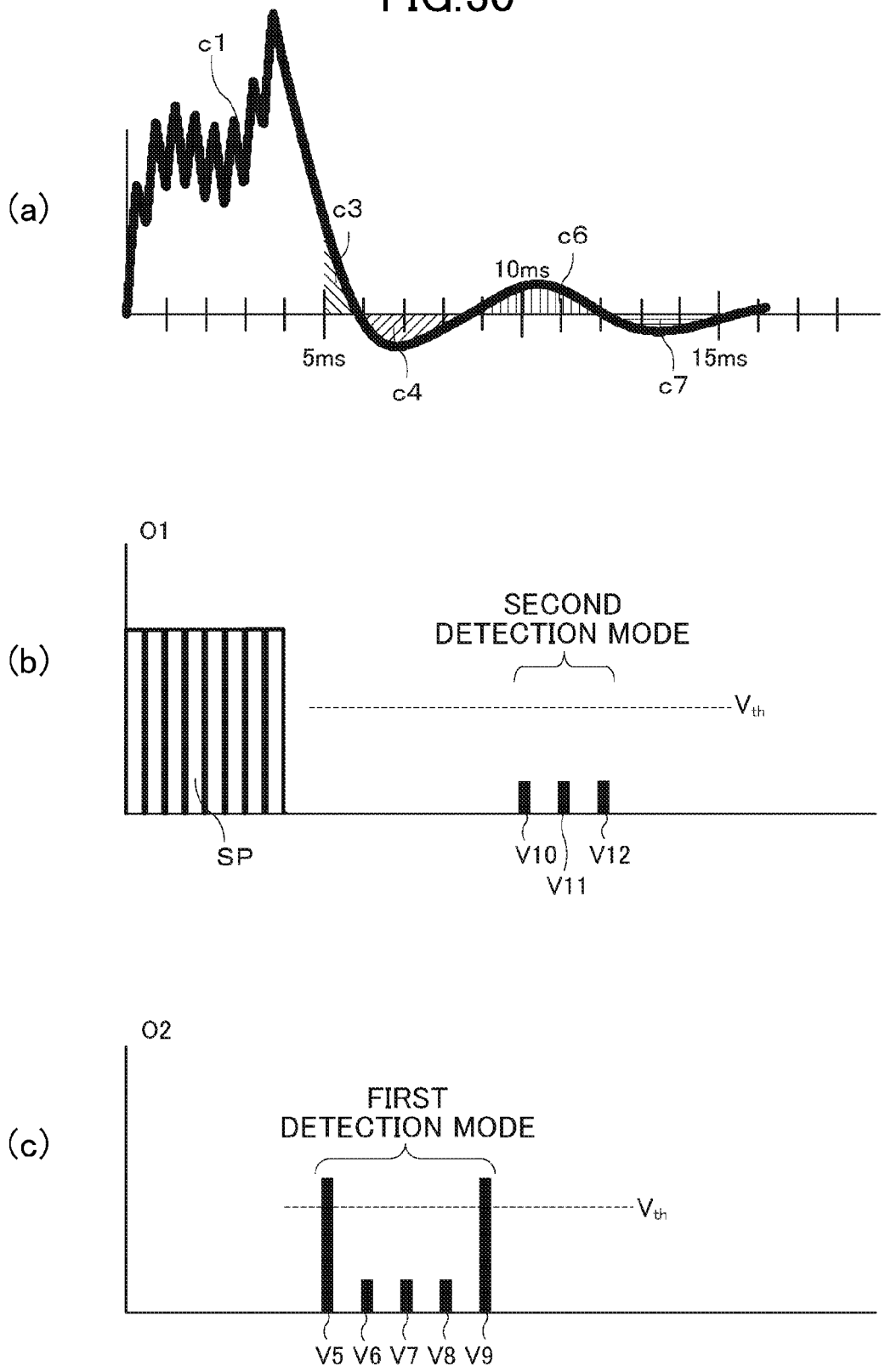
FIG. 30 are waveform diagrams of the pulse generated by the circuit of the electronic timepiece according to the seventh embodiment of the present invention and a waveform diagram of the current generated in the coil.
Figure 31:
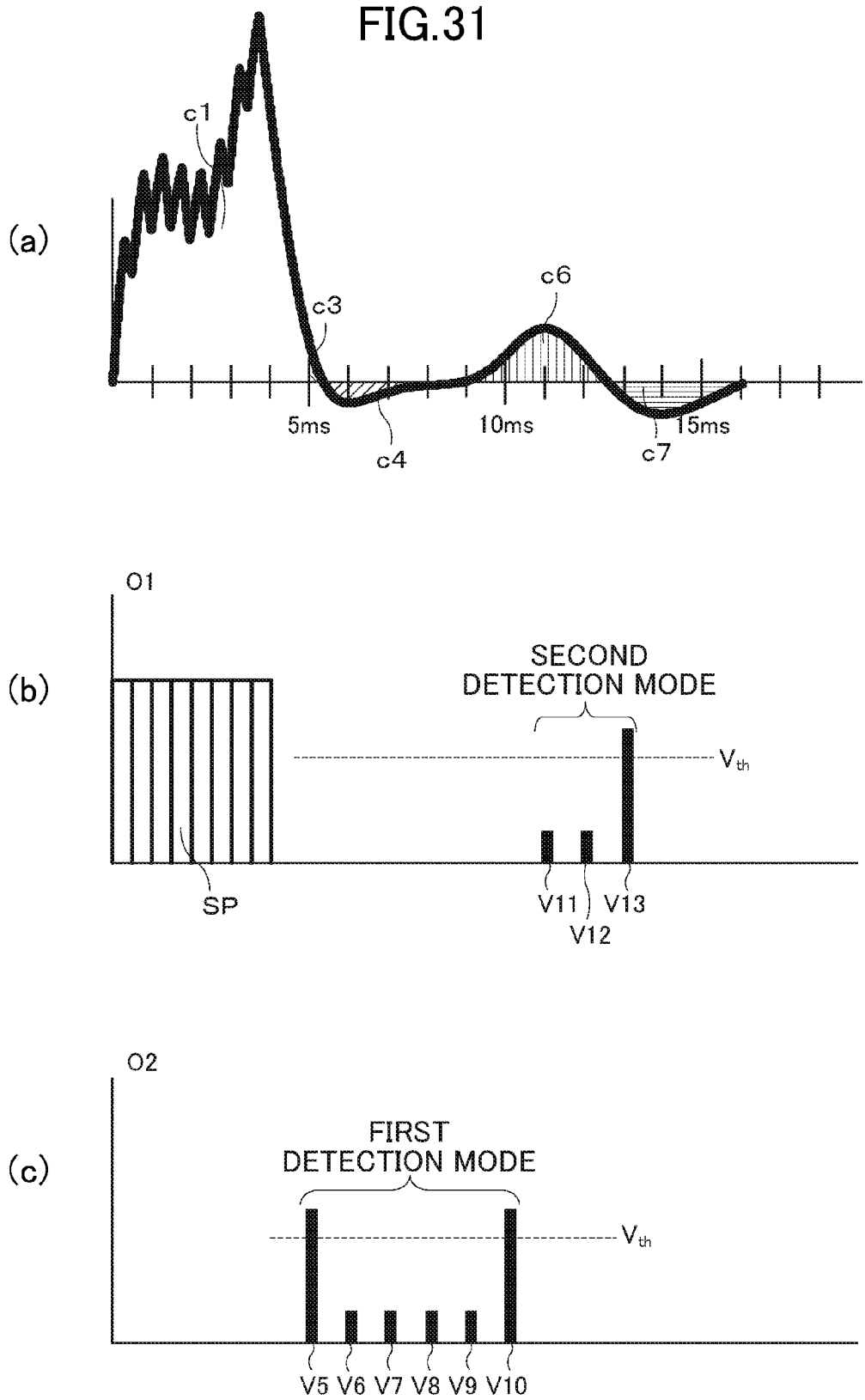
FIG. 31 are waveform diagrams of the pulse generated by the circuit of the electronic timepiece according to the seventh embodiment of the present invention and a waveform diagram of the current generated in the coil.

FIG. 26 is a block diagram of the seventh embodiment of the present invention, FIG. 27 is a flowchart of the seventh embodiment of the present invention, FIG. 28 is a matrix table for showing the determination result of rotation or non-rotation obtained by changing the power supply voltage and the drive rank according to the seventh embodiment of the present invention, FIG. 29 is a diagram for schematically illustrating a change in the drive rank from the drive rank 30/32, and FIG. 30 and FIG. 31 are waveform diagrams of the pulse generated by the circuit of an electronic timepiece according to the seventh embodiment of the present invention and a waveform diagram of the current generated in the coil. The waveform diagrams of the pulse (FIG. 2) are the same as those of the first embodiment, and descriptions thereof are omitted by using the same reference numerals to denote the same components as those described in the first embodiment.

In this embodiment, as illustrated in FIG. 26, the rotation determination counter circuit 11 includes a first detection mode non-successive detection counter circuit 131 in addition to the first detection mode determination counter circuit 111. In this case, the first detection mode determination counter circuit 111 is configured to count the number of times the detection signal has been detected prior to a predetermined timing in the first detection mode in the same manner as that of the first embodiment, and the first detection mode non-successive detection counter circuit 131 is configured to count a number of times that the detection signal has been non-successively detected in the first detection mode. The first detection mode determination counter circuit 111 and the first detection mode non-successive detection counter circuit 131 are the same in that both count the number of times that the detection signal in the first detection mode becomes a predetermined detection pattern.

Further, after the drive rank is changed and when the rotor is determined to exhibit non-rotation, not only the numbers of times counted by the rotation determination counter circuit 11 and the first detection mode determination counter circuit 111 but also the number of times counted by the first detection mode non-successive detection counter circuit 131 is reset. Other points, for example, the point that the drive rank selection circuit 10 is controlled so as to change the drive rank when the number of times that rotation has been successively determined to be exhibited reaches the set number of times, are the same as those of the first embodiment.

Next, an operation of the above-mentioned configuration is described with reference to a flowchart of FIG. 27. The operation conducted at every precise second is illustrated in the flowchart, from which the same parts as those of the first embodiment are omitted, and parts different from those of the first embodiment are described.

The steps conducted after the normal drive pulse SP is first output (Step ST1) until the presence or absence of the detection of the detection signal in the first detection mode is determined by the first detection mode determination circuit 91 (Step ST2), the steps conducted after the procedure advances to Step ST3 when no detection occurs in the first detection mode (Step ST2: N) until the drive rank is raised by one rank to output the correction drive pulse FP, and the steps conducted after the detection occurs in the first detection mode (Step ST2: Y) until it is determined whether or not the detection has been conducted with both the detection pulses B5 and B6 prior to the predetermined timing (Step ST4), are the same as those of the first embodiment.

When the detection has been conducted with both the detection pulses B5 and B6 (Step ST4: Y), in the same manner as in the first embodiment, the number of times of first detection mode determination is counted by being incremented by 1 by the first detection mode determination counter circuit 111 in the subsequent Step ST5, and the procedure advances to Step ST6.

In contrast, when the detection has not been conducted with both the detection pulses B5 and B6 (Step ST4: N), the procedure advances to Step ST19 to determine whether or not the detection signal in the first detection mode has been non-successively detected. When the detection has been non-successively conducted (Step ST19: Y), a number of times of the first detection mode non-successive determination is counted by being incremented by 1 by the first detection mode non-successive detection counter circuit 131 in Step ST20, and the procedure advances to Step ST6. When the detection is not non-successive (Step ST19: N), the procedure merely advances to Step ST6 in the same manner as in the first embodiment.

Step ST6 is the same as that of the first embodiment, and the presence or absence of the detection signal in the second detection mode is determined. When the detection has not been conducted (Step ST6: N), the procedure advances to Step ST3 to raise the drive rank by one rank and output the correction drive pulse FP. Step ST7 and Step ST8 are not different from those of the first embodiment.

When it is determined in Step ST8 that the number of times of rotation determination has been counted 240 times (Step ST8: Y), the procedure advances to Step ST9' to determine whether or not any one of such conditions as whether or not the number of times of first detection mode determination is the predetermined number of times, in this case, 4 or more times, and whether or not the number of times of the first detection mode non-successive determination is the predetermined number of times, in this case, 4 or more times, is satisfied. When the condition is not satisfied (Step ST9': N), the procedure advances to Step ST11 to lower the drive rank by one rank. When the condition is satisfied (Step ST9': Y), the procedure advances to Step ST10 to lower the drive rank to the minimum rank.

In any one of cases where the drive rank is raised in Step ST3 and where the drive rank is lowered in Step ST11 and Step ST10, the procedure advances to Step ST12 and Step ST13 to reset each of the number of times of rotation determination, the number of times of first detection mode determination and the number of times of the first detection mode non-successive determination.

This flow is different from the flowchart of FIG. 3 according to the first embodiment in that not only the number of times that the detection signal has been detected with the detection pulses B5 and B6 (Step ST4 and Step ST5) but also the number of times that the detection signal has been non-successively detected is counted (Step ST19 and Step ST20) after the detection signal is detected in the first detection mode (Step ST2: Y), and in that a condition based on a count value of the number of times of the first detection mode non-successive determination is added to the condition based on the count value of the number of times of first detection mode determination as the condition for lowering the drive rank to the minimum rank in Step ST9 (Step ST10).

Next, an operation of the actual rotation detection according to this embodiment is described by taking an example.

FIG. 28 is a matrix table for showing the determination result of rotation or non-rotation of the rotor obtained by changing drive ranks 16/32 to 30/32 used in the seventh embodiment every 1/32 and changing the power supply voltage in steps of 0.15 V from 1.05 V to 1.80 V.

In FIG. 28, the region of the FP indication, the region of the SP indication, the region of the bold italic FP indication, and the region of the bold italic SP indication are the same as those shown in FIG. 4 according to the first embodiment. That is, the rotor cannot be rotated with the normal drive pulse SP within the region of the FP indication, which is correctly determined as non-rotation by the rotation detection circuit 9, while the rotor can be rotated with the normal drive pulse SP within the region of the SP indication, which is correctly determined as rotation by the rotation detection circuit 9. In addition, the rotor can be rotated with the normal drive pulse SP within the region of the bold italic FP indication, which is, however, erroneously determined as non-rotation by the rotation detection circuit 9, while the rotor can be rotated with the normal drive pulse SP within the region of the bold italic SP indication, which is correctly determined as rotation by the rotation detection circuit 9. When the rotation has been successively determined to be exhibited within the region of the bold italic SP indication 240 times, such control as to lower the drive rank to the lowest drive rank is conducted.

In FIG. 28, the region of a bold italic FP2 indication and the region of a bold italic SP2 indication also exist as conditions for being a high voltage and a high drive rank. The rotor can be rotated with the normal drive pulse SP within the region of the bold italic FP2 indication, which is, however, erroneously determined as non-rotation by the rotation detection circuit 9. Therefore, the correction drive pulse is output immediately after the rotation detection (which does not influence the rotation of the rotor), and the drive rank is raised by one rank.

Then, the rotor can be rotated with the normal drive pulse SP within the region of the bold italic SP2 indication, which is correctly determined as rotation by the rotation detection circuit 9. However, a pattern in which the detection signal in the first detection mode is detected within this region is different from that of the region of the bold italic SP indication described above. Therefore, the fact that the current state falls within the region of the bold italic SP2 indication cannot be detected through use of the counter value of the first detection mode determination counter circuit 111. Assuming that the region of the bold italic SP2 indication cannot be detected and is handled equally to the region of the SP indication, in the example of FIG. 28, when the drive rank is in a state in which, for example, the power supply voltage is 1.80 V with the drive rank 30/32, the drive rank becomes stable at that state, which causes an increase in the current consumption due to the output of the normal drive pulse SP at an unnecessarily high drive rank.

The first detection mode non-successive detection counter circuit 131, which serves to detect that the state falls within the region of the bold italic SP2 indication, detects this through use of the fact that this region exhibits the pattern in which the detection signal in the first detection mode is non-successively detected, and counts the number of times of detection thereof. Accordingly, in this embodiment, when the rotation has been successively determined to be exhibited within the region of the bold italic SP2 indication 240 times, such control is conducted as to lower the drive rank to the lowest drive rank in the same manner as with the region of the bold italic SP indication.

FIG. 29 is a diagram for schematically illustrating a change in the drive rank from a state in which a drive rank 30/32 is attained with 1.80 V due to a temporarily imposed load or the like.

With reference to FIG. 29(*d*) "1.80 V Present Invention", in the case of this embodiment, when the rotation has been successively conducted at the drive rank 30/32 of the same normal drive pulse SP 240 times (d-1), the drive rank is lowered straight down to the drive rank 16/32 exhibiting the smallest driving force (d-2). This drive rank 16/32 falls within the region of the SP indication, and hence the drive rank is to be lowered when the rotation has been successively detected 240 times, but the drive rank cannot be lowered any further because of being the lowest drive rank, and becomes stable in the same state as it is.

Next, the operation of the actual rotation detection is described with reference to waveform diagrams by taking a typical example. Note that, the waveform diagrams for the region of the FP indication, the region of the SP indication, the region of the bold italic FP indication, and the region of the bold italic SP indication that are shown in FIG. 28 are not particularly different from the waveform diagrams according to the first embodiment, and correspond to FIG. 7, FIG. 6, FIG. 8, and FIG. 9, respectively. The operations of the rotation detection conducted in those cases are also the same, and hence duplicate descriptions are omitted.

In contrast, the waveform diagrams within the region of the bold italic FP2 indication shown in FIG. 28 are illustrated in FIG. 30. In this case, the normal drive pulse SP having a considerably excessive driving force is applied to the rotor, and hence, as illustrated in FIG. 30(*a*), the current waveform induced in the terminal of the coil includes the waveform c3 which immediately appears after the waveform c1 based on the normal drive pulse SP without the appearance of the waveform c2 unlike in FIG. 6, and includes the waveform c4 having a reversed polarity which appears immediately thereafter (that is, the waveforms c3 and c4 appear at early stages). Therefore, at the time point of 5 ms after a precise second at which the first detection mode is started, the current waveform fall s within the region of the waveform c3, and as illustrated in FIG. 30(*c*), the induced voltage V5 generated by the rotation detection pulse B5 becomes the detection signal exceeding the threshold value voltage Vth of the rotation detection circuit 9. However, the current waveform immediately enters the region of the waveform c4 at the subsequent time point of 6 ms, and hence the induced voltages generated by the rotation detection pulses B6 to B8 do not exceed the threshold value Vth, which inhibits the detection signal from being detected.

Further, at the time point of 9 ms, when the current waveform enters the region of a waveform c6 having a further reversed polarity, the induced voltage V9 generated by the rotation detection pulse B9 again exceeds the threshold value voltage Vth, and hence the detection signal is detected. As a result, two detection signals have been detected in the first detection mode, and the shift is made to the second detection mode.

When the shift is made to the second detection mode, the rotation detection pulses F10 to F12 are applied to the coil from the subsequent timing, that is, the time point of 10 ms illustrated in FIG. 30(*c*). However, at the time points of 10 ms to 12 ms, the current waveform still falls within the region of the waveform c6, and hence the induced voltages V10 to V12 do not exceed the threshold value voltage Vth. The detection signal is not detected at any one of the 3 times of the detection pulse in the second detection mode, and hence the rotation detection circuit 9 erroneously detects the non-rotation of the rotor in this case. As a result, the correction drive pulse FP is output, and the drive rank is raised by one rank.

On the other hand, the waveform diagrams within the region of the bold italic SP2 indication shown in FIG. 28 are illustrated in FIG. 31. Also in this case, the normal drive pulse SP having a considerably excessive driving force is applied to the rotor, and hence, in the same manner as in the example of FIG. 30, as illustrated in FIG. 31(*a*), the current waveform induced in the terminal of the coil includes the waveform c3 which immediately appears after the waveform c1 based on the normal drive pulse SP, and includes the waveform c4 having a reversed polarity which appears immediately thereafter. Also in this case, at the time point of 5 ms after a precise second at which the first detection mode is started, the current waveform falls within the region of the waveform c3, and as illustrated in FIG. 31(*c*), the induced voltage V5 generated by the rotation detection pulse B5 becomes the detection signal exceeding the threshold value voltage Vth of the rotation detection circuit 9. However, the current waveform immediately enters the region of the waveform c4 at the subsequent time point of 6 ms, and hence the induced voltages generated by the rotation detection pulses B6 to B9 do not exceed the threshold value Vth, which inhibits the detection signal from being detected.

Further, at the time point of 10 ms, when the current waveform enters the region of the waveform c6 having the further reversed polarity, the induced voltage V10 generated by the rotation detection pulse 810 again exceeds the threshold value voltage Vth, and hence the detection signal is detected. As a result, two detection signals have been detected in the first detection mode, and the shift is made to the second detection mode.

When the shi ft is made to the second detection mode, the rotation detection pulses F11 to F13 are applied to the coil from the subsequent timing, that is, a time point of 11 ms illustrated in FIG. 31(*b*). At the time point of 11 ms and a time point of 12 ms, in this example, the current waveform still falls within the region of the waveform c6, and hence the induced voltage V11 and an induced voltage V12 do not exceed the threshold value voltage Vth. However, at a time point of 13 ms, the current waveform falls within the region of a waveform c7 having a further reversed polarity. Therefore, an induced voltage V13 generated by the rotation detection pulse F13 exceeds the threshold value voltage Vth, and the detection signal is detected. As a result, the detection is conducted by the second detection mode determination circuit 92, and hence the rotation of the rotor is determined to be successful.

In this manner, when the normal drive pulse SP having a considerably excessive driving force is applied to the coil of the step motor, the detection signals in the first detection mode are separately obtained immediately after a start of the first detection mode and immediately before an end thereof, and the rotation detection pulse from which the detection signal is not obtained exists within that period, which means that the detection signal is non-successively detected.

This state cannot be detected and a number of appearances thereof cannot be counted by the first detection mode determination counter circuit 111, but this state can be detected and the number of appearances thereof can be counted by the first detection mode non-successive detection counter circuit 131. This allows such control as to lower the drive rank to the lowest drive rank when the rotation has been successively detected within the region of the bold italic SP2 indication 240 times.

Modification Example of Seventh Embodiment

Note that, this embodiment is not limited to the one described above, and the same modifications as those described in the first embodiment may be made thereto.

The embodiments of the present invention have been described above in detail with reference to the drawings. However, the embodiments are merely examples of the present invention, and the present invention is not limited to the configuration of the embodiments. Therefore, it should be understood that design changes and the like are encompassed by the present invention without departing from the spirit of the present invention.

For example, the block diagrams of FIG. 1, FIG. 11, and the like are examples, and any other configuration that conducts the above-mentioned operation may be provided. As a method of configuring a system of the block diagram, any control such as control by random logic or control by a microcomputer may be employed. Such a configuration in which the selector 6 is formed of a microcomputer with the other circuits implemented by random logics may be employed. With such a configuration, a change to be applied to a large number of models can be carried out relatively easily.

Note that, the current waveform is changed in a waveform thereof, namely, an output level or a temporal response, due to electric characteristics of the step motor, a voltage value of the driving pulse, or the like. However, the effects of the embodiments can be obtained without depending on the current waveform by setting the number of times of determination of a first detection pulse, the number of times of determination of a second detection pulse, the number of times of cancellation of the second detection mode (number of outputs of the second detection pulse), the threshold value Vth, and the like used in the embodiments to suitable values based on the current waveform.

In addition, the descriptions are made of the modification examples of the respective embodiments, but modifications that can be made to the respective embodiments are not limited to the modification example that are described. For example, it should be understood that a modification obtained by combining features of the respective embodiments with each other is included in the technical scope of the present invention.

The invention claimed is:

1. An electronic timepiece, comprising:

a step motor comprising a coil and a rotor;

a motor driver configured to drive the step motor;

a normal drive pulse generation circuit configured to output a normal drive pulse at a drive rank designated from among normal drive pulses at a plurality of drive ranks different in driving force;

a rotation detection pulse generation circuit configured to output a detection pulse at a predetermined timing after the outputting of the normal drive pulse;

a rotation detection circuit which comprises at least a first detection mode determination circuit configured to conduct a determination in a first detection mode after the outputting of the normal drive pulse and which is configured to detect rotation or non-rotation of the rotor based on a detection signal generated by the detection pulse;

a rotation determination counter circuit configured to count a number of times that the rotation has been successively detected by the rotation detection circuit;

a first detection mode determination counter circuit configured to count a number of times that the detection signal generated by the detection pulse becomes a predetermined detection pattern in the first detection mode; and a drive rank selection circuit configured to designate a drive rank of the normal drive pulse to be output by the normal drive pulse generation circuit based on results of the counting conducted by the rotation determination counter circuit and the first detection mode determination counter circuit.

2. The electronic timepiece according to claim 1, wherein:

the first detection mode determination circuit is further configured to detect the rotation or non-rotation of the rotor based on a c3 current detection pulse being a detection pulse output to a side different from a terminal to which the normal drive pulse is output; and the first detection mode determination counter circuit is further configured to count a number of times that a detection signal generated by the c3 current detection pulse has been, or has not been, detected prior to a predetermined timing.

3. The electronic timepiece according to claim 1, wherein:

the first detection mode determination circuit is further configured to detect the rotation or non-rotation of the rotor based on a c3 current detection pulse being a detection pulse output to a side different from a terminal to which the normal drive pulse is output; and the first detection mode determination counter circuit is further configured to count a number of times that a detection signal generated by a c2 current detection pulse, being a detection pulse output to the same side as the terminal to which the normal drive pulse is output has been, or has not been, detected.

4. The electronic timepiece according to claim 1, wherein the first detection mode determination counter circuit is further configured to count a number of times that the detection signal generated by the detection pulse has been, or has not been, non-successively detected.

5. The electronic timepiece according to claim 1, wherein the drive rank selection circuit is further configured to:

change the drive rank to be designated when the number of times counted by the rotation determination counter circuit reaches a predetermined number of times; and alter a manner of changing the drive rank based on whether or not the number of times counted by the first detection mode determination counter circuit is equal to or larger than a first predetermined number.

6. The electronic timepiece according to claim 5, wherein the drive rank selection circuit is further configured to select any one of the drive rank exhibiting a driving force smaller than a current drive rank by two or more ranks and the drive rank exhibiting a driving force smaller than the current drive rank by one rank, based on whether or not the number of times counted by the first detection mode determination counter circuit is equal to or larger than the first predetermined number.

7. The electronic timepiece according to claim 6, wherein the drive rank exhibiting a smallest driving force is selected when the number of times counted by the first detection mode determination counter circuit becomes equal to or larger than the first predetermined number.

8. The electronic timepiece according to claim 5, wherein the drive rank selection circuit is further configured to select any one of: the drive rank exhibiting a driving force larger than a current drive rank by one rank; the drive rank exhibiting a smallest driving force; and the drive rank exhibiting a driving force smaller than the current drive rank by one rank, based on whether or not the number of times counted by the first detection mode determination counter circuit is equal to or larger than the first predetermined number and whether or not the current drive rank is the drive rank exhibiting a largest driving force.

9. The electronic timepiece according to claim 5, wherein the predetermined number of times required for a change in the drive rank to be designated by the drive rank selection circuit is changed based on whether or not the number of times counted by the first detection mode determination counter circuit is equal to or larger than a second predetermined number.

10. The electronic timepiece according to claim 9, wherein the predetermined number of times is reduced based on whether or not the number of times counted by the first detection mode determination counter circuit is equal to or larger than the second predetermined number.

11. The electronic timepiece according to claim 9, wherein the first predetermined number and the second predetermined number are different from each other.

12. The electronic timepiece according to claim 1, further comprising a power supply voltage detection circuit configured to detect a voltage of a power source, wherein the drive rank selection circuit is further configured to alter a manner of changing the drive rank based on a detection result obtained by the power supply voltage detection circuit.

13. The electronic timepiece according to claim 12, wherein the drive rank selection circuit is further configured to select the drive rank exhibiting a smallest driving force when the power supply voltage detection circuit detects a voltage value larger than that of a predetermined voltage.

14. The electronic timepiece according to claim 1, wherein the drive rank selection circuit is configured to restrict a change in the drive rank in a case where a detection result of conducting the counting by the first detection mode determination counter circuit is obtained when the normal drive pulse is output to only a specific terminal.

15. The electronic timepiece according to claim 1, further comprising a correction drive pulse generation circuit configured to generate and output a correction drive pulse to be output when the non-rotation is detected by the rotation detection circuit.

16. The electronic timepiece according to claim 1, wherein the rotation detection circuit further comprises a second detection mode determination circuit configured to conduct a determination in a second detection mode after the first detection mode is brought to an end.

* * * * *